US006648364B2

(12) United States Patent
Okajima et al.

(10) Patent No.: US 6,648,364 B2
(45) Date of Patent: Nov. 18, 2003

(54) SNOWBOARD BINDING SYSTEM

(75) Inventors: Shinpei Okajima, Izumi (JP); Kimitaka Takahama, Izumiohtsu (JP)

(73) Assignee: Shimano Inc., Osaka (JP)

( * ) Notice: Subject to any disclaimer, the term of this patent is extended or adjusted under 35 U.S.C. 154(b) by 35 days.

(21) Appl. No.: 10/108,302

(22) Filed: Mar. 28, 2002

(65) Prior Publication Data

US 2002/0153704 A1 Oct. 24, 2002

Related U.S. Application Data

(63) Continuation-in-part of application No. 10/074,253, filed on Feb. 14, 2002, which is a continuation-in-part of application No. 09/997,241, filed on Nov. 30, 2001, now Pat. No. 6,536,795, which is a continuation-in-part of application No. 09/921,307, filed on Aug. 3, 2001, which is a continuation-in-part of application No. 09/836,545, filed on Apr. 18, 2001.

(51) Int. Cl.[7] ..... A63C 9/18

(52) U.S. Cl. ..... 280/613; 280/617; 280/632; 280/634; 36/117.3

(58) Field of Search ..... 280/617, 618, 280/623, 626, 628, 632, 634, 635, 14.21, 14.22, 14.24, 613, 614, 615; 36/115, 117.1, 117.2, 117.3, 132

(56) References Cited

U.S. PATENT DOCUMENTS 4,177,584 A * 12/1979 Beyl ..... 280/613
4,722,613 A * 2/1988 Jungkind ..... 280/615
4,728,115 A * 3/1988 Pozzobon et al. ..... 280/613
5,007,656 A * 4/1991 Girault et al. ..... 280/615
5,193,840 A * 3/1993 Spitaler et al. ..... 280/615
5,704,139 A * 1/1998 Okajima ..... 36/115
5,722,680 A 3/1998 Dodge
5,906,058 A 5/1999 Rench et al.
5,944,337 A * 8/1999 Girard et al. ..... 280/615
6,062,586 A * 5/2000 Korman ..... 280/613
6,099,018 A 8/2000 Maravetz et al.
6,123,354 A 9/2000 Laughlin et al.
6,164,682 A 12/2000 Okajima et al.
6,213,493 B1 * 4/2001 Korman ..... 280/613
6,322,096 B2 * 11/2001 Porte ..... 280/617
6,530,590 B2 * 3/2003 Okajima et al. ..... 280/613
6,536,795 B2 * 3/2003 Okajima et al. ..... 280/613

* cited by examiner

*Primary Examiner*—Brian L. Johnson
*Assistant Examiner*—Bridget Avery
(74) *Attorney, Agent, or Firm*—Shinjyu Global IP Counselors, LLP

(57) ABSTRACT

A snowboard binding system has a boot and a binding configured to be releasably coupled together. The boot has an upper potion, a sole portion, a front catch and at least one rear catch. The binding includes a base member, a rear binding arrangement and a front binding arrangement. The rear binding arrangement selectively engages at least one rear catch of the heel of the boot. The front binding arrangement selectively engages the front catch that extends downwardly from of the sole portion of the boot. The front binding arrangement and the front catch are arranged to limit forward and rearward movement of the boot relative to the binding and prevent premature release of the front catch from the front binding arrangement.

36 Claims, 51 Drawing Sheets

SNOWBOARD BINDING SYSTEM

CROSS-REFERENCE TO RELATED APPLICATIONS

This application is a continuation-in-part application of U.S. patent application Ser. No. 10/074,253 filed on Feb. 14, 2002, which is a continuation-in-part application of U.S. patent application Ser. No. 09/997,241 filed on Nov. 30, 2001 and now U.S. Pat. No. 6,536,795, which is a continuation-in-part application of U.S. patent application Ser. No. 09/921,307 filed on Aug. 3, 2001, which is a continuation-in-part application of U.S. patent application Ser. No. 09/836,545 filed on Apr. 18, 2001. The entire disclosures of U.S. patent application Ser. Nos. 10/074,253, 09/997,241, 09/921,307 and 09/836,545 are hereby incorporated herein by reference.

BACKGROUND OF THE INVENTION

1. Field of the Invention

The present invention generally relates to a snowboard binding system for releasably coupling a snowboard boot to a snowboard. More specifically, the present invention relates to a snowboard binding system that is easy to step-in and step-out of, and which maintains a tight coupling between the snowboard boot and the snowboard binding.

2. Background Information

In recent years, snowboarding has become a very popular winter sport. In fact, snowboarding was also an Olympic event during the winter games at Nagano, Japan. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. The snowboarder stands with both feet on the snowboard in a direction generally transverse to the longitudinal axis of the snowboard. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, his or her movements must be transmitted from the boots worn by the rider to the snowboard in order to maintain control of the snowboard. For example, when a snowboarder leans backward, the movement causes the snowboard to tilt accordingly turning in the direction of the lean. Similarly, leaning forward causes the board to tilt in a corresponding manner and thus causing the snowboard to turn in that direction.

Generally, the snowboarding sport may be divided into alpine and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots are typically worn.

Boots that are used for skiing and/or snowboarding must have a high degree of rigidity for effecting steering while skiing and snowboarding. In particular, when snowboarding it is important that the rider be able to lean to the side, backward and forward with respect to the snowboard. The motion corresponding to the direction of the lean of the rider is transmitted through the boots to the snowboard (or skis) to effect turning or braking. Therefore, it is extremely important that the boots worn by the rider have sufficient rigidity to transfer such leaning motion to the snowboard or skis.

In particular, the back side of a snowboard boot must be rigid in order to provide the appropriate support for controlling movement of the snowboard. Further, as the art of snowboarding has developed, riders have found that snowboard boots provide optimal support when the back side of the snowboard boots are inclined slightly, such that the knees of the rider are always slightly bent when wearing the boots on level ground. Therefore, standing up straight with knees straight when wearing inclined snowboard boots is not always comfortable. Further, walking in such snowboard boots is sometimes awkward.

Recently, snowboard boots have been developed which allow a rider to adjust and change the inclination of inclined backside snowboard boots. For example, there are snowboard boots which include a member known as a highback support that is secured to the snowboard boot by pins which allow the highback support to pivot about the pins. The highback support extends up the back side of the boot and when locked into position fixes the back side of the boot into a predetermined inclined position that is optimal for snowboarding. When unlocked, the highback support can pivot back and allow the rider wearing the boot to stand up straight and walk more freely without having to keep the knees bent. A simple bar is used with such a boot for locking the highback support in place. Typically, the bar braces the highback support into position. An upper end of the bar is fixed to an upper portion of the highback support by a pivot pin. A lower end of the bar is configured to fit into a hook formed in a lower portion of the boot. When a rider is wearing the boots, the rider must lean forward in order to fit the bar into and out of position. The lean forward requires a significant amount of effort due to the overall rigidity of the snowboard boots and therefore the bar configuration, especially in the snow and cold, can be difficult for some riders to release and/or engage.

In recent years, snowboard bindings have been designed that securely lock to the snowboard boots, but can be released by the snowboarder after riding. Sometimes these bindings are difficult to engage due to buildup of snow and or cold. Moreover, these bindings can be difficult to release the snowboarder's boots. Furthermore, these bindings can be uncomfortable when riding the snowboard due to continued shock between the snowboard boots and the bindings.

In view of the above, there exists a need for a snowboard binding which overcomes the above mentioned problems in the prior art. This invention addresses this need in the prior art as well as other needs, which will become apparent to those skilled in the art from this disclosure.

SUMMARY OF THE INVENTION

One object of the present invention is to provide a snowboard binding system that is relatively easy to step-in and step-out of and which maintains a tight coupling between the snowboard boot and the snowboard binding.

Another object of the present invention is to provide a snowboard binding system that has at least two height adjustment positions for accommodating snow between the snowboard binding and the sole of the snowboard boot.

Another object of the present invention is to provide a snowboard binding system which eliminates the rear binding beneath the sole of the snowboard boot.

Still another object of the present invention is to provide a snowboard binding system that is relatively simple and inexpensive to manufacture and assemble.

Still another object of the present invention is to provide a snowboard binding system that is relatively lightweight.

Still another object of the present invention is to provide a snowboard binding system that is relatively easy to step-in and step-out of without holding a release lever in a certain position.

Yet still another object of the present invention is to provide a snowboard binding, which reduces shock and improves power transfer between the sole of the snowboard boot and the snowboard binding.

In accordance with one aspect of the present invention, a snowboard binding is provided that comprises a base member, a rear binding arrangement and a front binding arrangement. The base member has a front portion, a rear portion and a longitudinal axis extending between the front and rear portions. The rear binding arrangement is coupled to the rear portion of the base member. The front binding arrangement is coupled to the front portion of the base member. The front binding arrangement includes a front claw and a stop member that form a front catch receiving area. The front claw is pivotally coupled to the front portion of the base member to move between a release position and a latched position. The stop member is coupled to the front portion of the base member adjacent the front claw. The stop member has a front stop surface facing in a rearward direction that is substantially facing toward the rear portion of the base member to prevent a front catch of a boot from moving the front claw from the latched position to the release position when the front catch is located in the front catch receiving area.

In accordance with another aspect of the present invention, a snowboard boot is provided that comprises an upper portion, a sole portion, at least one rear catch and a front catch. The upper portion includes a foot section and a leg section extending upwardly from the foot section. The sole portion is fixedly coupled to the foot section of the upper portion. The sole portion has a toe section, a mid section and a heel section with a forward to rearward longitudinal axis extending between the toe section and the heel section. The rear catch is located at the heel section of the sole portion. The front catch is coupled to the toe section of the sole portion. The front catch has a pair of leg portions extending downwardly from the toe section of the sole portion and a tongue portion extending laterally between the leg portions of the front catch. The tongue portion of the front catch has a non-planar lower surface with a front end and a rear end. The rear end of the lower surface is spaced further from the sole portion than the front end of the lower surface.

In accordance with another aspect of the present invention, a snowboard binding system is provided that comprises a snowboard binding and a snowboard boot configured to be releasably coupled to the snowboard binding. The snowboard binding includes a base member, a rear binding arrangement and a front binding arrangement. The base member has a front portion, a rear portion and a binding longitudinal axis extending between the front and rear portions. The rear binding arrangement is coupled to the rear portion of the base member. The front binding arrangement is coupled to the front portion of the base member. The front binding arrangement includes a front claw and a stop member that form a front catch receiving area. The front claw is pivotally coupled to the front portion of the base member to move between a release position and a latched position. The stop member is coupled to the front portion of the base member adjacent the front claw. The snowboard boot includes an upper portion, a sole portion, at least one rear catch and a front catch. The upper portion includes a foot section and a leg section extending upwardly from the foot section. The sole portion is fixedly coupled to the foot section of the upper portion. The sole portion has a toe section, a mid section and a heel section with a forward to rearward longitudinal axis extending between the toe section and the heel section. The rear catch is located at the heel section of the sole portion. The rear catch is configured to be releasably coupled to the rear binding arrangement. The front catch is coupled to the toe section of the sole portion. The front catch is configured to be releasably coupled to the front binding arrangement via the front claw. The front claw, the stop member and the front catch are arranged and configured to prevent the front catch of the boot from moving the front claw from the latched position to the release position when the front catch is located in the front catch receiving area.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 12(*b*) is a diagrammatic, partial cross-sectional view of the rear binding member and the snowboard boot illustrated in FIG. 12(*a*) with the snowboard boot and rear binding member moved to an deflected locked or latched position;

FIG. 13(*b*) is a partially exploded perspective view of the snowboard binding illustrated in FIGS. 1, 2 and 5–8 with the rear binding members removed for the purpose of illustration;

FIG. 14(*b*) is a rear end elevational view of the latch member illustrated in FIG. 14(*a*);

FIG. 14(*c*) is an inside elevational view of the latch member illustrated in FIGS. 14(*a*) and 14(*b*);

FIG. 14(*d*) is a top, plan view of the latch member illustrated in FIGS. 14(*a*)–14(*c*);

FIG. 14(*e*) cross-sectional view of the latch member illustrated in FIGS. 14(*a*)–14(*d*) as seen along section line 14(*e*)–14(*e*) of FIG. 14(*c*);

FIG. 14(*f*) cross-sectional view of the latch member illustrated in FIGS. 14(*a*)–14(*e*) as seen along section line 14(*f*)–14(*f*) of FIG. 14(*c*);

FIG. 14(*g*) cross-sectional view of the latch member illustrated in FIGS. 14(*a*)–14(*f*) as seen along section line 14(*g*)–14(*g*) of FIG. 14(*a*);

FIG. 111 is an enlarged top plan view of the front stop member (of the front binding arrangement of the snowboard binding) of the snowboard binding system illustrated in FIGS. 97–101;

FIG. 112 is a side elevational view of the front stop member illustrated in FIG. 111;

FIG. 113 is a rear end elevational view of the front stop member illustrated in FIGS. 111 and 112;

FIG. 114 is a cross-sectional view of the front stop member illustrated in FIGS. 111–113, as seen along section line 114—114 of FIG. 111;

FIG. 115 is a top plan view of the front binding member (of the front binding arrangement of the snowboard binding) of the snowboard binding system illustrated in FIGS. 97–101;

FIG. 116 is a side elevational view of the front binding member illustrated in FIG. 115;

FIG. 117 is a front elevational view of the front binding member illustrated in FIGS. 115 and 116;

FIG. 118 is a partial, inclined elevational view of the front claw of the front binding member illustrated in FIGS. 115–117, as seen along arrow 118 of FIG. 116;

FIG. 119 is a bottom plan view of the front binding member illustrated in FIGS. 115–118; and FIG. 120 is a partial, inclined elevational view of the front claw illustrated in FIGS. 115–119, as seen along arrow 120 of FIG. 116.

DETAILED DESCRIPTION OF THE PREFERRED EMBODIMENTS

Figure 1:
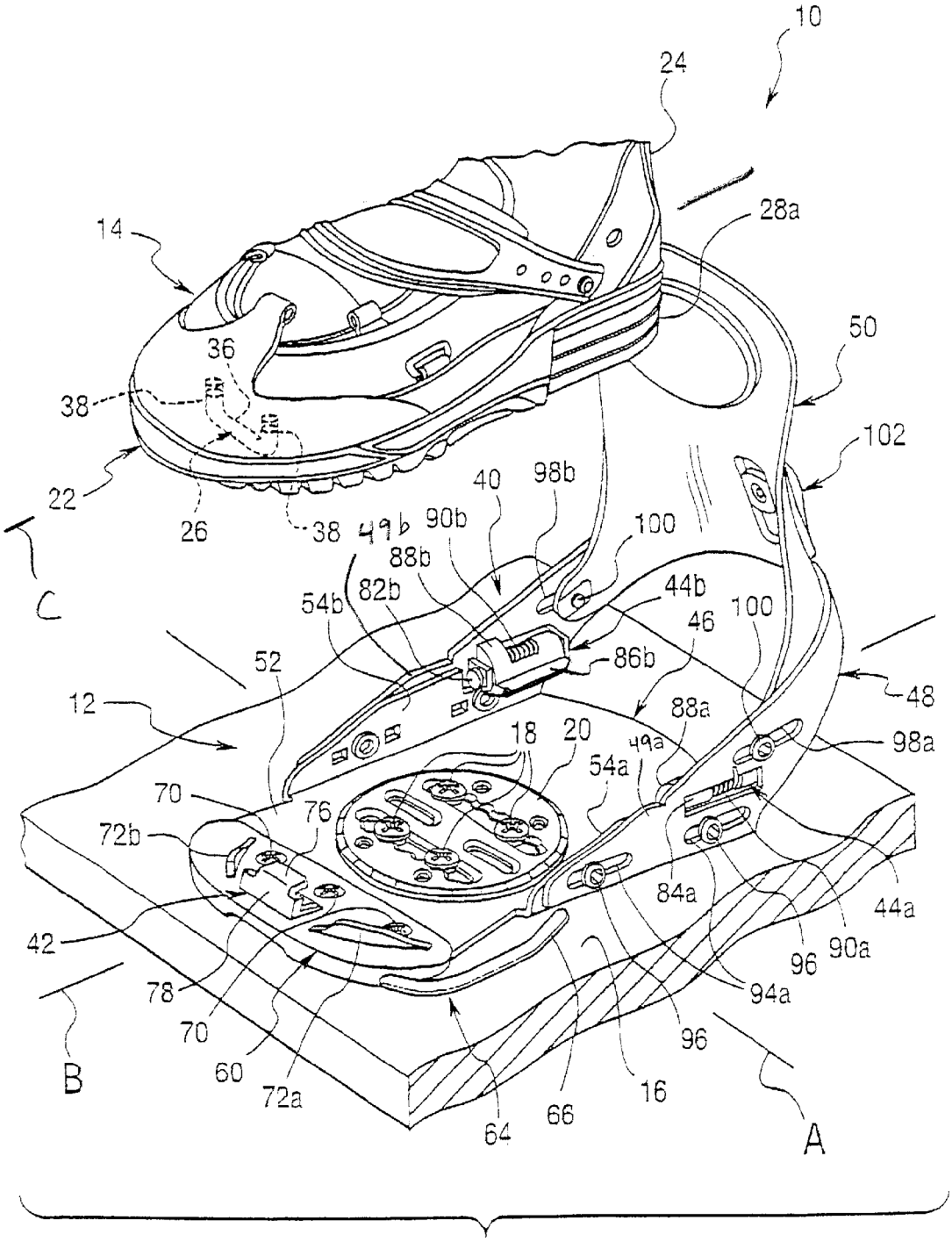
FIG. 1 is a perspective view of a snowboard binding system having a snowboard binding fixed to a snowboard and a snowboard boot in accordance with a first embodiment of the present invention.
Figure 2:
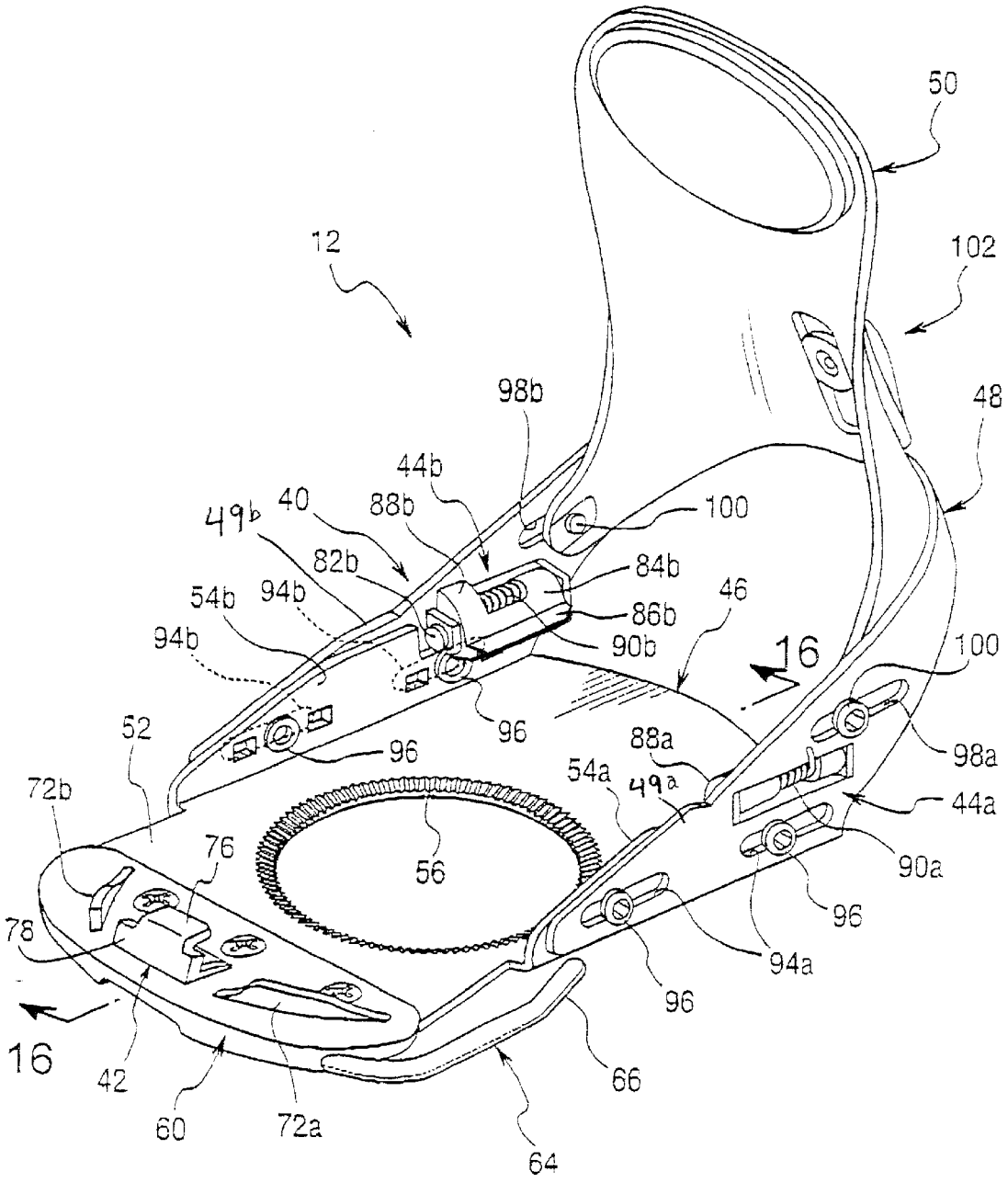
FIG. 2 is an enlarged perspective view of the snowboard binding illustrated in FIG. 1 with the snowboard binding removed from the snowboard.

Referring initially to FIGS. 1 and 2, a snowboard binding system 10 is illustrated in accordance with a preferred embodiment of the present invention. The snowboard binding system 10 basically includes a snowboard binding 12 and a snowboard boot 14. The snowboard binding 12 is attached to the top or upper surface of the snowboard 16 via four fasteners or screws 18 in a conventional manner. The longitudinal axis of the snowboard 16 is represented by the centerline A in FIG. 1. It will be apparent to those skilled in the art from this disclosure that a pair of snowboard binding systems 10 are utilized in conjunction with the snowboard 16 such that the rider has both feet firmly attached to the snowboard 16. Preferably, two adjustment disks 20 are used to adjustably couple the pair of snowboard binding systems 10 to the snowboard 16 via the screws 18. For the sake of brevity, only a single snowboard binding system 10 will be discussed and/or illustrated herein.

The snowboard boot 14 of the present invention is preferably a relatively soft or flexible snowboard boot. Soft snowboard boots are well known in the art, and thus, the snowboard boot 14 will not be discussed or illustrated in detail herein, except as the snowboard boot 14 relates to snowboard binding system 10 of the present invention. Basically, the snowboard boot 14 has a sole portion 22 made of a stiff rubber-like material, and a flexible upper portion 24 constructed of a variety of materials, such as plastic materials, leather and/or synthetic leather materials. Thus, the upper portion 24 of a soft snowboard boot should be somewhat flexible.

Figure 3:
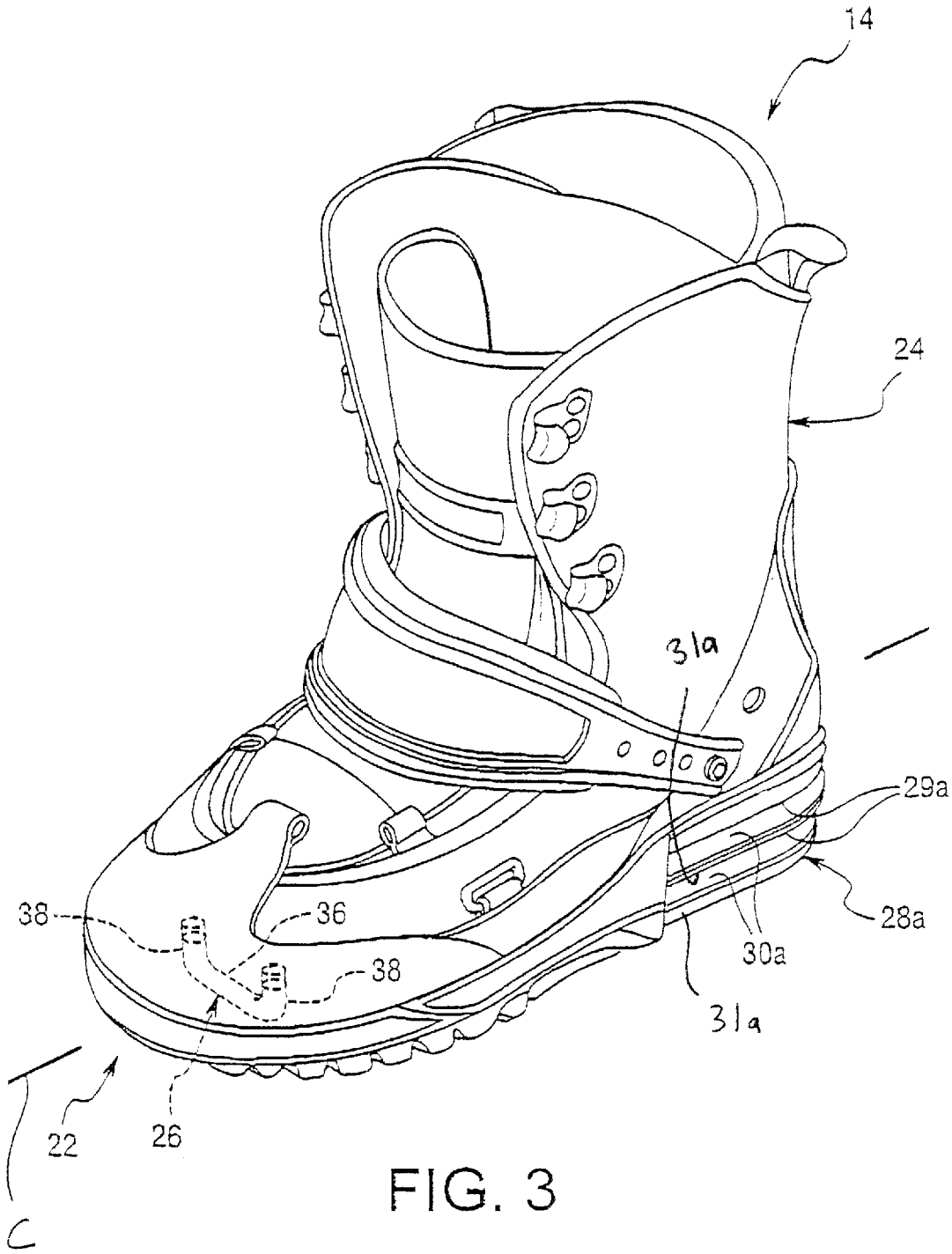
FIG. 3 is an enlarged, top perspective view of the entire snowboard boot illustrated in FIG. 1.
Figure 4:
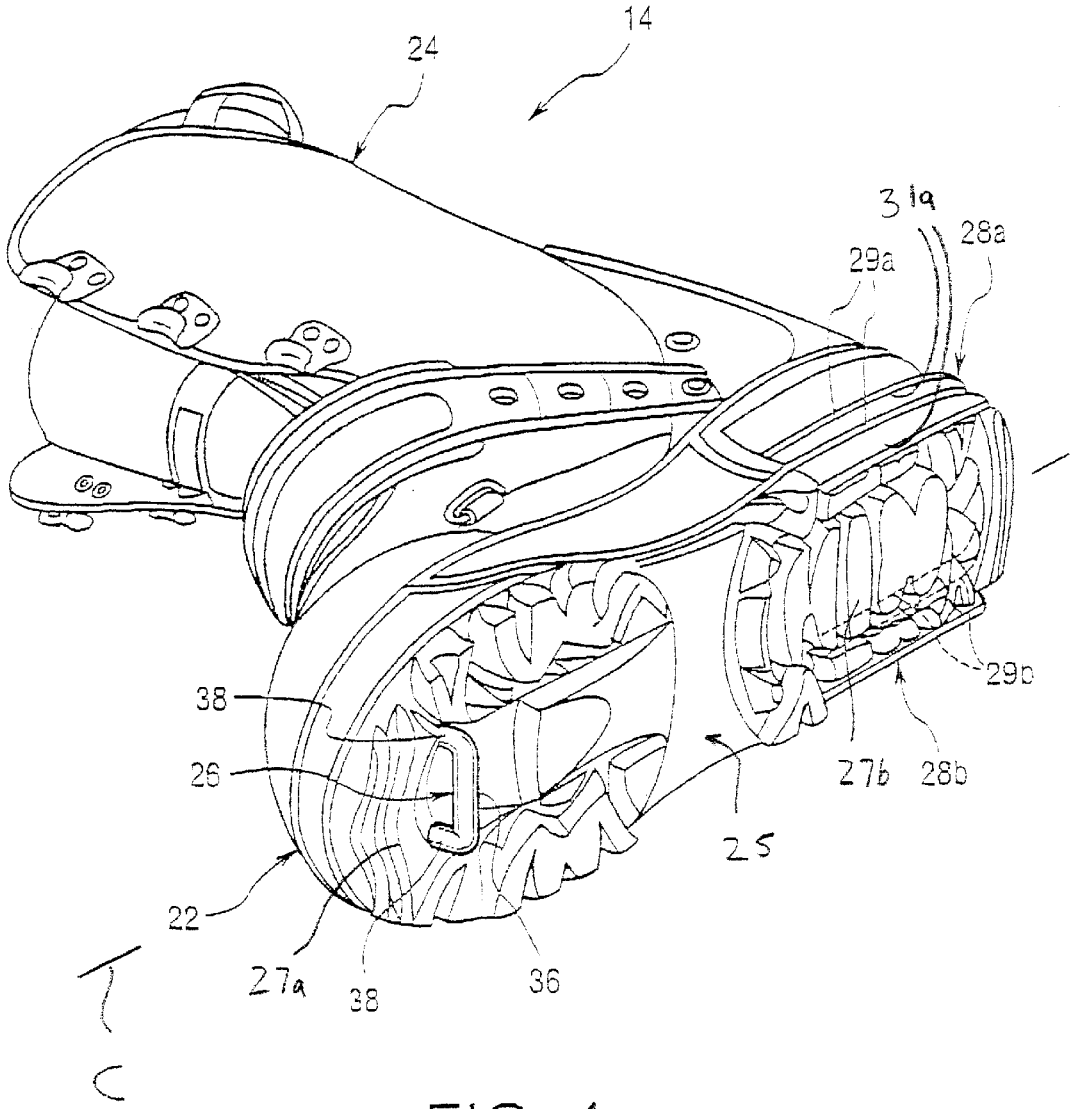
FIG. 4 is a bottom perspective view of the entire snowboard boot illustrated in FIG. 3.

The upper portion 24 is coupled to the sole portion 22, as seen in FIGS. 3 and 4. The upper portion 24 is not critical to the present invention, and thus, will not be discussed or illustrated in detail herein. The sole portion 22 has a toe section 27*a* and a heel section 27*b* with a boot center longitudinal axis C extending between the toe section 27*a* and the heel section 27*b*. A front catch 26 is located at the toe section or front part 27*a* of the sole portion 22 and extends downwardly from a bottom surface 25 of the sole portion 22. A first rear catch 28*a* is located at a first lateral side of the sole portion 22, while a second rear catch 28*b* is located at a second lateral side of the sole portion 22. The front catch 26 is fixedly coupled to the sole portion 22 of the snowboard boot 14 at the toe section 27*a*. The rear catches 28*a* and 28*b* are preferably molded into the lateral sides of the sole portion 22 at the heel section 27*b*.

More specifically, the front catch 26 is preferably either molded into the sole portion 22 of the snowboard boot 14 or attached thereto via fasteners (not shown). Referring again to FIGS. 1, 3 and 4, the front catch 26 is basically a U-shaped member with a tongue portion 36 and a pair of leg portions 38 extending from the tongue portion 36. As should be appreciated from this disclosure, the present invention is not limited to the precise construction of the front catch 26. Rather, the front catch 26 can be implemented in any number of ways, and the present invention is not limited to the particular implementations shown in the drawings, which are provided merely for purposes of illustration. In any event, the front catch 26 is preferably constructed of hard rigid material, such as steel or any other suitable material, and is fixedly coupled to the snowboard boot 14. The front catch 26 is configured to engage a portion of the snowboard binding 12, as discussed below in more detail.

As mentioned above, the rear catches 28*a* and 28*b* are preferably molded into the sole portion 22 of the snowboard boot 14. Alternatively, the rear catches 28*a* and 28*b* could be removable, and could be attached to the snowboard boot 14 via fasteners (not shown). In any event, each of the rear catches 28*a* or 28*b* is preferably designed to engage the snowboard binding 12 at a plurality of engagement or locked positions having different heights relative to the snowboard binding 12. Preferably the rear catches 28*a* and 28*b* are mirror images of each other. Accordingly, both of the rear catches 28*a* and 28*b* will not be discussed and/or illustrated in detail herein. Rather, it will be apparent to those skilled in the art from this disclosure that the descriptions/illustrations of the rear catch 28*a* also applies to the rear catch 28*b* and vice versa. However, it will also be apparent to those skilled in the art from this disclosure that various modifications can be made to one or both of the rear catches 28*a* and 28*b* without departing from the scope of the present invention.

More specifically, the rear catch 28*a* is formed by molding a plurality (only two illustrated) of longitudinally extending, substantially V-shaped grooves or notches 29*a* into a (first) lateral side of the sole portion 22 of the snowboard boot 14. The rear catch 28*b* is formed by molding a plurality (only two illustrated) of longitudinally extending, substantially V-shaped grooves or notches 29*b* into an opposite (second) lateral side of the sole portion 22 of the snowboard boot 14. Thus, in the illustrated embodiment, the rear catches 28*a* and 28*b* are integrally formed with the sole portion 22. In any case, the (first) rear catch 28*a* preferably includes at least one (first) groove 29*a*, while the (second) rear catch 28*b* preferably includes at least one (second) groove 29*b*.

As best shown in FIGS. 3–5 and 9–12(*b*), each of the notches or grooves 29*a* preferably has a concave abutment surface. 30*a* generally angled relative to the bottom surface of sole portion 22. Each of the notches or grooves 29*b* also preferably has a concave abutment surface 30*b* generally angled relative to the bottom surface of the sole portion 22. Preferably, each of the abutment surfaces 30*a* or 30*b* is a smooth curved surface. In other words, abutment surfaces 30*a* and 30*b* taper downwardly away from and curve laterally away from a center plane of snowboard boot 14 and are configured to engage the snowboard binding 12 to prevent upward movement of snowboard boot 14 relative to the snowboard binding 12. Thus, the abutment surfaces 30*a* or 30*b* preferably face upwardly and outwardly from a center longitudinal axis C of the sole portion 22, and are configured/shaped to mate with the snowboard binding 12.

Preferably, the rear catch 28*a* includes a pair of (first) ramp surfaces 31*a* located directly below the concave abutment surfaces 30*a* of the grooves 29*a*, respectively. The ramp surfaces 31*a* serve for guiding the boot 14 into the binding 12, as discussed below. Thus, the ramp surfaces 31 a are located between the bottom surface 25 of the sole portion 22 and the corresponding one of the concave abutment surfaces 30*a*. The ramp surfaces 31 a are preferably planar surfaces that face downwardly and outwardly from the boot center longitudinal axis C. An outer 30 convex curved transitional surface is formed between adjacent ones of the ramp surfaces 31*a* and the concave abutment surfaces 30*a*, respectively. Thus, the ramp surface 31*a* and the concave abutment surfaces 30*a* form a zigzag pattern in the rear catch 28*a*.

Likewise, the rear catch 28*b* preferably includes a pair of (second) ramp surfaces 31*b* located directly below the concave abutment surfaces 30*b* of the grooves 29*b*, respectively. The ramp surfaces 31*b* serve for guiding the boot 14 into the binding 12, as discussed below. Thus, the ramp surfaces 31*b* are also located between the bottom surface 25 of the sole portion 22 and the corresponding one of the concave abutment surfaces 30*b*. The ramp surfaces 31*b* are preferably planar surfaces that face downwardly and outwardly from the boot center longitudinal axis C. An outer convex curved transitional surface is also formed between adjacent ones of the ramp surfaces 31*b* and the concave abutment surfaces 30*b*, respectively. Thus, the ramp surface 31*b* and the concave abutment surfaces 30*b* form a zigzag pattern in the rear catch 28*a*.

The term "concave abutment surface" used herein means a recessed surface having an effective curvature. Thus, a "concave abutment surface" can be formed of one or more curved surfaces, or two or more flat and/or curved surfaces to form an overall recessed or concave shaped surface.

Of course, it will be apparent to those skilled in the art from this disclosure, that the snowboard boot 14 could be designed to have additional engagement or locked positions at different heights if needed and/or desired. For example, the snowboard boot 14 could be designed to have three different engagement positions with three different heights (i.e. three longitudinally extending, substantially V-shaped grooves), respectively. However, it should be appreciated from this disclosure that the present invention is not limited to the precise construction of the rear catches 28*a* and 28*b*. Rather, the rear catches 28*a* and 28*b* can be implemented in any number of ways, and the present invention is not limited to the particular implementations shown in the drawings, which are provided merely for the purposes of illustration.

Referring again to FIGS. 1 and 2, the snowboard binding 12 is preferably a highback binding that applies a forward leaning force on the snowboard boot 14. The snowboard binding 12 basically has a base member 40, a front binding member 42 and a pair (first and second) of rear binding members 44*a* and 44*b*. The front binding member 42 is movably coupled to the base member 40 between a release position and a latched position. The pair (first and second) of rear binding members 44*a* and 44*b* are coupled to opposite lateral sides of the base member 40 as discussed in more detail below.

The base member 40 basically includes a base plate 46 adjustably coupled to the snowboard 16 via the adjustment disk 20, a heel cup 48 adjustably coupled to the base plate 46 and a highback 50 adjustably coupled to the heel cup 48. The snowboard binding 12 is preferably adjustably coupled to snowboard 16 via the adjustment disk 20. The rear binding members 44*a* and 44*b* are movable relative to the base member 40 to selectively hold the snowboard boot 14 thereto. The rear binding members 44*a* and 44*b* form a rear binding arrangement. The rear binding members 44*a* and 44*b* are arranged to move laterally apart relative to each other from the initial rest positions or latched positions (FIG. 9) to the guide positions or coupling positions (FIG. 10) upon application of a force in a direction substantially towards the base member 40. The rear binding members 44*a* and 44*b* are also arranged to move laterally toward each other or together to one of the locked or latched positions (FIG. 11 or FIG. 12) upon removal of the force.

More specifically, the snowboard boot 14 is releasably coupled to the snowboard binding 12 by first hooking the front catch 26 of the snowboard boot 14 on the front binding member 42. Next, the heel section 27*b* of the snowboard boot 14 is pressed downwardly so that the rear catches 28*a* and 28*b* engage the rear binding members 44*a* and 44*b*. This downward movement of the boot causes the lower pair of ramp surfaces 31*a* and 31*b* to initially contact the rear binding members 44*a* and 44*b*, respectively, such that the rear binding members 44*a* and 44*b* move laterally apart. Further downward movement of the snowboard boot 14 causes the rear binding members 44*a* and 44*b* to move laterally towards each other and into the lower pair of grooves 29*a* and 29*b*, respectively. Even further downward movement of the snowboard boot 14 causes the rear binding members 44*a* and 44*b* to contact the upper pair of ramp surfaces 31*a* and 31*b* to again move apart, until the rear binding member 44*a* and 44*b* engage the upper pair of grooves 29*a* and 29*b*, respectively. Thus, the rear binding members 44*a* and 44*b* are arranged to selectively hold the snowboard boot 14 in a plurality of engagement or locked positions having different heights above the base member 40.

The adjustment disk 20 is attached to the snowboard 16 via fasteners or screws 18 that clamp the base plate 46 of the base member 40 to the top surface of the snowboard 16, as seen in FIG. 1. Accordingly, the base member 40 is angularly adjustable relative to the adjustment disk 20 and the snowboard 16 by loosening the fasteners or screws 18. Of course, the base plate 46 of the base member 40 could be attached directly to the snowboard 16, as needed and/or desired. It should be appreciated by those skilled in the art from this disclosure that the attachment of the base member 40 to the snowboard 16 can be accomplished in a number of ways. Moreover, the present invention is not limited to any particular implementation.

Figure 17:
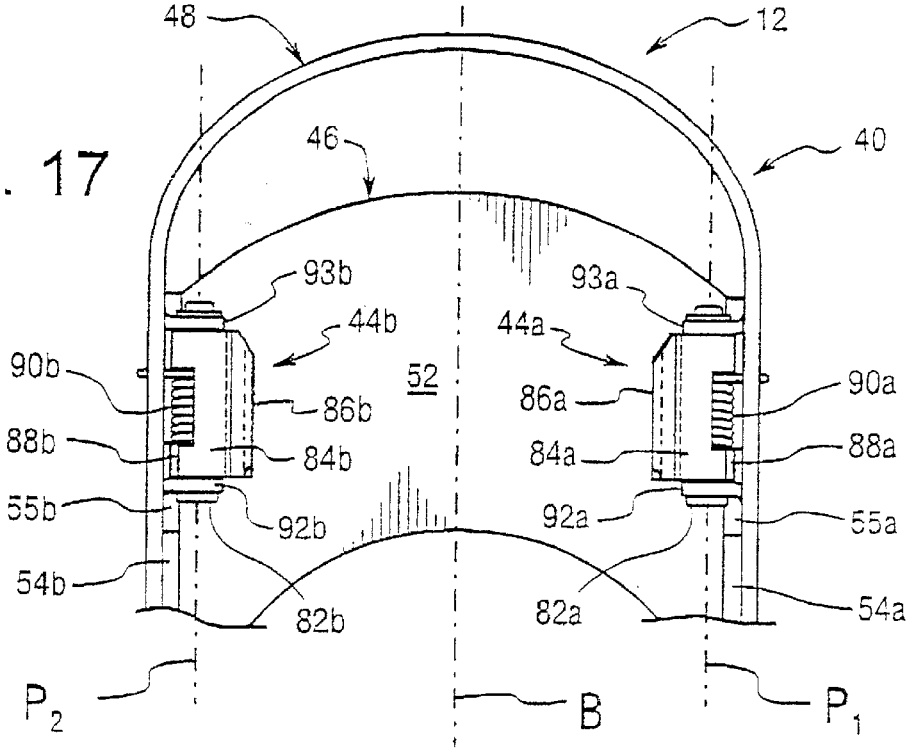
FIG. 17 is a diagrammatic, top plan view of a portion of the snowboard binding illustrated in FIGS. 1, 2 and 5–16.

As seen in FIGS. 1 and 2, the base plate 46 of the base member 40 preferably has a mounting portion 52 and a pair (first and second) of side attachment sections 54*a* and 54*b*. Preferably, the base plate 46 is constructed of a hard, rigid material. Examples of suitable hard rigid materials for the base plate 46 include various metals as well as carbon and/or a metal/carbon combination. In the preferred embodiment, the mounting portion 52 and the side attachment sections 54*a* and 54*b* are formed by bending a metal sheet material. Thus, the base plate 46 is a one-piece, unitary member. The side attachment sections 54*a* and 54*b* are preferably substantially parallel to each other and perpendicular to the mounting portion 52, as seen in FIG. 17. Alternatively, the side attachment sections 54*a* and 54*b* can taper slightly outwardly from (i.e. away from) each other from the rear portion of the snowboard binding 12 toward the front portion of the snowboard binding 12, as discussed below in reference to another embodiment of the present invention. The mounting portion 52 has a central opening 56 for receiving the adjustment disk 20 therein. Preferably, the opening 56 has a beveled edge that is serrated to form teeth for engaging a corresponding bevel edge with mating teeth of the adjustment disk 20.

Figure 13A:
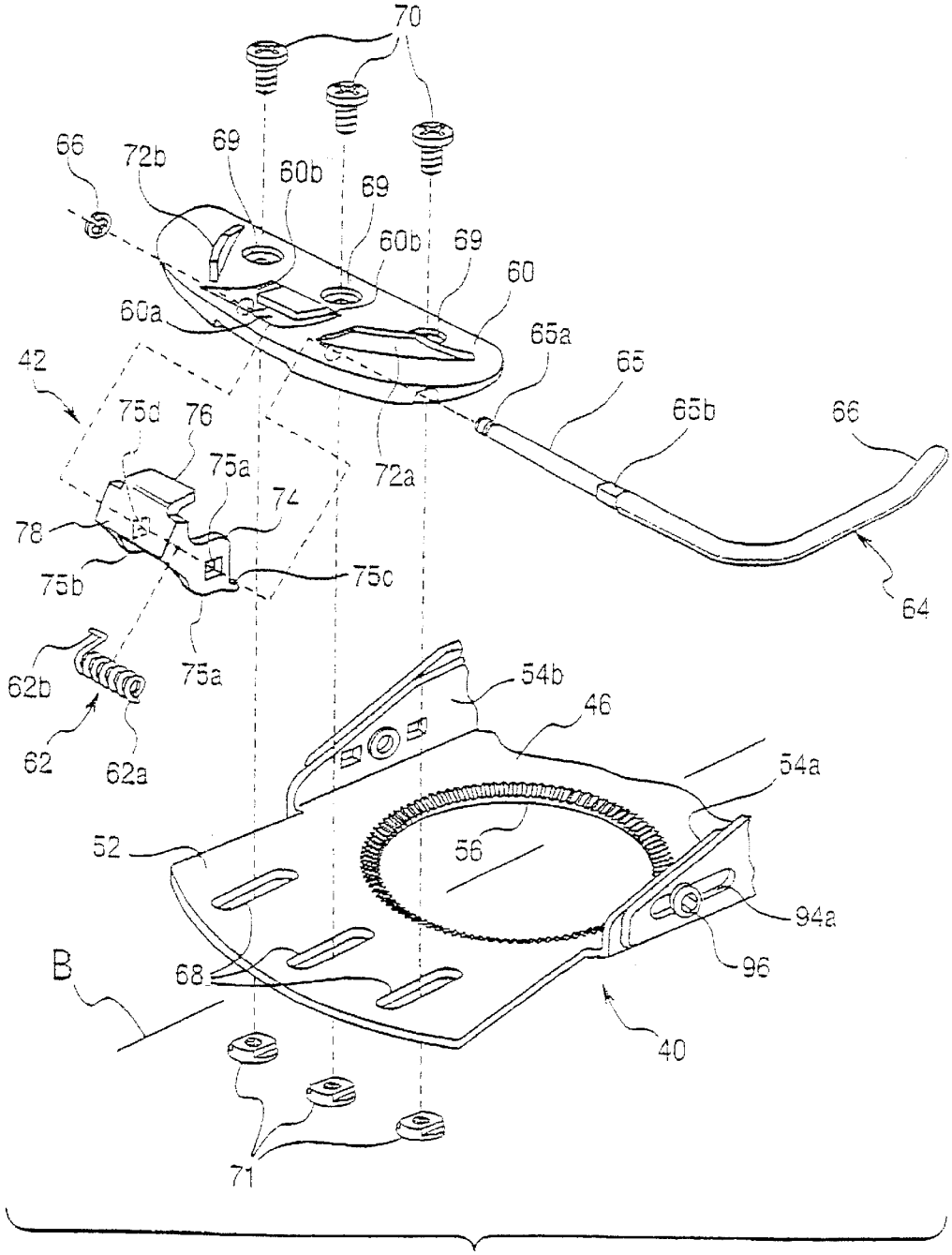
FIG. 13(*a*) is a partially exploded perspective view of the front binding member for the snowboard binding illustrated in FIGS. 1, 2 and 5–8.
Figure 13B:
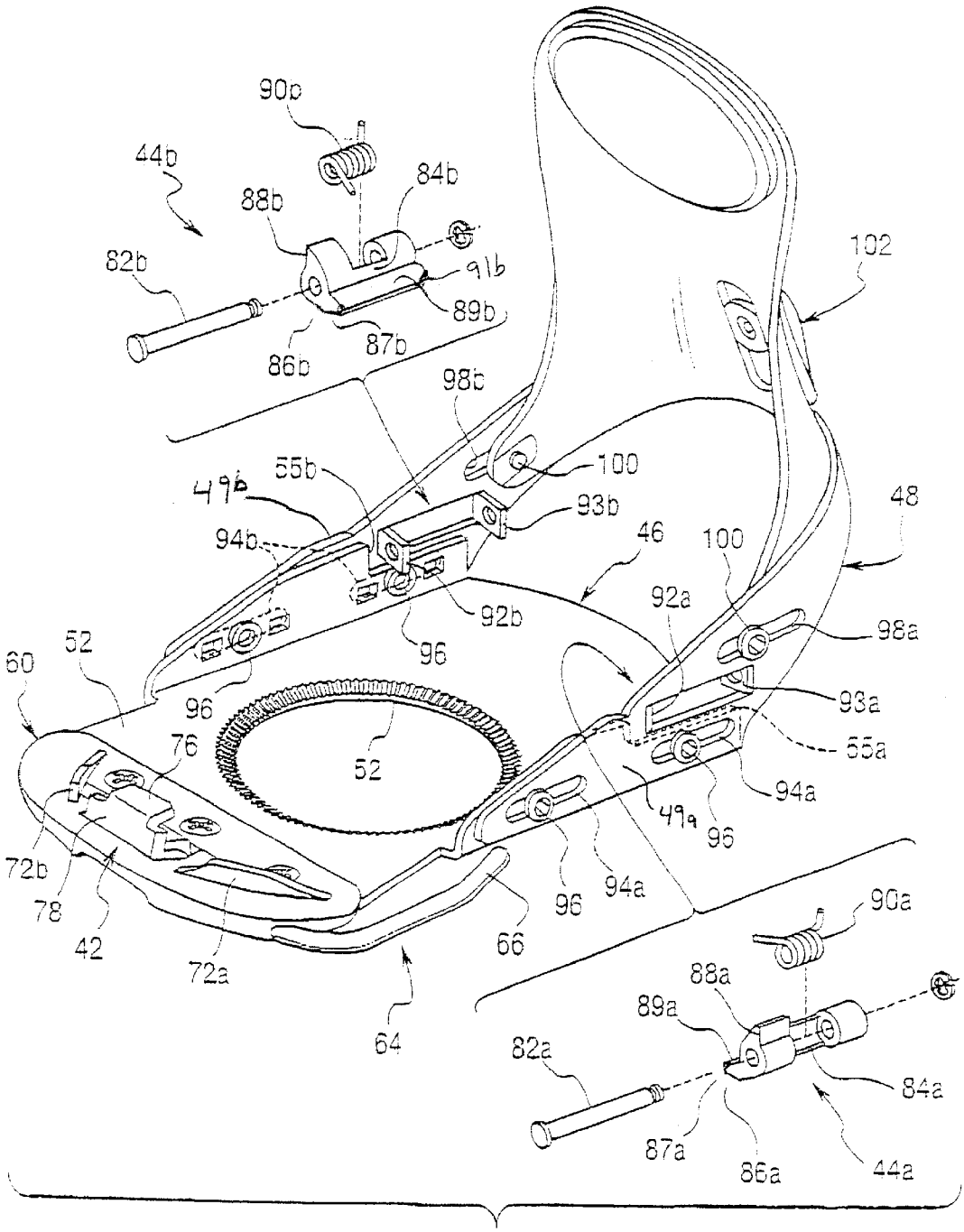
Figure 14A:
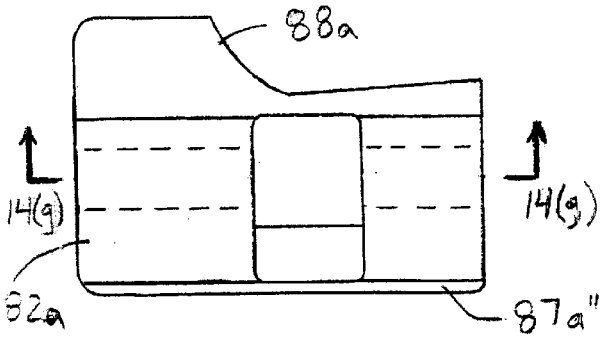
FIG. 14(*a*) is an enlarged, outside elevational view of a (first) latch member of the (first) rear binding member illustrated 1, 2, 5–12(*b*) and 13(*b*)
Figure 14B:
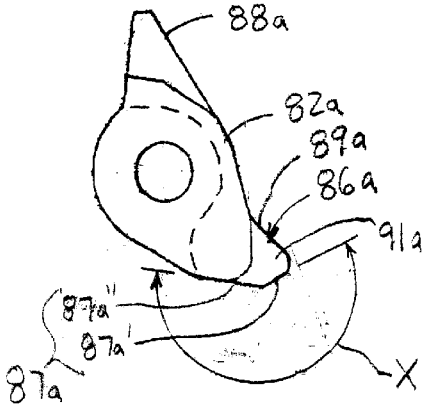
Figure 14C:
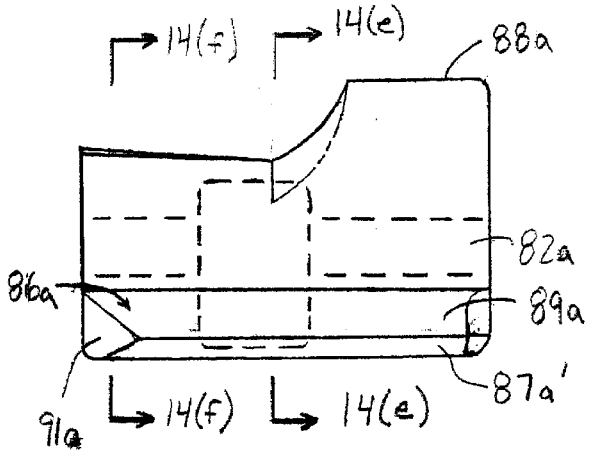
Figure 14D:
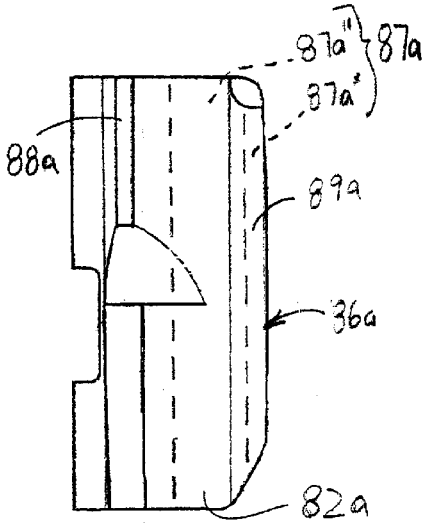
Figure 14E:
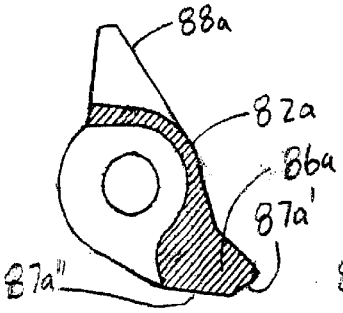
Figure 14F:
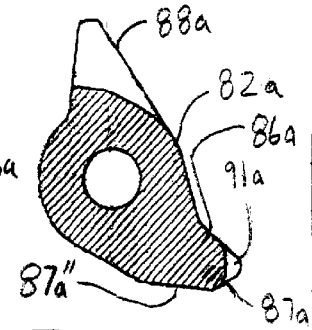
Figure 14G:
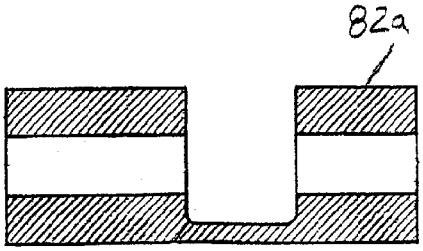
Figure 15:
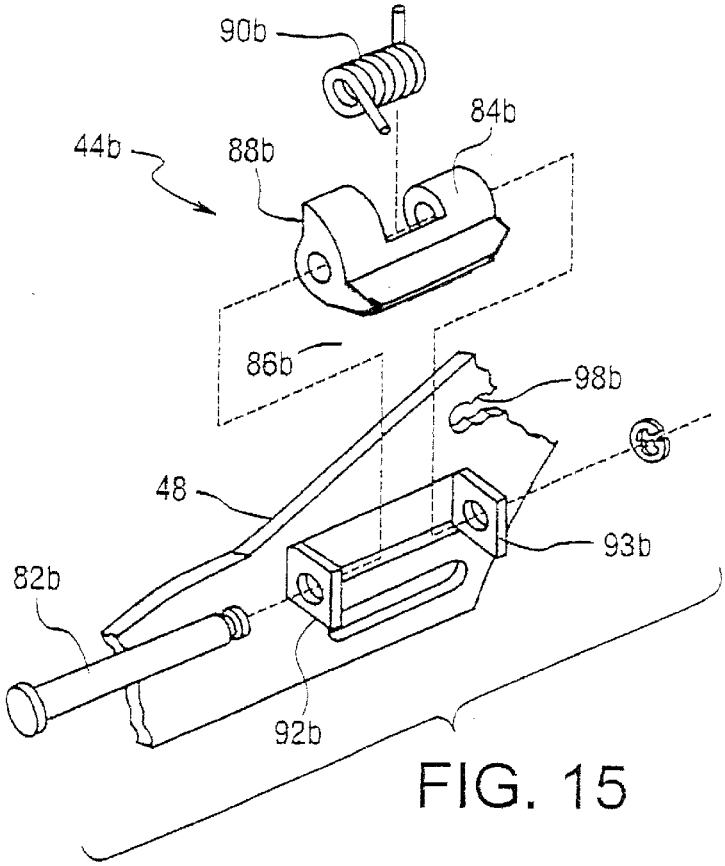
FIG. 15 is an enlarged, exploded perspective view of one of the rear binding members of the snowboard binding illustrated in FIGS. 1, 2 and 5–8.
Figure 16:
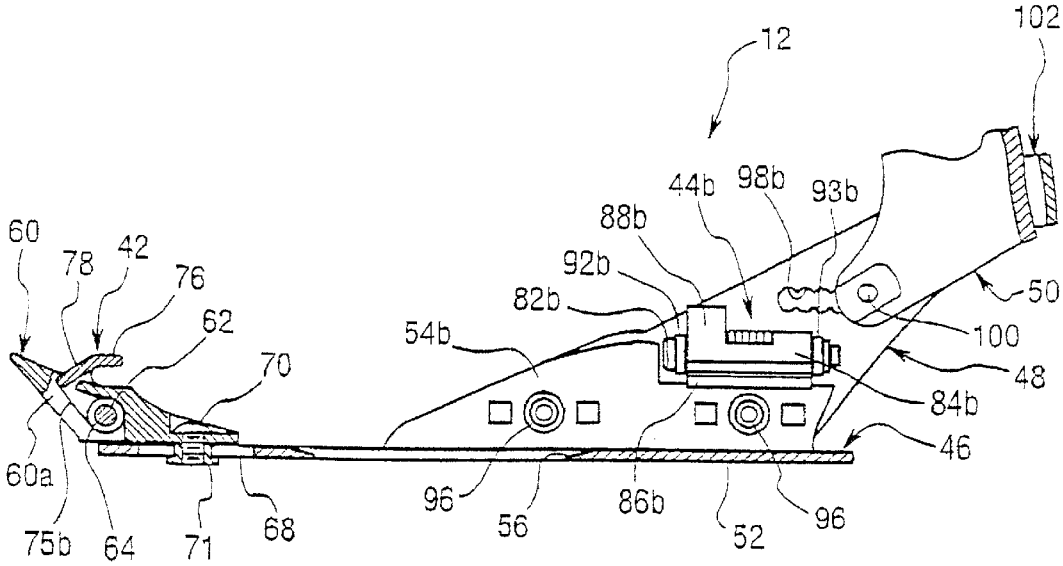
FIG. 16 is a longitudinal cross-sectional view of the snowboard binding system illustrated in FIGS. 1–15 as seen along section line 16—16 of FIG. 2.

As seen in FIGS. 2 and 13(*a*), the mounting portion 52 of the base plate 46 has a front binding plate 60 fixedly coupled thereto to form a front portion of the base plate 46. The front binding member 42 is movably coupled to the binding plate 60. Thus, when the binding plate 60 is fixedly coupled to the mounting portion 52, the front binding member 42 is movably coupled to the base plate 46 of the base member 40. The base member 40 has a longitudinal center axis B extending between the front portion of the base member 40 (i.e., the binding plate 60) and the rear portion of the base member 40 (i.e., the heel cup 48 and the highback 50). The front binding member 42 is preferably pivotally coupled to the binding plate 60 via a front release lever 64 which functions as a front pivot pin for the front binding member 42. A biasing member 62 is arranged on the front release lever 64 to bias the front binding member 42 toward an engaged or latched position as explained below. The control or release lever 64 is preferably non-rotatably coupled to the front binding member 42 to move the front binding member 42 against the biasing or urging force of biasing member or spring 62 from the latched position toward the release position.

The release lever 64 basically includes a pivot pin section 65 and a handle or control section 66. In other words, a part of the release lever 64 (pivot pin section 65) forms the front pivot pin of the front binding member 42. Thus, the release lever 64 is integrally formed as a one-piece, unitary member. The pivot pin section 65 preferably includes an annular recess 65a formed at a free end thereof. Any other suitable retaining member or C-clip 66 is received in the annular recess 65*a* to secure the release lever 64 and the front binding member 42 to the binding plate 60, with the spring 62 arranged therebetween.

Additionally, the binding plate 60 is preferably adjustable (along longitudinal axis B) relative to the mounting portion 52 of the base plate 46. More specifically, the mounting portion 52 includes a plurality (three) of slots 68, while the binding plate 60 includes a plurality (three) through holes 69. A plurality (three) of fasteners or attachment screws 70 are inserted through the holes 69 and the slots 68 and attached to the nuts 71 to fixedly couple the binding plate 60 to the mounting portion 52 in an adjustable manner along longitudinal axis B of the base member 40. Thus, the front binding member 42 can be selectively coupled at different longitudinal positions relative to the base member 40. Of course, it will be apparent to those skilled in the art that various other structures could be utilized to adjust the longitudinal position of the front binding member 42. Moreover, it will be apparent to those skilled in the art that the binding plate 60 could be integrally formed with the base plate 46 if needed and/or desired.

The binding plate 60 preferably includes a pair (first and second) of guide flanges 72*a* and 72*b* extending from an upper surface thereof, which aid in coupling the snowboard boot 14 to the snowboard binding 12. The guide flanges 72*a* and 72*b* are angled relative to longitudinal axis B of the snowboard binding 12 to guide the front catch 26 toward longitudinal axis B, and thus, toward the front binding member 42. The engagement between the snowboard boot 14 and the snowboard binding 12 will be discussed in more detail below. Additionally, the release of the snowboard boot 14 from the snowboard binding 12 via the control or the release lever 64 will also be discussed in more detail below.

As best seen in FIG. 13(*a*), the front binding member 42 basically includes a mounting portion 74, a binding flange or front claw 76, a connecting portion 78, the biasing member 62 and the release lever 64. The mounting portion 74 is non-rotatably mounted on the pivot pin section 65 of the release lever 64 for rotation between a latched position and a release position about a front pivot axis. The front pivot axis is arranged below the binding plate 60 such that front claw or binding flange 76 can be moved out of engagement with the front catch member 26 (i.e. to the release position). The biasing member or spring 62 urges the front claw 76 toward the latched position. The front claw 76 includes a lower surface configured to engage an upper surface of the tongue portion 36 of the front catch 26 of the snowboard boot 14. The connecting portion 78 extends between the front claw 76 and the mounting portion 74.

More specifically, the mounting portion 74 is preferably formed of a pair (first and second) mounting flanges 75*a* and 75*b*. The mounting flange 75*a* preferably includes a protrusion 75*c* extending therefrom. The protrusion 75*c* is designed to engage a first end 62*a* of the spring 62. The other end (second end) 62*b* of the spring 62 is designed to be received in a transverse hole (not shown) formed in the mounting plate 60. Thus, the spring 62 is preloaded to urge the front binding member 42 towards the latched position to selectively hold the front catch 26 of the snowboard boot 14. Additionally, at least one of the mounting flanges 75*a* and 75*b* preferably includes a noncircular (square) opening 75*d* to non-rotatably receive a noncircular portion 65*b* of the release lever 64. In the illustrated embodiment, both of the mounting flanges include the noncircular hole 75*d* such that the release lever 64 could be mounted to extend from either side of the binding plate 60.

The binding plate 60 includes a substantially U-shaped opening 60*a* formed therein, which is configured to partially receive the front binding member 42. A pair of the stop surfaces 60*b*, are formed at the rearmost edges of the legs of the U-shaped opening 60*a*. The stop surfaces 60*b* normally hold the front binding member 42 in the latched position. Moreover, because the pivot axis of the front binding member 42 is below bottom surface of the binding plate 60, the front binding member 42 can rotate out of contact with the front catch 26. The bottom surface of base member (i.e. the binding plate 60) forms an additional stop surface when the front binding member 42 is in the release position. In this manner, the front claw 76 can rotate about 90 degrees from the latched position where binding flange 76 is substantially horizontal to the release position where binding flange 76 is substantially vertical.

As best seen in FIGS. 13(*b*) and 15, the rear binding members (first and second) 44*a* and 44*b* are preferably movably coupled to the heel cup 48 of the base member 40. The heel cup 48 is adjustably coupled to the attachment sections 54*a* and 54*b* of the base plate 46 to form a pair (first and second) side attachment portions, as discussed in more detail below. Thus, the rear binding members 44*a* and 44*b* are movably coupled to the base plate 46. The attachment sections 54*a* and 54*b* each include a cutout 55*a* or 55*b*, respectively. The cutouts 55*a* and 55*b* are configured to allow the heel cup 48, with the rear binding members 44*a* and 44*b* coupled thereto, to be adjustably mounted to the base plate 46. Thus, the rear binding members 44*a* and 44*b* are adjustably and movably coupled to the base member 40.

More specifically, the rear binding members 44*a* and 44*b* are pivotally coupled to the base member 40 about a pair (first and second) of the pivot axes $P_1$ and $P_2$, respectively. Preferably, the first and second pivot axes $P_1$ and $P_2$ are substantially parallel to each other, and substantially parallel to the longitudinal axis B of the snowboard binding 12 as seen in FIG. 17. This arrangement aids in releasing the snowboard boot 14 from the snowboard binding 12, as discussed in more detail below. Of course these center axes could be angled relative to the longitudinal axis B as discussed below in reference to another embodiment of the present invention.

The rear binding members 44*a* and 44*b* are preferably mirror images of each other. Thus, both rear binding members 44*a* and 44*b* will not be discussed and/or illustrated in detail herein. Rather, it will be apparent to those skilled in the art from this disclosure that the descriptions/illustrations of the rear binding member 44*a* also applies to the rear binding member 44*b* and vice versa. However, it will also be apparent to those skilled in the art from this disclosure that various modifications can be made to one or both of the rear binding members 44*a* and 44*b* without departing from the scope of the present invention.

The rear binding member 44*a* basically includes a (first) pivot pin 82*a*, a (first) body portion 84*a*, a (first) tooth portion 86*a*, a (first) stop member 88*a* and a (first) biasing member 90*a*. The body portion 84*a*, the tooth portion 86*a* and the stop member 88*a* form a (first) latch member. The rear binding member 44*b* basically includes a (second) pivot pin 82*b*, a (second) body portion 84*b*, a (second) tooth portion 86*b*, a (second) stop member 88*b* and a (second) biasing member 90*b*. The body portion 84*b*, the tooth portion 86*b* and the stop member 88*b* form a (second) latch member. The biasing members or springs 90*a* and 90*b* normally bias the latch members (tooth portions 86*a* and 86*b*) toward locked or latched positions from the guide or coupling positions, respectively, as discussed in more detail below.

The tooth portions 86*a* and 86*b* are preferably substantially parallel to the longitudinal axis B and the pivot axes $P_1$ and $P_2$. In any case, the tooth portions 86*a* and 86*b* are configured to selectively mate with one of the pairs of the grooves 29*a* and 29*b* of the snowboard boot 14, respectively. Alternatively, the tooth portions 86*a* and 86*b* can be constructed to be angled relative to the longitudinal axis B and the pivot axes $P_1$ and $P_2$ as discussed below in reference to another embodiment of the present invention. Moreover, the rear binding members 44*a* and 44*b* could be mounted to angled side attachment portions such that tooth portions 86*a* and 86*b* are angled relative to the longitudinal axis B, as also discussed below in reference to another embodiment of the present invention. In any event, the notches or grooves 29*a* and 29*b* of snowboard boot 14 are configured to mate with tooth portions 86*a* and 86*b*. In other words, if the tooth portions 86*a* and 86*b* are angled relative to longitudinal axis B, the notches or grooves 29*a* and 29*b* should have a corresponding angle, as discussed below in reference to the other embodiments of the present invention.

The body portion 84*a* of the binding member 44*a* is pivotally mounted on the pivot pin 82*a*. The pivot pin 82*a* is preferably a headed pivot pin with an annular groove formed at a free end thereof. Any suitable retaining member or c-clip 66 is received in the annular groove to retain the rear binding member 44*a* between a pair of flanges 92*a* and 93*a* of heel cup 48. The biasing member 90*a* is preferably a coil spring with one end engaged with an outer later side surface of heel cup 48 and the opposite end engaged with the binding member 44*a* (i.e. a surface of the latch member) to bias the rear binding member 44*a* toward the locked or latched position. The tooth portion 86*a* extends from the body portion 84*a* and is configured to engage the grooves or notches 29*a* of the snowboard boot 14. Preferably, the tooth portion 86*a* forms a first pawl of rear binding member 44*a*. The stop member 88*a* also extends from the body portion 84*a* but in a substantially opposite direction from the tooth portion 86*a*.

Figure 9:
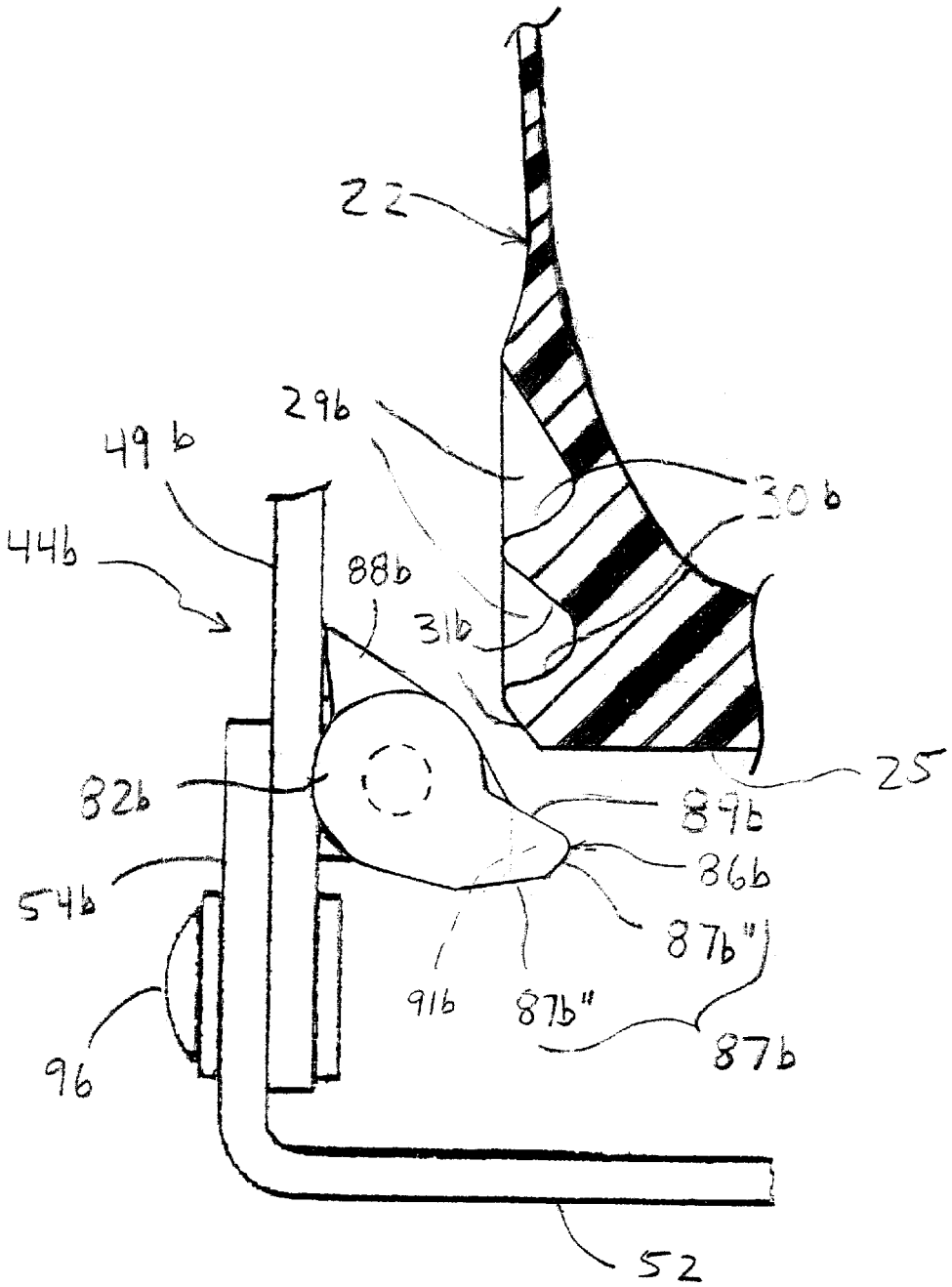
FIG. 9 is a diagrammatic, partial cross-sectional view of one of the rear binding members of the snowboard binding and the snowboard boot illustrated in FIGS. 1–8 prior to coupling the snowboard boot to the snowboard binding (i.e. with the binding member in the initial position) to illustrate the shapes of the teeth and grooves of the rear binding arrangement.
Figure 10:
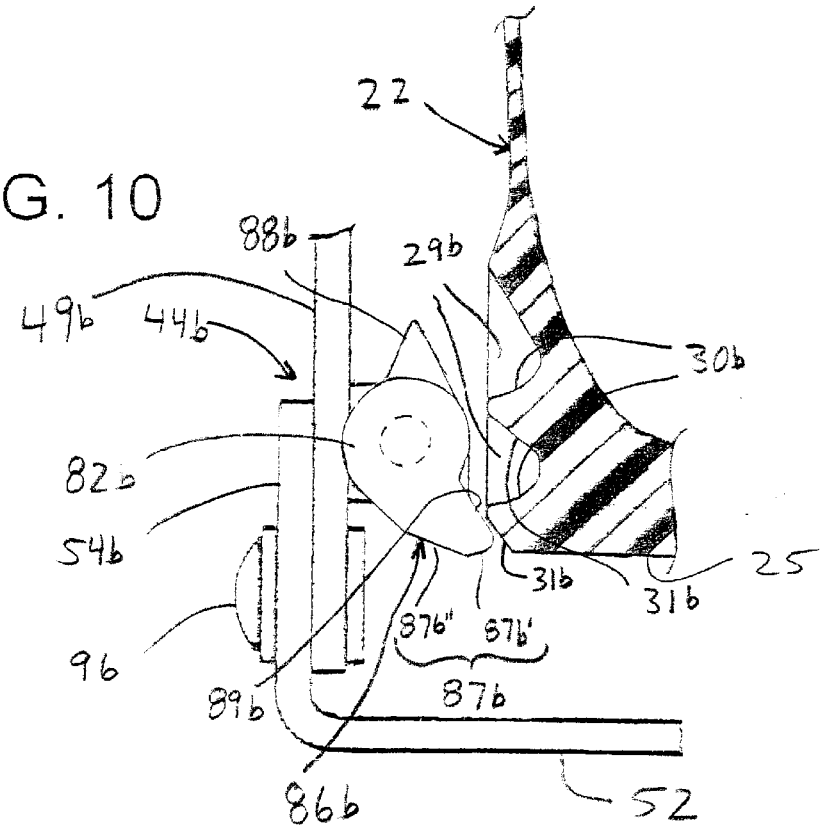
FIG. 10 is a diagrammatic, partial cross-sectional view of the rear binding member and the snowboard boot illustrated in FIG. 9 with the snowboard boot and rear binding member in an intermediate or guide position.
Figure 11:
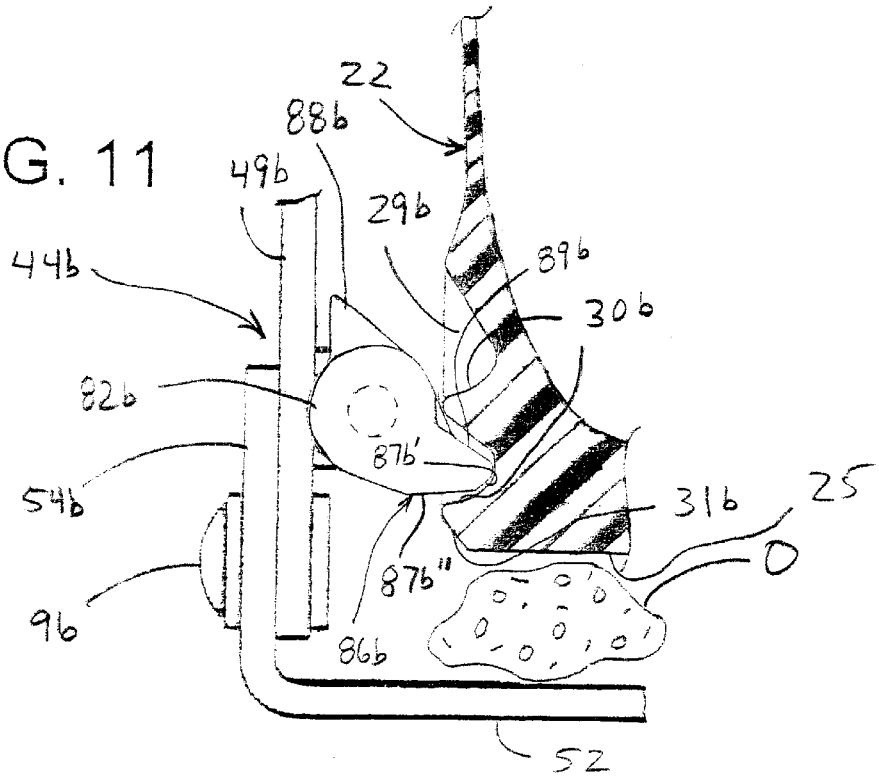
FIG. 11 is a diagrammatic, partial cross-sectional view of the rear binding member and the snowboard boot illustrated in FIGS. 9 and 10 with the snowboard boot and rear binding member in a first locked or latched position.
Figure 12A:
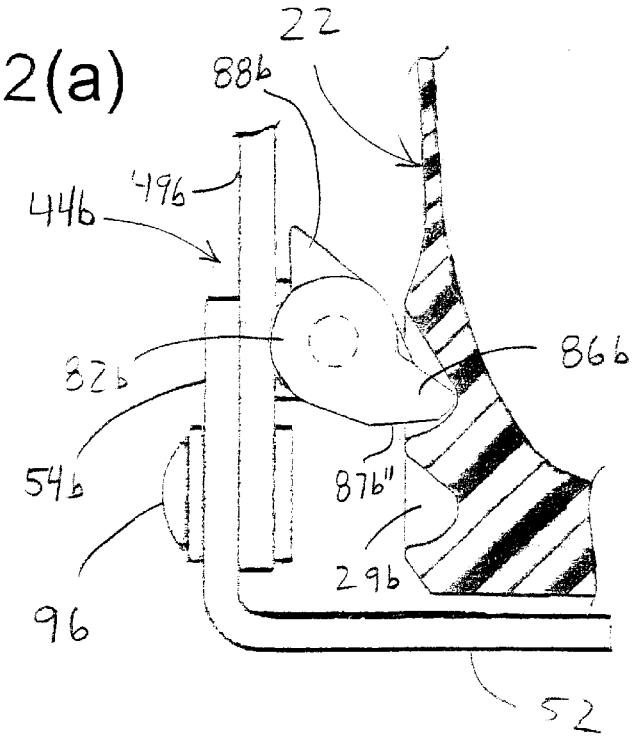
FIG. 12(*a*) is a diagrammatic, partial cross-sectional view of the rear binding member and the snowboard boot illustrated in FIGS. 9–11 with the snowboard boot and rear binding member in a second locked or latched position.
Figure 12B:
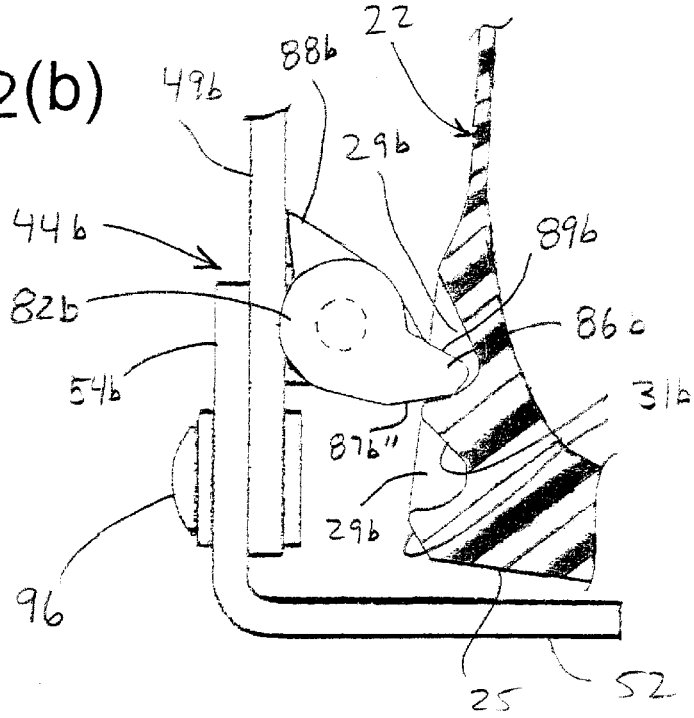

More specifically, the stop member 88*a* includes an abutment or contact surface configured to contact an inside surface or lateral side surface of the heel cup 48 when the binding member 44*a* is in the initial rest position. In the locked or latched position, the tooth portion 86*a* is received in one of the grooves or notches 29*a* of the snowboard boot 14 and the stop member 88*a* is slightly spaced from the lateral side surface of the heel cup 48. As seen in FIGS. 11 and 12 (tooth portion 86*b* illustrated), the tooth portion 86*a* can be received in either of the lateral grooves or notches 29*a* such that the height of the snowboard boot 14 can be varied relative to the base member 40 (i.e. the mounting portion 52 of the base plate 46). The tooth portion 86*a* basically includes a latching surface 87*a* and a guide surface 89*a* as seen in FIGS. 9, 10 (tooth portion 86*b* illustrated) and FIG. 13(*b*). The latching surface 87*a* engages one of the abutment surfaces 30*a* when the snowboard boot 14 in one of the locked or latched positions.

As best seen in FIGS. 14(*a*)–14(*d*), the latching surface 87*a* has an inner section 87*a*' and an outer section 87*a*" configured to form a convexly shaped latching surface 87*a*. More specifically, the inner section 87*a*' faces downwardly and inwardly toward the binding center longitudinal axis B in the latched position. The outer section 87*a*" is arranged outwardly of the inner section 87*a*' relative to the center axis B, and is substantially parallel to the base plate 46 in the latched position. The inner and outer sections 87*a*' and 87*a*" are preferably planar, flat surfaces that are angled relative to each other to form an angle X therebetween. Specifically, the inner and outer sections 87*a*' and 87*a*" preferably form an angle X of less than about 240° therebetween. More specifically, the inner and outer sections 87*a*' and 87*a*" preferably form an angle X of about 216° therebetween. Thus, the latching surface 87*a* is preferably formed of two distinct surfaces.

The outer section 87*a*" is laterally wider than the inner section 87*a*' such that the apex between the inner and outer sections 87*a*' and 87*a*" is located within one of the grooves 29*a* when in the latched position. In other words, the apex between the inner and outer sections 87*a*' and 87*a*" is laterally located about 2.1 millimeters, measured in a direction perpendicular to the center axis B, from an inner edge of the tooth portion 86*a* in the latched position. A curved inner transitional surface connects the inner section 87*a*' to the guide surface 89*a* and forms the inner edge. Each of the grooves 29*a* has a lateral depth, measured in a direction perpendicular to the center axis B that is larger than about 3.0 millimeters. More specifically, each of the grooves 29*a* preferably has a lateral depth of about 4.1 millimeters.

As mentioned above, the rear binding member 44*b* is preferably a mirror image of the rear binding member 44*a*. The body portion 84*b* of the binding member 44*b* is pivotally mounted on the pivot pin 82*b*. The pivot pin 82*b* is preferably a headed pivot pin with an annular groove formed at a free end thereof. A retaining C-clip (or any other suitable retaining member) is received in the annular groove to retain the rear binding member 44*b* between a pair of flanges 92*b* and 93*b* of the heel cup 48. The biasing member 90*b* is preferably a coil spring with one end engaged with an outer later side surface of the heel cup 48 and the opposite end engaged with binding member 44*a* (i.e. a surface of the latch member) to bias the rear binding member 44*b* toward the locked or latched position. The tooth portion 86*b* extends from the body portion 84*b* and is configured to engage the grooves or notches 29*b* of the snowboard boot 14. Preferably, the tooth portion 86*b* forms a second pawl of the (second) rear binding member 44*b*. The stop member 88*b* also extends from the body portion 84*b* but in a substantially opposite direction from the tooth portion 86*b*.

More specifically, the stop member 88*b* includes an abutment or contact surface configured to contact an inside surface or lateral side surface of the heel cup 48 when the binding member 44*b* is in the initial rest position (FIG. 9). In the locked or latched position, the tooth portion 86*b* is received in one of the grooves or notches 29*b* of the snowboard boot 14 and the stop member 88*b* is slightly spaced from the lateral side surface of the heel cup 48. The tooth portion 86*b* can be received in either of the lateral grooves or notches 29*b* such that the height of the snowboard boot 14 can be varied relative to the base member 40 (i.e. the mounting portion 52 of the base plate 46). Tooth portion 86*b* includes a latching surface 87*b* and a guide surface 89*b*, as seen in FIGS. 9, 10 and 13(*b*)–14(*e*). The latching surface 87*b* engages the abutment surface 30*b* when the snowboard boot 14 in one of the locked or latched positions.

The latching surface 87*b* has an inner section 87*b*' and an outer section 87*b*" configured to form a convexly shaped latching surface 87*b*. More specifically, the inner section 87*b*' faces downwardly and inwardly toward the binding center longitudinal axis B in the latched position. The outer section 87*b*" is arranged outwardly of the inner section 87*b*' relative to the center axis B, and is substantially parallel to the base plate 46 in the latched position. The inner and outer sections 87*b*' and 87*b*" are preferably planar, flat surfaces that are angled relative to each other to form an angle X therebetween. Specifically, the inner and outer sections 87*b*' and 87*b*" preferably form an angle X of less than about 240° therebetween. More specifically, the inner and outer sections 87*b*' and 87*b*" preferably form an angle X of about 216° therebetween. Thus, the latching surface 87*b* is also preferably formed of two distinct surfaces.

The outer section 87*b*" is laterally wider than the inner section 87*b*' such that the apex between the inner and outer sections 87*b*' and 87*b*" is located within one of the grooves 29*b* when in the latched position. In other words, the apex between the inner and outer sections 87*b*' and 87*b*" is laterally located about 2.1 millimeters, measured in a direction perpendicular to the center axis B, from an inner edge of the tooth portion 86*a* in the latched position. A curved inner transitional surface connects the inner section 87*b*' to the guide surface 89*b* and forms the inner edge. Each of the grooves 29*b* has a lateral depth, measured in a direction perpendicular to the center axis B that is larger than about 3.0 millimeters. More specifically, each of the grooves 29*b* preferably has a lateral depth of about 4.1 millimeters.

The term "convexly shaped surface" as used herein means a bulged surface having an effective curvature. Thus, a "convexly shaped surface" can be formed of one or more curved surfaces, or two or more flat and/or curved surfaces to form an overall bulged or convexly shaped surface. In event, the convexly shaped latching surface 87*a* preferably has an effective curvature smaller than that of the concave abutment surfaces 30*a* to form a space below the latching surface 87*a* when the tooth portion 86*a* is located in one of the grooves 29*a* in the latched position. Moreover, the convexly shaped latching surface 87*b* also preferably has an effective curvature smaller than that of the concave abutment surfaces 30*b* to form a space below the latching surface 87*b* when the tooth portion 86*b* is located in one of the grooves 29*b* in the latched position. Thus, when the boot 14 is moved/pivoted or deflected from the latched position (FIG. 12(*a*)) to a deflected latched position (FIG. 12(*b*)), the outer section 87*b*" contacts one of the concave abutment surfaces 30*b*. This arrangement reduces flexing of the base member 40 during such movements to maintain a tight coupling between the snowboard boot 14 and the snowboard binding 12.

The heel cup 48 is preferably constructed of a hard rigid material. Examples of suitable hard rigid materials for the heel cup 48 include various metals, as well as carbon and/or a metal/carbon combination. The heel cup 48 is an arcuate member having a pair of slots 94*a* and a pair of slots 94*b* at each of the lower free ends that are attached to the side attachment sections 54*a* and 54*b*, respectively, of the base plate 46. More specifically, the heel cup 48 includes a pair of support portion 49*a* and 49*b* that form the lower free ends. The support portions 49*a* and 49*b* are preferably adjustably coupled to the outer lateral sides of the side attachment sections 54*a* and 54*b*, respectively to form the side attachment portions for the rear binding members 44*a* and 44*b*, respectively. The slots 94*a* and 94*b* receive the fasteners 96 therein to adjustably couple the heel cup 48 to the base plate 46. Additional slots 98*a* and 98*b* are provided in the heel cup 48 to attach the highback 50 to the heel cup 48 via fasteners 100. Accordingly, the heel cup 48 is adjustably coupled to the base plate 46 and the highback 50 is adjustably coupled to the heel cup 48 to form the base member 40. Thus, rear binding members 44*a* and 44*b* can be selectively coupled at different longitudinal positions relative to base member 40.

Of course, it will be apparent to those skilled in the art from this disclosure that various other arrangements of the base member 40 are possible. For example, the support portions 49*a* and 49*b* could be coupled to the inner lateral side of the side attachment sections such as is diagrammatically illustrated in FIGS. 9–12(*b*). Moreover, it will be apparent to those skilled in the art from this disclosure that various other coupling methods for the parts of the base member are possible without departing from the scope of the present invention. In any event, the heel cup 48 is preferably adjustably coupled to the outer lateral sides of the base plate 46 and has the rear binding members 44*a* and 44*b* movably coupled thereto.

The highback 50 is a rigid member constructed of a hard rigid material. Examples of suitable hard rigid materials for the highback 50 include a hard rigid plastic material or various composite types of materials. Of course, the highback 50 could also be constructed of various metals. The highback 50 has a substantially U-shaped bottom portion with a pair of holes for receiving fasteners 100. The fasteners 100 are adjustably coupled within slots 98*a* and 98*b* of the heel cup 48 to allow adjustment of the highback 50 about a vertical axis. The highback 50 is pivotally coupled to the heel cup 48 by the fasteners 100. The connections between the highback 50, the heel cup 48 and the base plate 46 are relatively conventional. Accordingly, it will be apparent to those skilled in the art that these members could be attached in any number of ways, and that the present invention should not be limited to any particular implementation of these connections.

The highback 50 also preferably has a conventional forward lean or incline adjuster 102 that engages the heel cup 48 to cause the highback 50 to lean forward relative to the base member 40. The precise construction of the forward lean adjuster 102 is not relevant to the present invention. Moreover, the forward lean adjuster 102 is well known in the art, and thus, will not be discussed or illustrated herein. Of course, it will be apparent to those skilled in the art from this disclosure that the forward lean adjustment can be implemented in any number of ways, and that the present invention should not be limited to any particular implementation of the forward lean adjustment.

The snowboard binding system 10, in accordance with the present invention, allows for the snowboard boot 14 to be attached to the snowboard binding 12 when the highback 46 is in its forward-most lean position. Specifically, the front and rear binding members 42, and 44*a* and 44*b* are arranged such that when the rider steps into the binding 12, the snowboard boot 14 moves rearwardly against the highback 50 during the engagement process. In other words, during engagement of the front catch 26 to the binding 12, the upper portion of the snowboard boot 14 contacts the highback 50 such that the highback 50 flexes the upper portion of the snowboard boot 14 forward relative to the binding 12.

Figure 5:
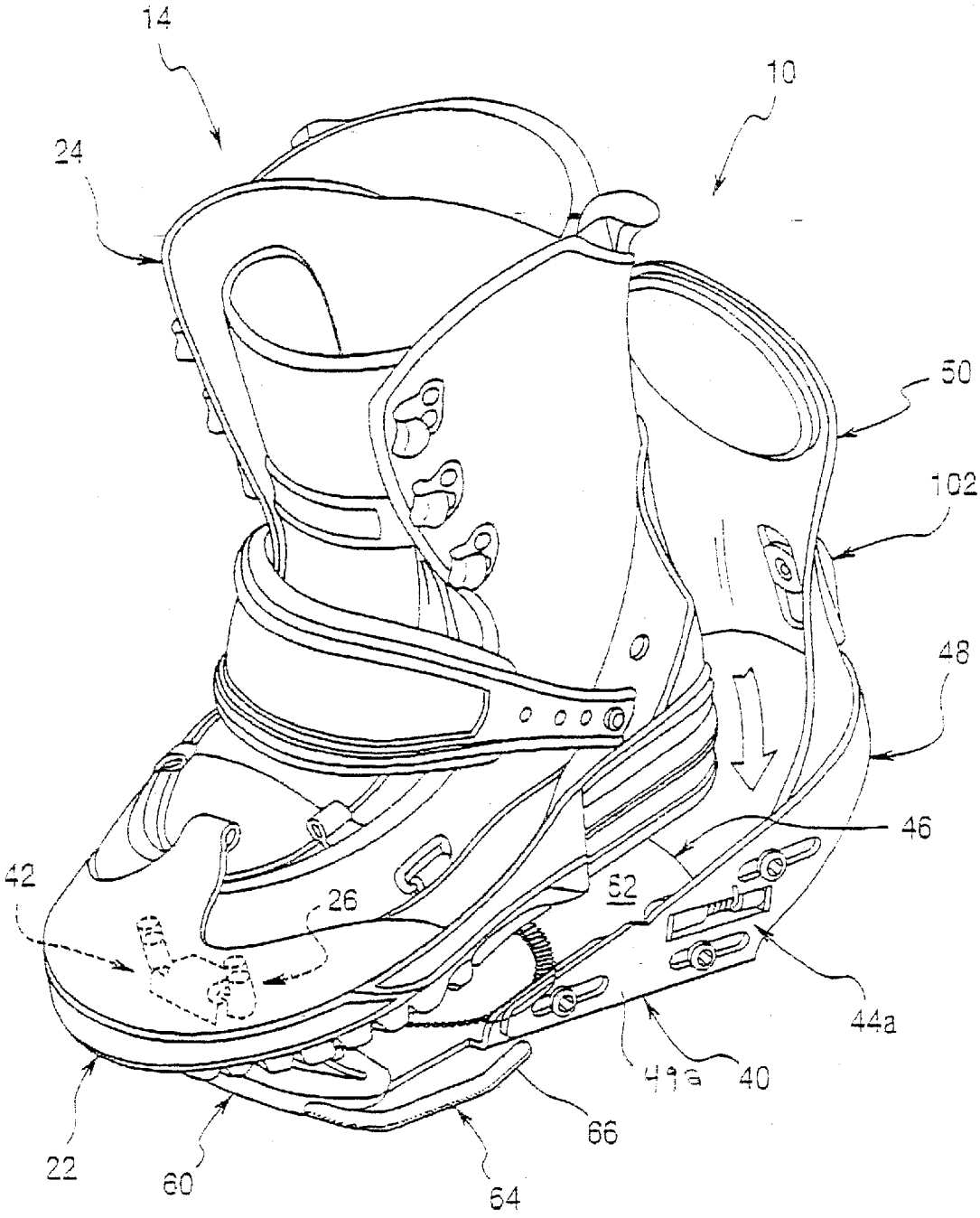
FIG. 5 is an enlarged perspective view of the. snowboard binding system illustrated in FIGS. 1–4 showing the snowboard boot in a first position partially engaged with the snowboard binding.

Referring to FIGS. 5–8 and 9–12(*a*), mounting and dismounting the snowboard boot 14 with the snowboard binding 12 will now be discussed in more detail. When the rider wants to enter the snowboard binding 12, boot 14 should be slightly inclined as seen in FIGS. 5 and 9. The front catch 26 is first engaged with the front binding member 42. Specifically, the front catch 26 is positioned beneath the front binding flange or pawl 76. Then the rider moves the heal or rear portion of the snowboard boot 14 in a direction substantially towards the base member 40 (i.e. toward the base plate 46). In other words, the snowboard boot 14 pivots rearwardly about the front catch 26 such that the rear of the snowboard boot 14 moves substantially toward the base member 40.

Figure 6:
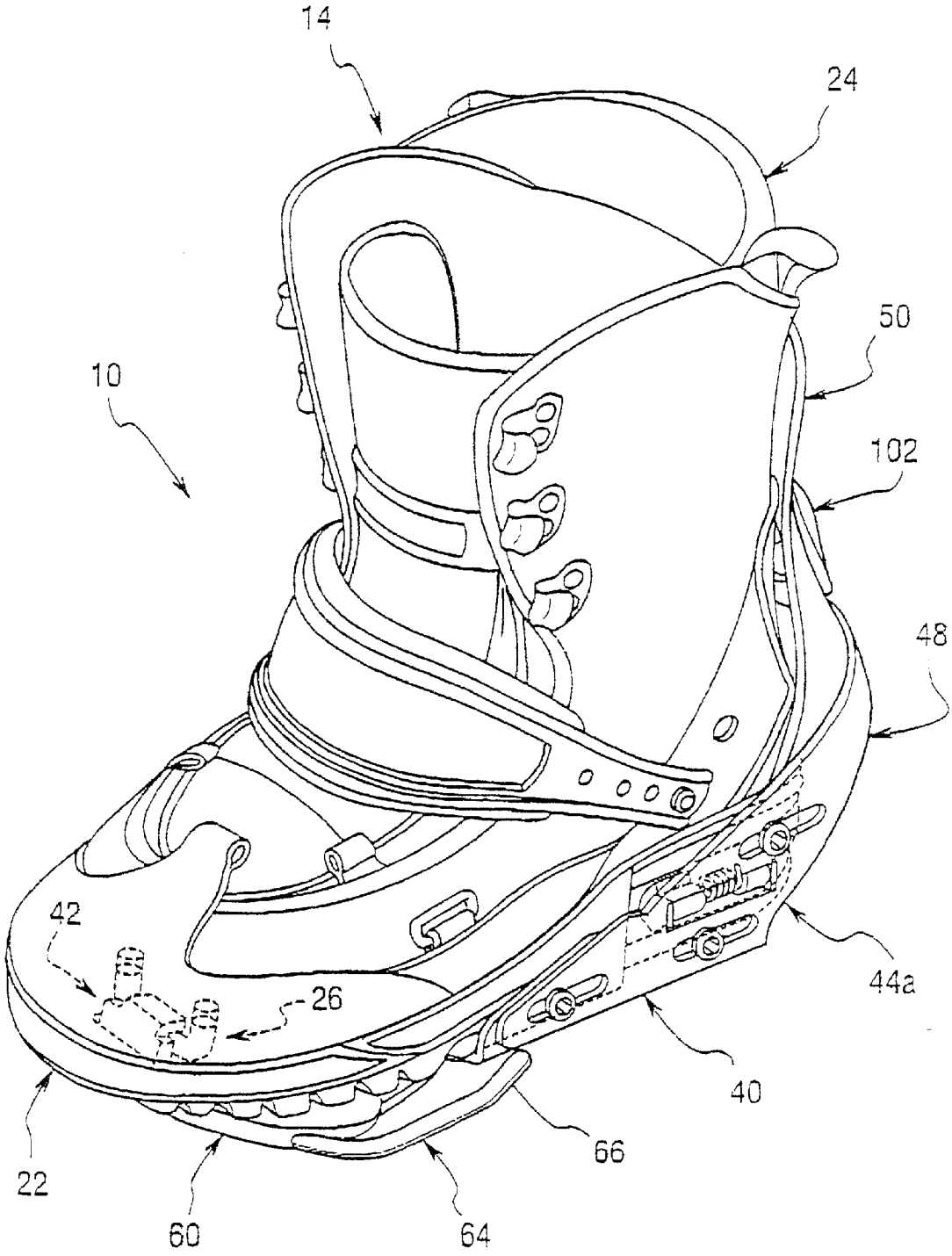
FIG. 6 is an enlarged perspective view of the snowboard binding system illustrated in FIGS. 1–5 showing the snowboard boot in a second position completely engaged with the snowboard binding.

As seen in FIG. 10, this movement of the snowboard boot 14 causes the rear binding members 44*a* and 44*b* to pivot against the biasing force of the springs 90*a* and 90*b*, respectively. Thus, the rear tooth portions 86*a* and 86*b* move laterally away from longitudinal axis B into guide or coupled positions (first and second coupled positions, respectively) such that the snowboard boot 14 can be moved downwardly. As best seen in FIGS. 6 and 11, once the rear catches 28*a* and 28*b* move a predetermined distance, the rear tooth portions 86*a* and 86*b* move from the (first and second) guide positions to (first and second) locking or latching positions. Thus, the snowboard boot 14 is in a first locked or latched position. In this first locked or latched position, the rear of the sole portion 22 is slightly spaced from the mounting portion 52 of the base plate 46. Thus an obstruction O, such as snow, mud or sand can be accommodated if needed as seen in FIG. 11. As seen in FIG. 12(*a*), the snowboard boot 14 can be further moved into a second locked or latched position, if no obstruction O prevents such movement. In this second locked or latched position, the rear tooth portions 86*a* and 86*b* move from intermediate (first and second) guide positions (not shown) to additional (first and second) locking or latching positions, respectively. Thus, the snowboard boot 14 is in a second locked or latched position.

Figure 7:
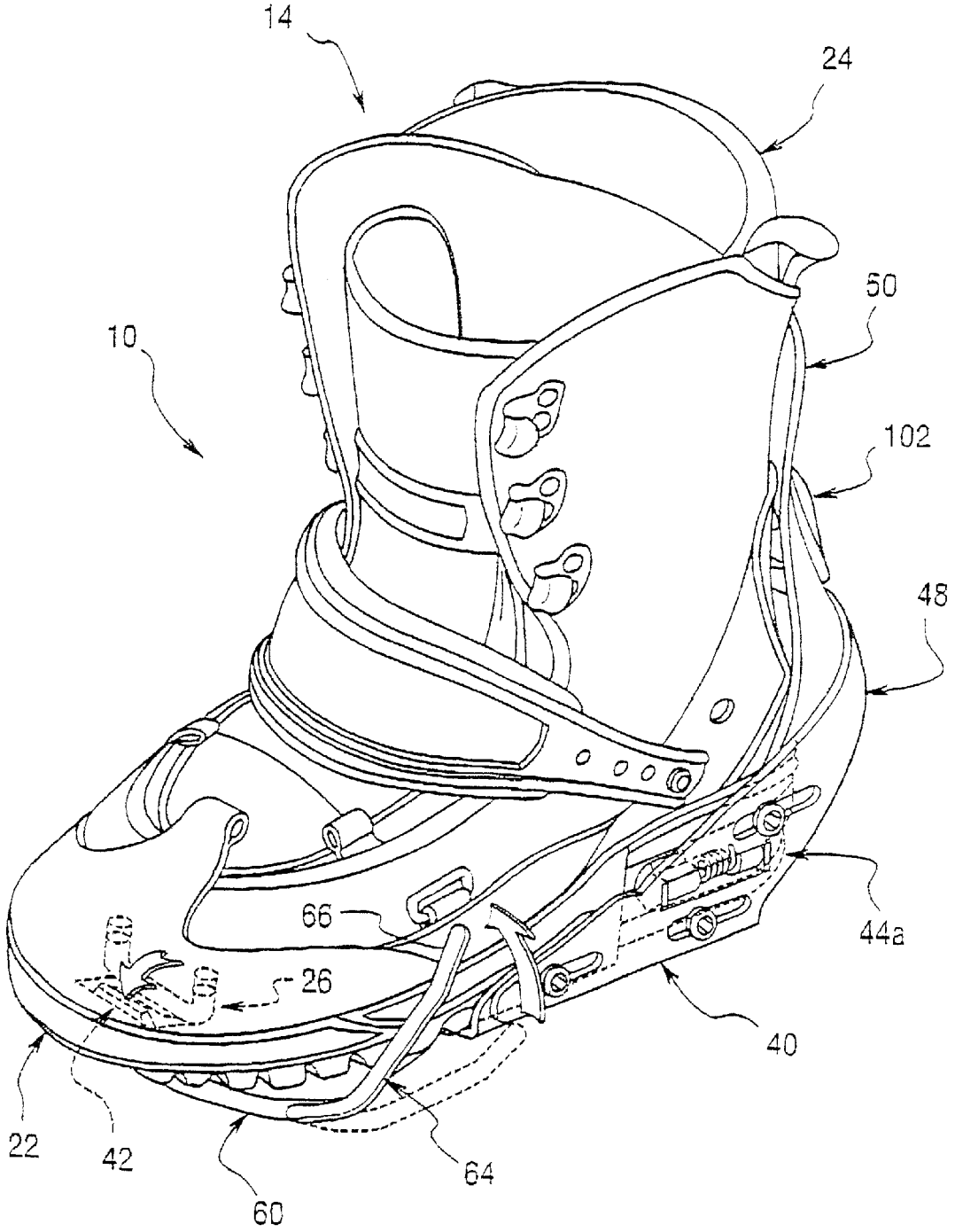
FIG. 7 is an enlarged perspective view of the snowboard binding system illustrated in FIGS. 1–6 showing the snowboard boot in the second position after moving a control lever to release the front of the snowboard boot from the snowboard binding (previous position of the control lever shown in broken lines)
Figure 8:
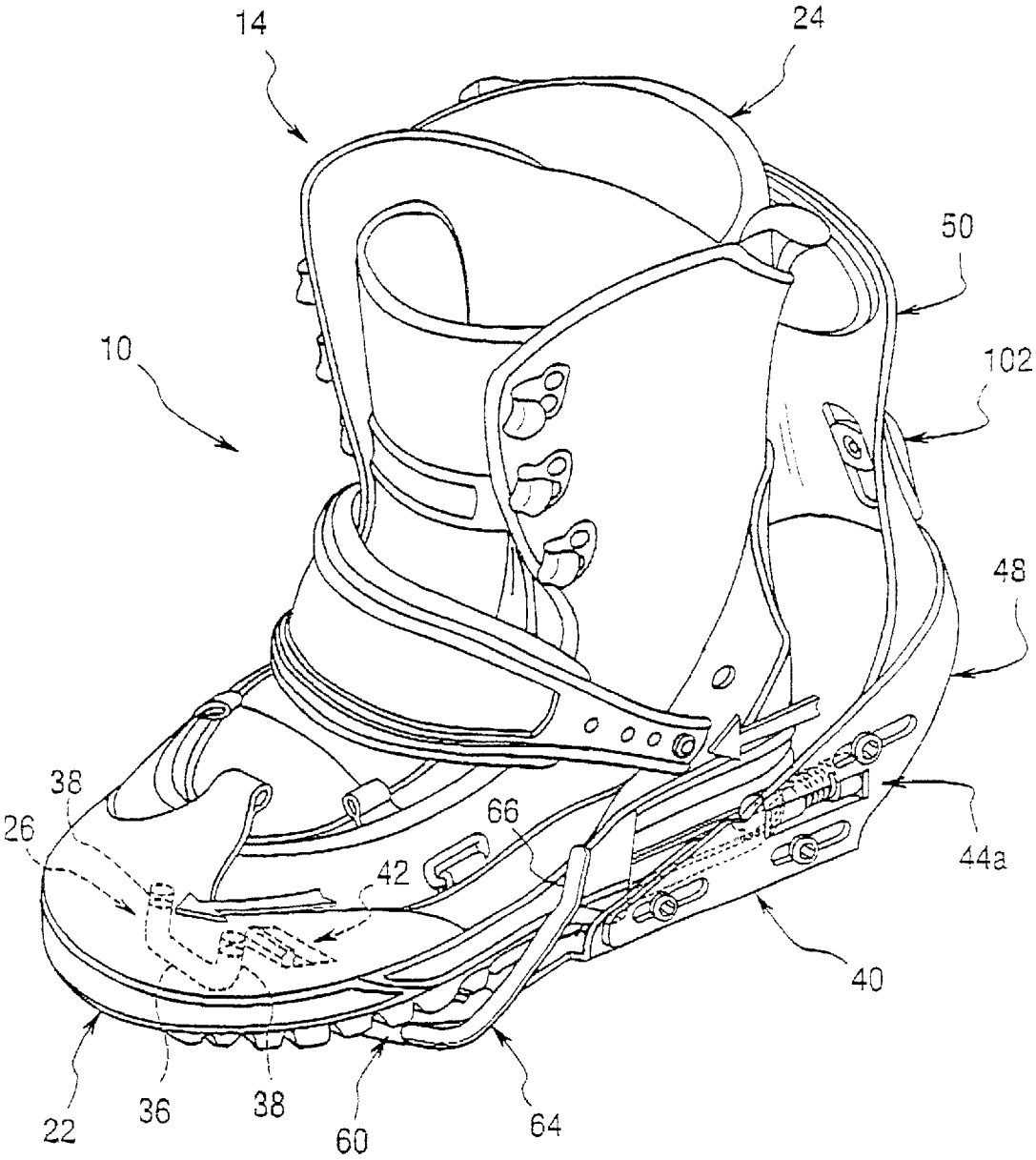
FIG. 8 is an enlarged perspective view of the snowboard binding system illustrated in FIGS. 1–7 showing the snowboard boot in a third position after moving the control lever to release the front of the snowboard boot and after sliding the snowboard boot forward (in order to completely release the snowboard boot from the snowboard binding.

Release of the snowboard boot 14 from the snowboard binding 12 will now be discussed in more detail. The snowboard binding 12 can easily release the snowboard boot 14 therefrom, when the snowboard boot 14 is in either of the locked or latched positions (FIGS. 6, 11 and 12). Specifically, as seen in FIG. 7, the release lever 64 is pivoted in order to move the front binding member 42 from the latched position (FIG. 6) to the release position. Thus, the front catch 26 of the snowboard boot 14 is released from the snowboard binding 12. However, the rear binding members 44*a* and 44*b* remain in the engagement or locking positions. In order to completely, detach the snowboard boot 14 from snowboard binding 12, the snowboard boot 14 is then moved longitudinally (i.e. along longitudinal axis B) such that the rear pawls 86*a* and 86*b* slide in the notches or grooves 29*a* and 29*b*, respectively. After the boot 14 is moved a sufficient distance, the rear pawls 86*a* and 86*b* will not engage or lock notches or grooves 29*a* and 29*b*. Thus the snowboard boot 14 can be completely released from snowboard binding 12.

SECOND EMBODIMENT

Figure 18:
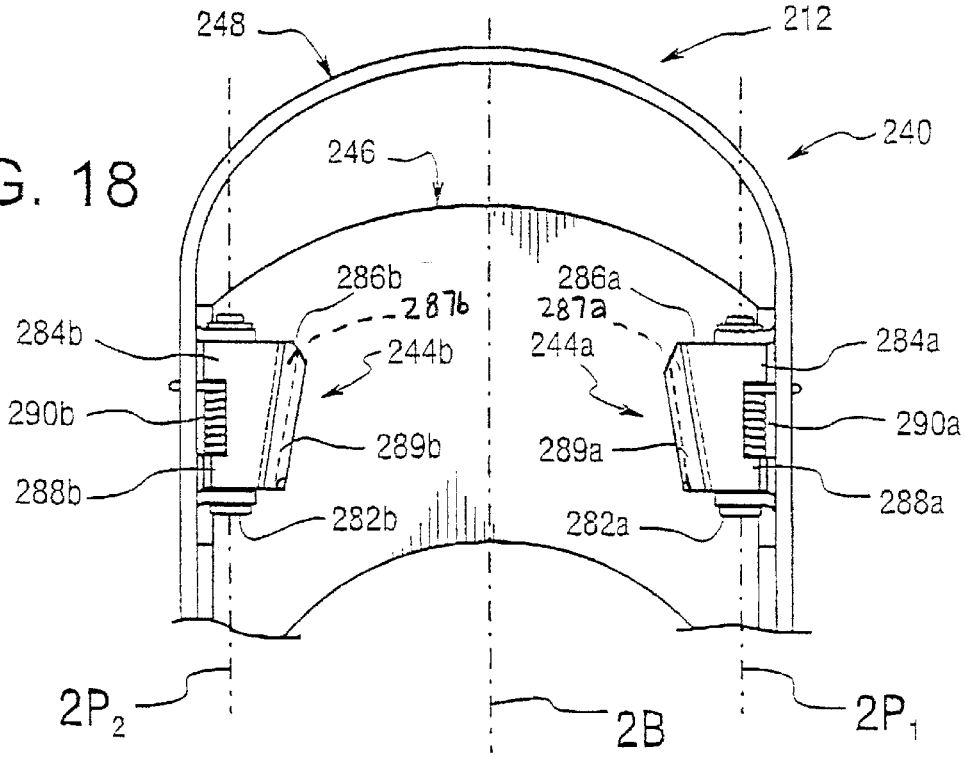
FIG. 18 is a diagrammatic, top plan view of a portion of a snowboard binding in accordance with a second embodiment of the present invention.

Referring now to FIG. 18, a portion of a snowboard binding 212 is illustrated in accordance with a second embodiment of the present invention. The snowboard binding 212 of this second embodiment is identical to the snowboard binding 12 of the first embodiment, except that the snowboard binding 212 has a pair (first and second) of rear binding members 244*a* and 244*b* that are modified versions of the rear binding members 44*a* and 44*b* of the first embodiment. The snowboard binding 212 is designed to be used with a snowboard boot identical or substantially identical to the snowboard boot 14 of the first embodiment. Since the snowboard binding 212 of the second embodiment is substantially identical to the snowboard binding 12 of the first embodiment, the snowboard binding 212 will not be discussed or illustrated in detail herein. Rather, the following description will focus mainly on the differences. Moreover, it will be apparent to those skilled in the art that most of the descriptions of the snowboard binding system 10, the snowboard binding 12 and the snowboard boot 14 of the first embodiment apply to the snowboard binding 212 of this second embodiment.

The snowboard binding 212 basically includes a base member 240, a front binding member (not shown) and the pair (first and second) of rear binding members 244*a* and 244*b*. The base member 240 of this second embodiment basically includes a base plate 246, a heel cup 248 and a highback (not shown). The base member 240 is identical to the base member 40 of the first embodiment. Thus, the base member 240 will not be discussed or illustrated in detail herein. Moreover, the front binding member (not shown) of the snowboard binding 212 is identical to the front binding member 42 of the first embodiment. Accordingly, the front binding member of this second embodiment will not be discussed or illustrated in detail herein. As mentioned above, the rear binding members 244*a* and 244*b* are modified versions of the rear binding members 44*a* and 44*b* of the first embodiment. More specifically, the rear binding member 44*a* basically includes a (first) pivot pin 282*a*, a (first) body portion 284*a*, a (first) tooth portion 286*a*, a (first) stop member 288*a* and a (first) biasing member 290*a*. The body portion 284*a*, the tooth portion 286*a* and the stop member 288*a* form a (first) latch member. The rear binding member 244*b* basically includes a (second) pivot pin 282*b*, a (second) body portion 284*b*, a (second) tooth portion 286*b*, a (second) stop member 288*b* and a (second) biasing member 290*b*. The body portion 284*b*, the tooth portion 286*b* and the stop member 288*b* form a (second) latch member. The rear binding members 244*a* and 244*b* are pivotally coupled to the base member 240 about a pair (first and second) pivot axes $2P_1$ and $2P_2$ in a manner identical to the first embodiment. In other words, the body portion 284*a* is pivotally mounted on the pivot pin 282*a*, while the body portion 284*b* is pivotally mounted on the pivot pin 282*b*. On the other hand, the tooth portions 286*a* and 286*b* are slightly modified versions of the tooth portions 86*a* and 86*b* of the first embodiment. Specifically, the tooth portion 286*a* includes a latching surface 287*a* and a guide surface 289*a*, while the tooth portion 286*b* includes a latching surface 287 and a guide surface 289*b*. The tooth portions 286*a* and 286*b* (i.e. the lock surfaces and the guide surfaces 289*a* and 289*b*) are identical to the tooth portions 86*a* and 86*b*, except the tooth portions 286*a* and 286*b* are angled relative to a center longitudinal axis 2B of the base member 240. In other words, (first and second) elongated latching surfaces 287*a* and 287*b* diverge relative to longitudinal axis 2B of the base member 240 as the elongated latching surfaces 287*a* and 287*b* extend from the rear portion of the base member 240 towards the front portion (not shown). Moreover, the tooth portions 286*a* and 286*b* are angled relative to the pivot axes $2P_1$ and $2P_2$. In other words, the snowboard binding 212 is designed to be used with a snowboard boot with angled notches or grooves substantially identical to the grooves 29*a* and 29*b* of the first embodiment, but that diverge to correspond in shape to the tooth portions 286*a* and 286*b*.

THIRD EMBODIMENT

Figure 19:
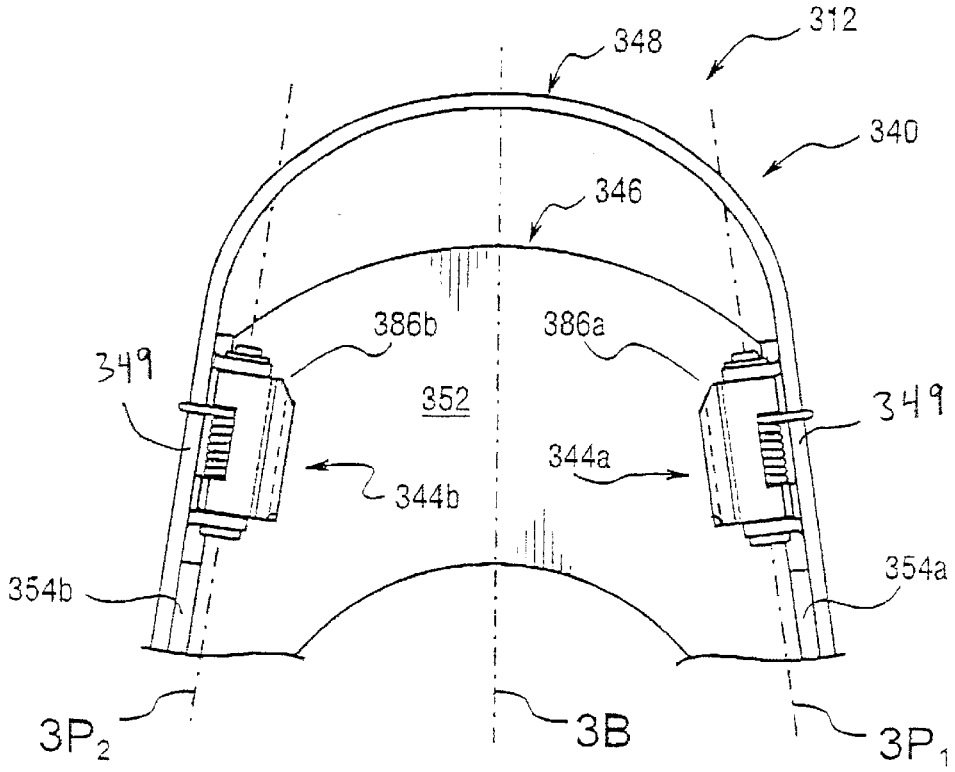
FIG. 19 is a diagrammatic, top plan view of a portion of a snowboard binding in accordance with a third embodiment of the present invention.

Referring now to FIG. 19, a snowboard binding 312 is illustrated in accordance with a third embodiment of the present invention. The snowboard binding 312 of this third embodiment is substantially identical to the snowboard binding 12 of the first embodiment except the snowboard binding 312 utilizes a base member 340 which is a modified version of the. base member 40 of the first embodiment. The snowboard binding 312 is designed to be used with a snowboard boot identical or substantially identical to the snowboard boot 14 of the first embodiment. Since the snowboard binding 312 of this third embodiment is substantially identical to snowboard binding 12 of the first embodiment, the snowboard binding 312 will not be discussed or illustrated in detail herein. Rather, the following description will focus mainly on the differences. Moreover, it will be apparent to those skilled in the art that most of the descriptions of snowboard binding system 10, the snowboard binding 12 and the snowboard boot 14 of the first embodiment apply to the snowboard binding 312 of this third embodiment.

The snowboard binding 312 basically includes the modified base member 340, a front binding member (not shown) and a pair (first and second) of rear binding members 344*a* and 344*b*. The front binding member (not shown) of the snowboard binding 312 is identical to the front binding member 42 of the first embodiment. Moreover, the rear binding members 344*a* and 344*b* are identical to the rear binding members 44*a* and 44*b* of the first embodiment. Thus, the front binding member (not shown) and the rear binding members 344*a* and 344*b* will not be discussed or illustrated in detail herein. The modified base member 340 is identical to the base member 40 of the first embodiment except that the shape has been slightly modified such that the rear binding members 344*a* and 344*b* are slightly angled relative to a center longitudinal axis 3B of the base member 340. The base member 340 basically includes a base plate 346, a heel cup 348 and a highback (not shown). The base plate 346 includes a mounting portion 352 and a pair (first and second) of side attachment sections 354*a* and 354*b*. The base plate 346 is identical to the base plate 46 of the first embodiment except that the attachment sections 354*a* and 354*b* are slightly angled relative to center longitudinal axis 3B. Moreover, heel cup 348 is identical to the heel cup 48 of the first embodiment, except that the shape of the heel cup 348 has been modified to be used with the modified base plate 346. In other words, the free ends or support portions 349 of the heel cup 348 are also preferably slightly angled relative to the center longitudinal axis 3B. Moreover, the highback (not shown) of the snowboard binding 312 may be slightly modified in order to be utilized with the base plate 346 and the heel cup 348. However, the highback is preferably formed of a material, which has limited flexibility such that the highback 50 of the first embodiment could also be used with the base plate 346 and the heel cup 348. Due to the configurations of the base plate 346 and heel cup 348, the rear binding members 344*a* and 344*b* are angled relative to center axis 3B. More specifically, the rear binding members 344*a* and 344*b* are pivotally coupled to the base member 340 about a pair (first and second) of the pivot axes $3P_1$ and $3P_2$, respectively. The pivot axes $3P_1$ and $3P_2$ are angled (i.e. diverge from axis 3B toward the front portion of the base member 340) relative to the longitudinal axis 3B. Moreover, the rear binding member 344*a* has a tooth portion 386*a* while rear binding member 344*b* has a tooth portion 386*b*. Thus, the tooth portions 386*a* and 386*b* are angled relative to center longitudinal axis 3B. In other words, the rear binding members 344*a* and 344*b* are identical to the rear binding members 44*a* and 44*b* of the first embodiment, except that the orientation of the rear binding members 344*a* and 344*b* have been modified due to the configuration of the base member 340. In other words, (first and second) elongated latching surfaces diverge relative to the longitudinal axis 3B of the base member 340 as the elongated latching surfaces extend from the rear portion of the base member 340 towards the front portion (not shown). Thus, the snowboard binding 312 is designed to be used with a snowboard boot with angled grooves substantially identical to the grooves 29*a* and 29*b* of the first embodiment, but that diverge to correspond to the orientation of the tooth portions 386*a* and 386*b*.

FOURTH EMBODIMENT

Figure 20:
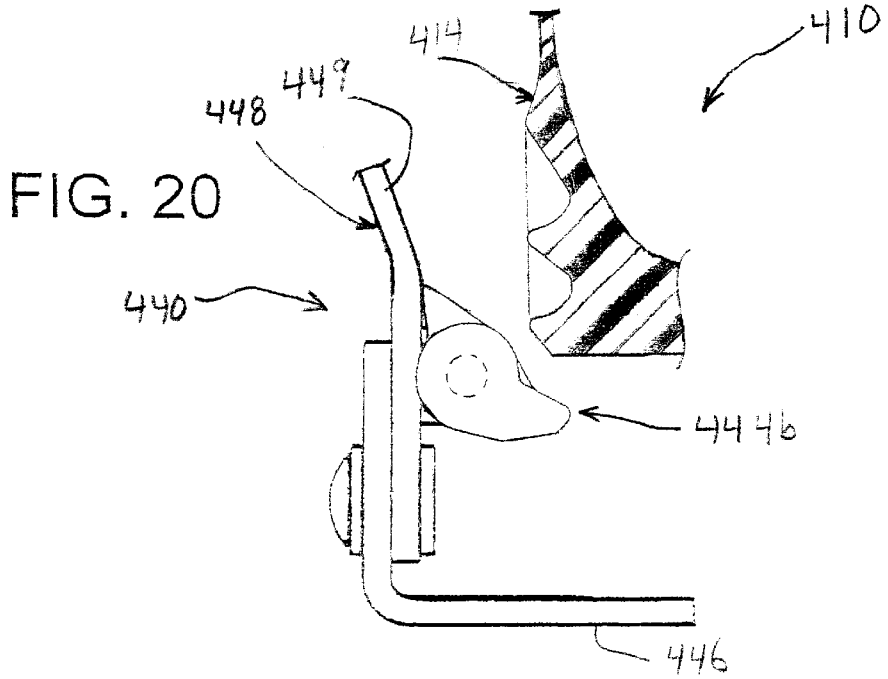
FIG. 20 is a diagrammatic, partial cross-sectional view of a portion of a snowboard binding system in accordance with a fourth embodiment of the present invention.

Referring now to FIG. 20, a portion of a snowboard binding system 410 is illustrated in accordance with a fourth embodiment of the present invention. The snowboard binding system 410 of this fourth embodiment is substantially identical to the snowboard binding system 10 of the first embodiment, except the snowboard binding system 410 includes a base member 440, which is a modified version of the base member 40 of the first embodiment. The snowboard binding system 410 has a snowboard binding 412, which is designed to be used with a snowboard boot identical or substantially identical to the snowboard boot 14 of the first embodiment. Since the snowboard binding system 410 is substantially identical to snowboard binding system 10 of the first embodiment, the snowboard binding system 410 will not be discussed or illustrated in detail herein. Rather, the following description will focus mainly on the differences. Moreover, it will be apparent to those skilled in the art that most of the descriptions of snowboard binding system 10 of the first embodiment also apply to the snowboard binding system 410 of this fourth embodiment.

The snowboard binding system 410 basically includes the snowboard binding 412 and a snowboard boot 414. The snowboard boot 414 is identical to the snowboard boot 14 of the first embodiment. Thus, the snowboard boot 414 will not be discussed or illustrated in detail herein. The snowboard binding 412 basically includes a base member 440, a front binding member (not shown) and a pair (first and second) of rear binding members (only one rear binding member 444*b* shown). The front binding member (not shown) of the snowboard binding 412 is identical to the front binding member 42 of the first embodiment. Moreover, the rear binding members (only one rear binding member 444*b* shown) are also identical to the rear binding members 44*a* and 44*b* of the first embodiment. On the other hand, the base member 440 is a modified version of the base member 40 of the first embodiment. More specifically, the base member 440 includes a base plate 446, a heel cup 448 and a highback (not shown). The base plate 446 and the highback (not shown) of the base member 440 are identical to the base plate 46 and the highback 50 of the first embodiment. However, the heel cup 448 is a modified version of the heel cup 48 of the first embodiment. Specifically, the heel cup 448 has a pair of flared sections or support portions (only one shown) 449 formed at the free ends of the heel cup 448 to aid in guiding the snowboard boot 414 into the snowboard binding 412. The support portions 449 are slanted upwardly and outwardly from the base plate 446. The support portions 449 can be slightly curved if needed and/or desired. The support portions 449 can be configured to be coupled laterally inside of the side attachment sections of the base plate 46, as diagrammatically illustrated in FIG. 20. Alternatively, the support portions 449 can be configured to be coupled laterally outside of the side attachment sections of the base plate 46, as in the first embodiment.

FIFTH EMBODIMENT

Referring now to FIGS. 21–45, a modified snowboard binding system 510 with a modified snowboard binding 512 and a modified snowboard boot 514 is illustrated in accordance with a fifth embodiment of the present invention. The snowboard binding 512 of this fifth embodiment is identical to the snowboard binding 12 of the first embodiment, except that the front binding arrangement of the snowboard binding 512 has been modified from the front binding arrangement of the snowboard binding 12 of the first embodiment as discussed below. Thus, the remaining parts of the snowboard binding 512 are identical to the snowboard binding 12 of the first embodiment. Since the snowboard binding 512 of the fifth embodiment is substantially identical to the snowboard binding 12 of the first embodiment, the snowboard binding 512 will not be discussed or illustrated in detail herein. Rather, the following description will focus mainly on the differences of the snowboard binding 512 from the snowboard binding 12. Similarly, the snowboard boot 514 is also substantially identical to the snowboard boot 14 of the first embodiment. Thus, the snowboard boot 514 will not be discussed and/or illustrated in detail herein. Rather, the following description will focus mainly on the differences between the snowboard boot 514 and the snowboard boot 14. Moreover, it will be apparent to those skilled in the art that most of the descriptions of the snowboard binding system 10, the snowboard binding 12 and the snowboard boot 14 of the first embodiment apply to the snowboard binding 510 of this fifth embodiment.

Figure 21:
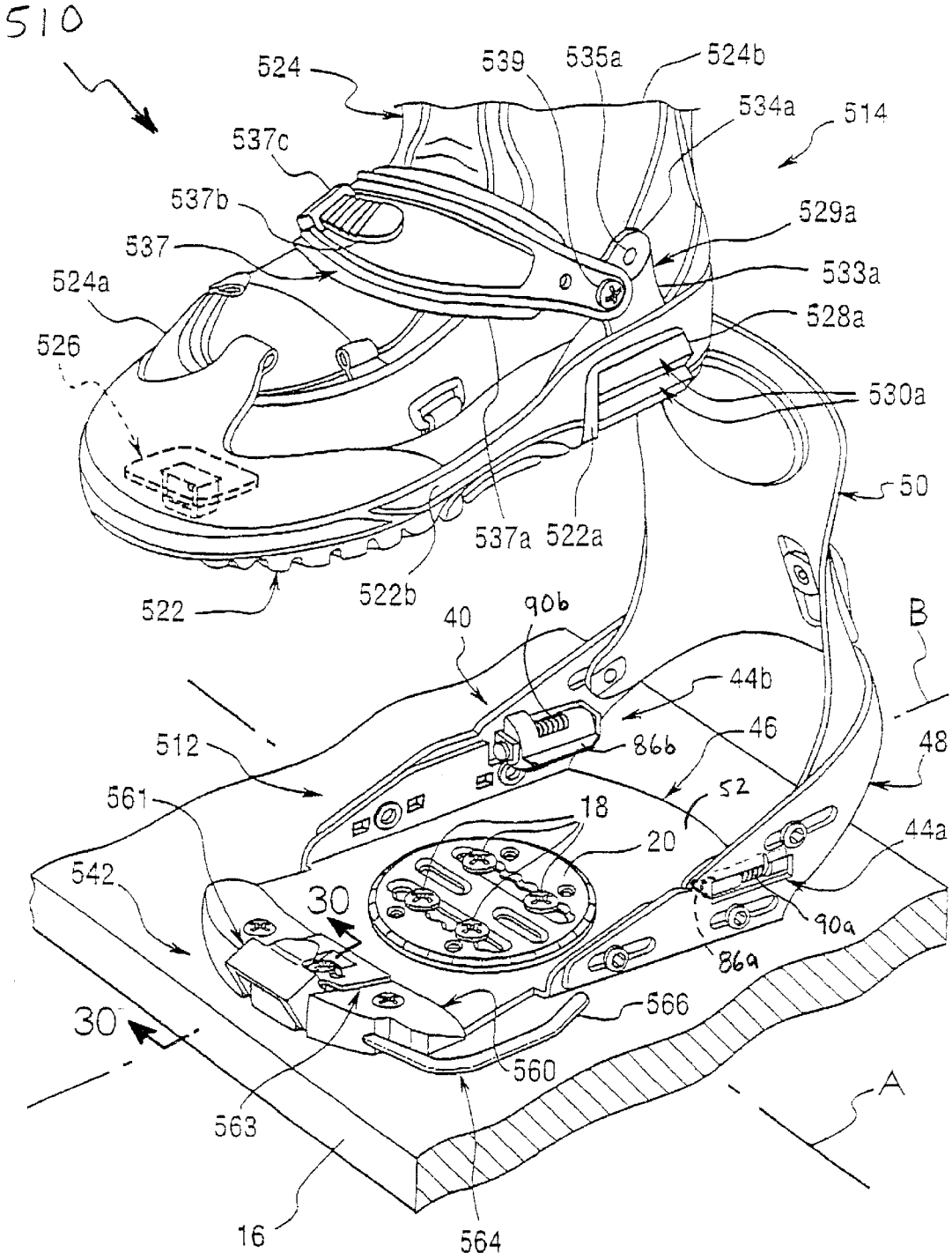
FIG. 21 is a perspective view of a snowboard binding system having a snowboard binding fixed to a snowboard and a snowboard boot in accordance with a fifth embodiment of the present invention.

Referring now to FIGS. 21 and 31–45, the snowboard boot 514 of this fifth embodiment of the present invention will be discussed in more detail. As seen in FIG. 21, the snowboard boot 514 is designed to be utilized with the snowboard binding 512. The snowboard boot 514 of the present invention basically has a sole portion 522 and an upper portion 524. The upper portion 524 has a foot section 524*a* fixedly coupled to the sole portion 522 and a leg portion 524*b* extending upwardly from the foot section 524*a*. The upper portion 524 is basically constructed of a flexible material and is fixedly attached to the sole portion 522 via adhesive molding and/or stitching (not shown). The upper portion 524 is not critical to the present invention, and thus, will not be discussed and/or illustrated in detail herein.

Figure 34:
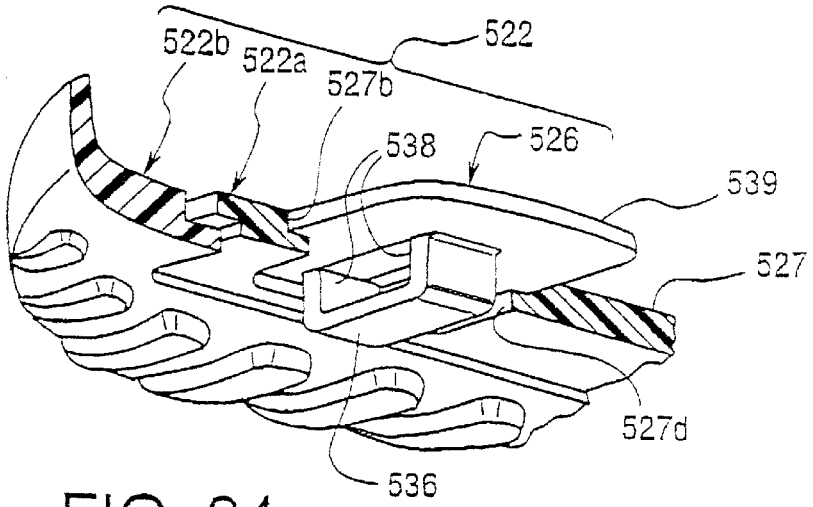
FIG. 34 is a partial bottom perspective view of the sole portion with the front catch of the snowboard boot illustrated in FIG. 21.
Figure 35:
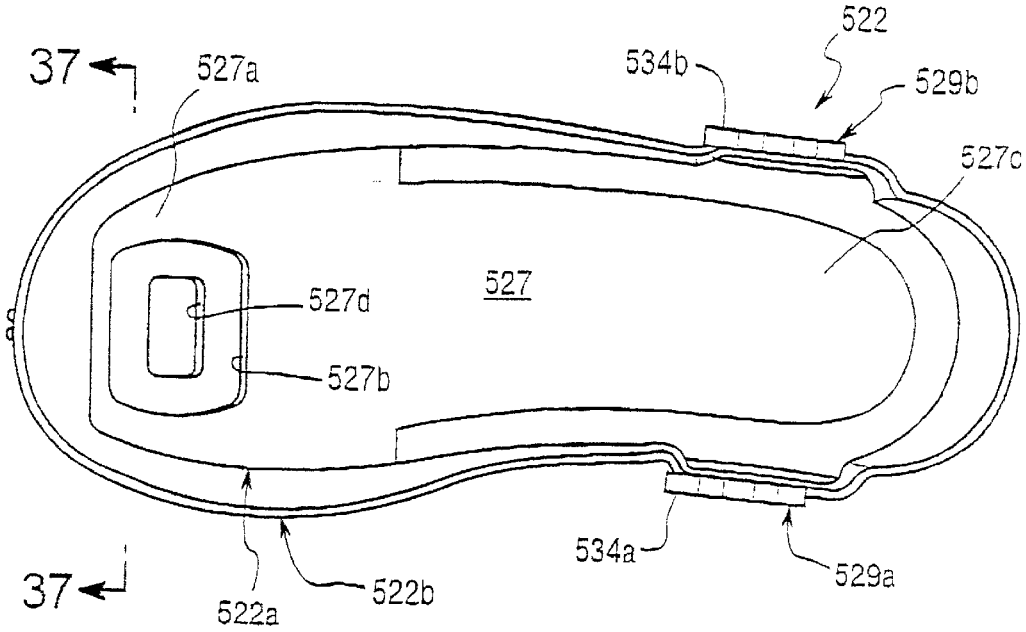
FIG. 35 is a center longitudinal cross sectional view of the sole portion of the snowboard boot illustrated in FIG. 21 with the front catch removed.
Figure 36:
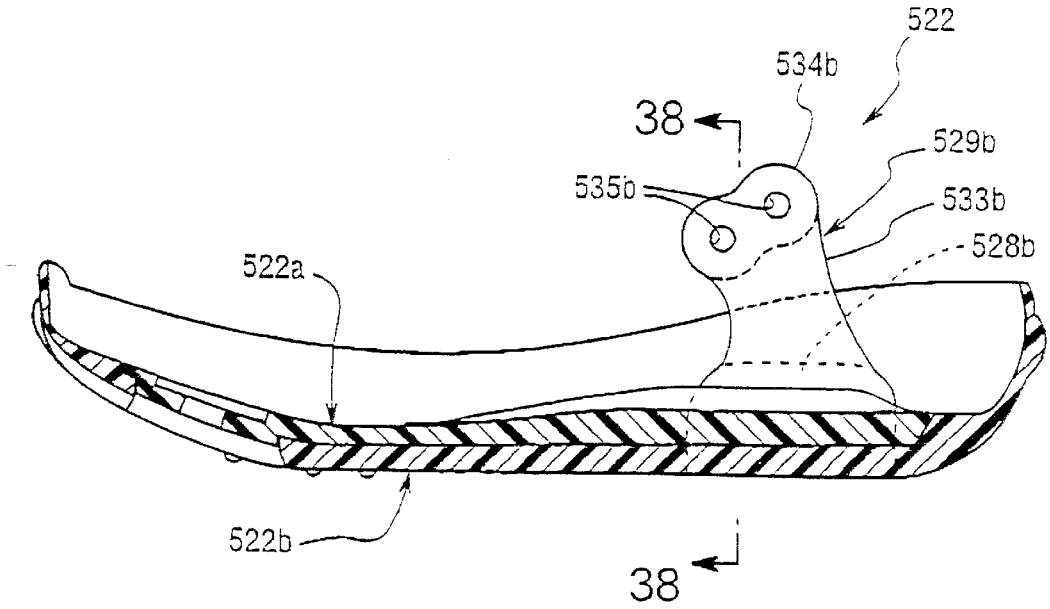
FIG. 36 is a top plan view of the sole portion of the snowboard boot illustrated in FIG. 21 with the front catch removed.
Figure 37:
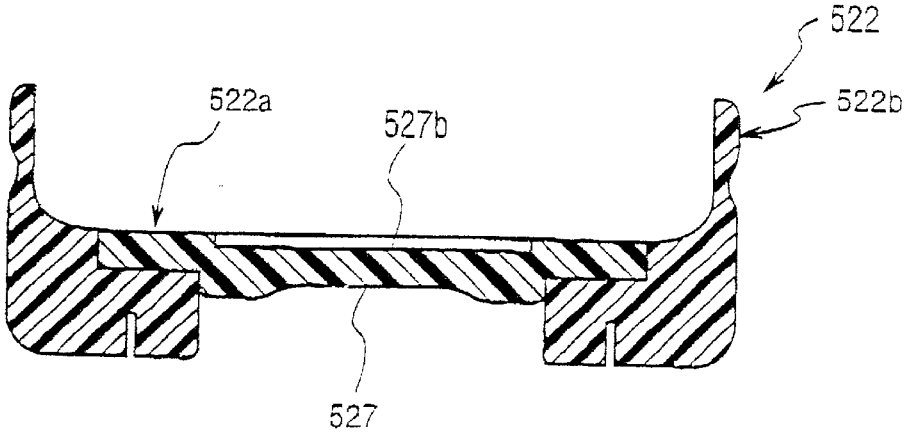
FIG. 37 is a transverse cross sectional view of the sole portion of the snowboard boot illustrated in FIG. 21 with the front catch removed as seen along section line 37—37 of FIG. 36.
Figure 38:
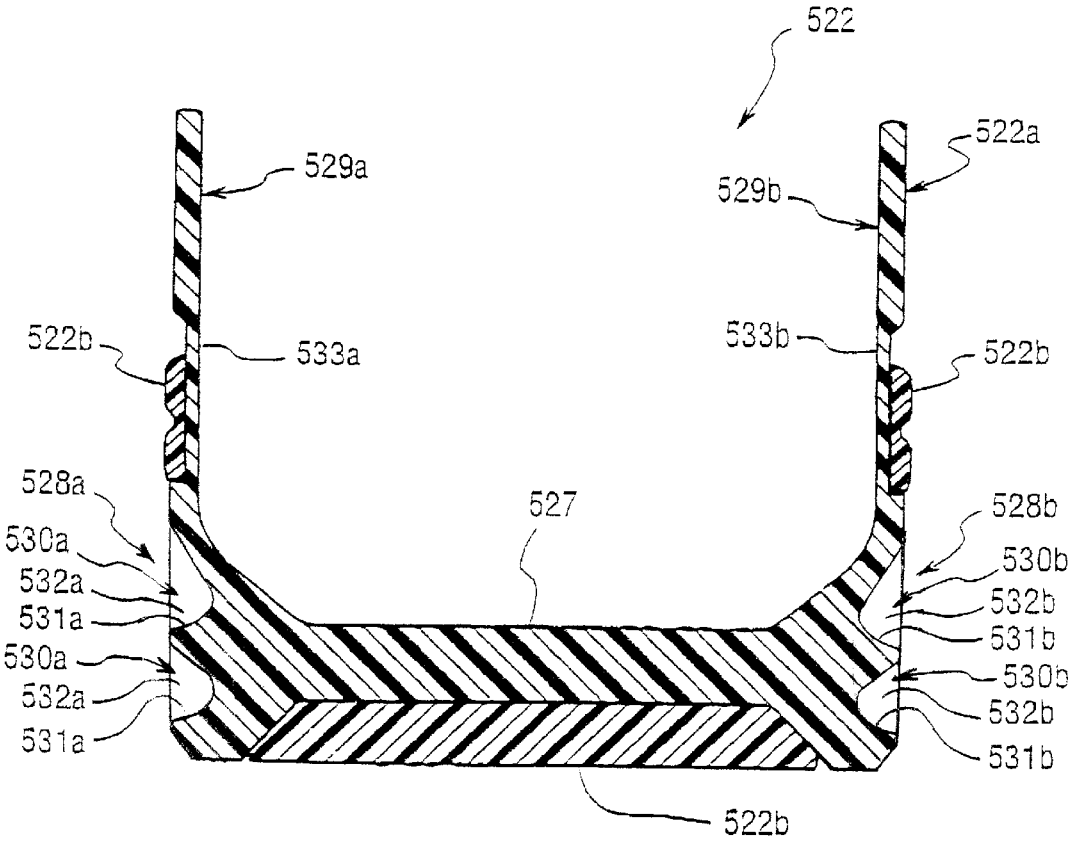
FIG. 38 is a transverse cross sectional view of the sole portion of the snowboard boot illustrated in FIG. 21 as seen along section line 38—38 of FIG. 35.
Figure 39:
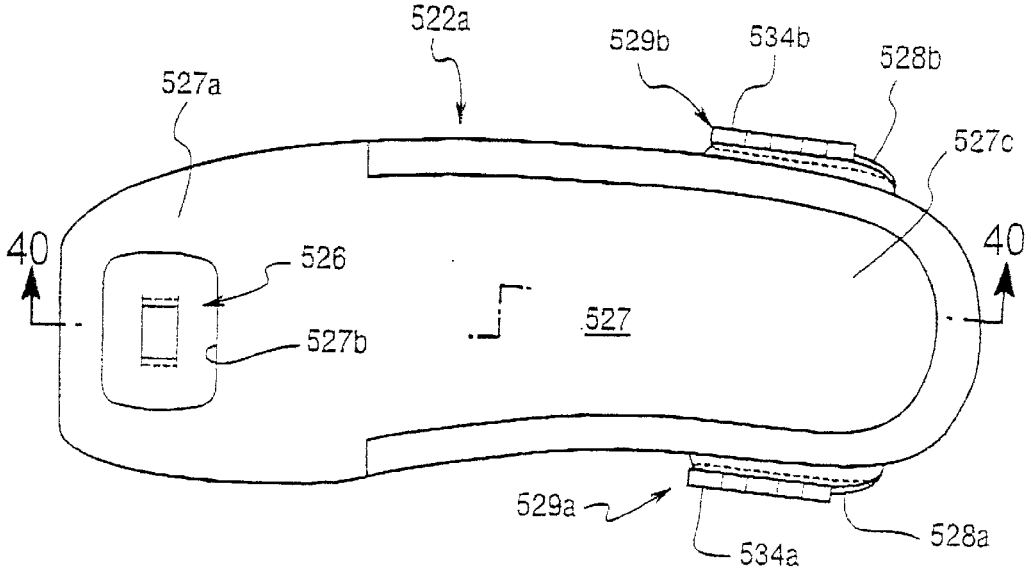
FIG. 39 is a top plan view of the mid sole of the sole portion of the snowboard boot illustrated in FIG. 21.
Figure 40:
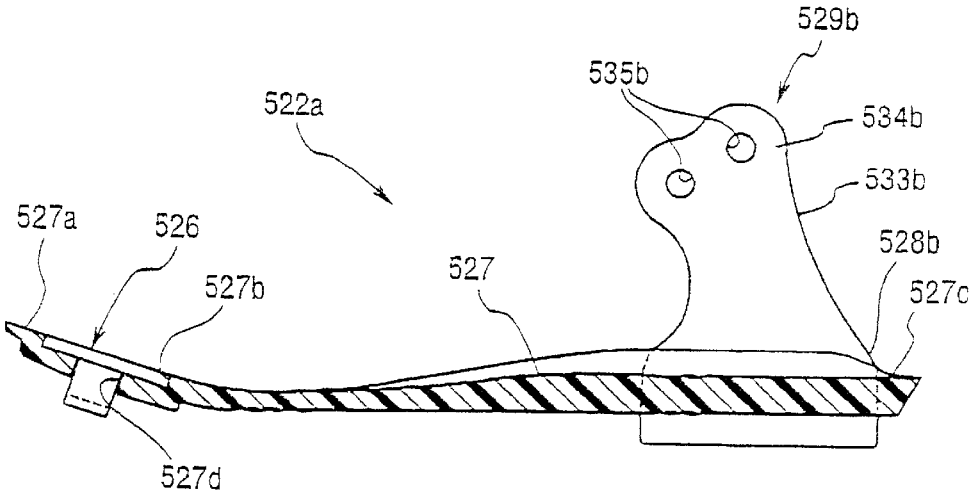
FIG. 40 is a center longitudinal cross sectional view of the mid sole of the sole portion illustrated in FIG. 39 as seen along section line 40—40 of FIG. 39.
Figure 41:
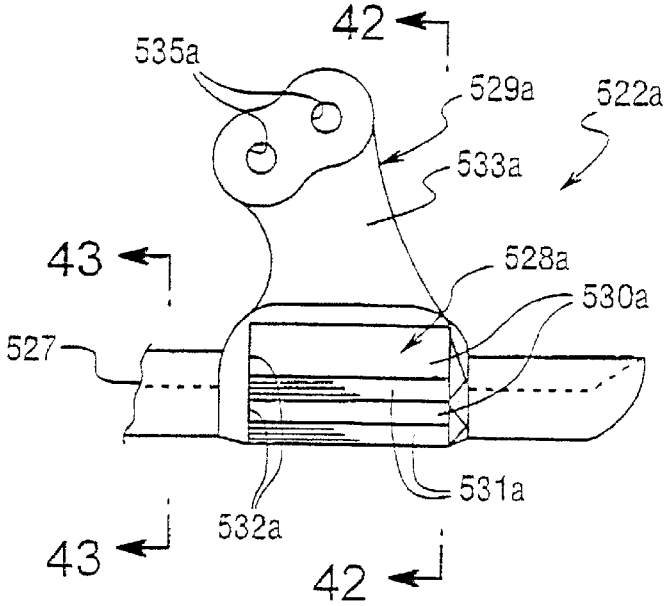
FIG. 41 is a partial side elevational view of the mid sole of the sole portion illustrated in FIGS. 39 and 40.
Figure 42:
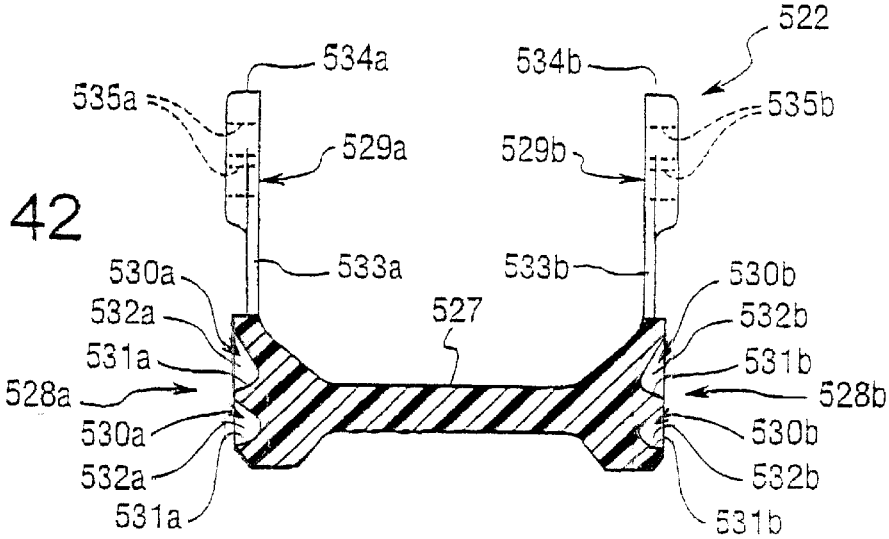
FIG. 42 is a transverse cross sectional view of the mid sole of the sole portion illustrated in FIGS. 39–41 as seen along section line 42—42 of FIG. 41.
Figure 43:
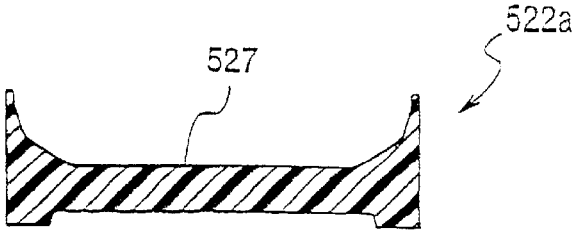
FIG. 43 is a transverse cross sectional view of the mid of the sole portion illustrated in FIG. 39 as seen along section line 43—43 of FIG. 41.
Figure 44:
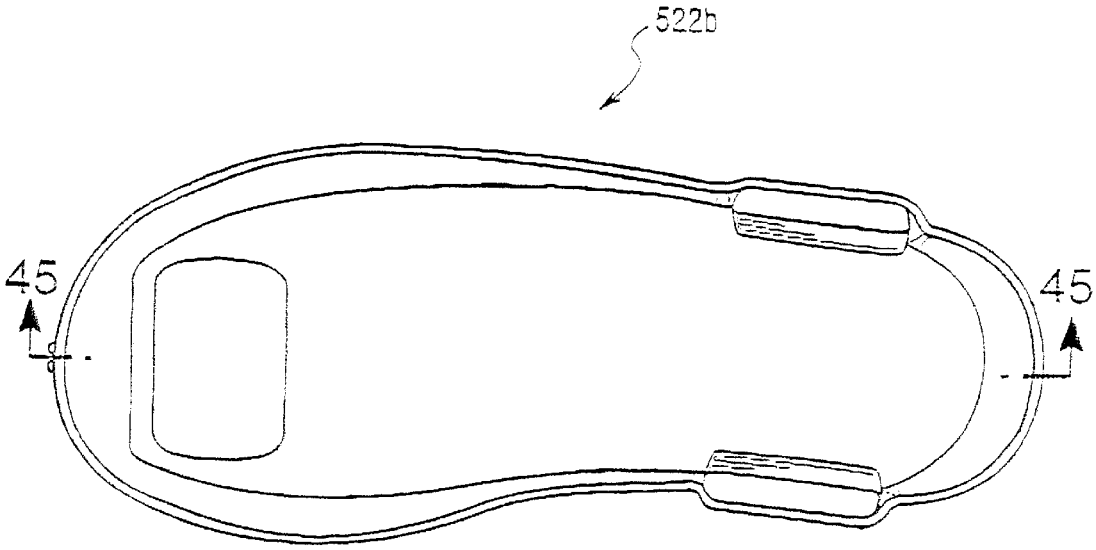
FIG. 44 is a top plan view of the outer sole of the sole portion of the snowboard boot illustrated in FIG. 21.
Figure 45:
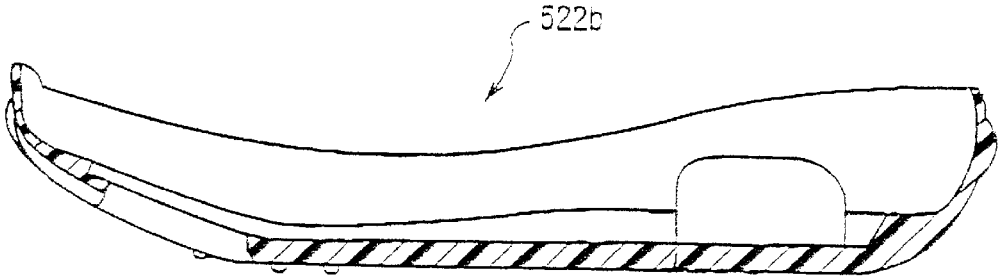
FIG. 45 is a center longitudinal cross sectional view of the outer sole of the sole portion illustrated in FIG. 44 as seen along section line 45—45 of FIG. 44.

As seen in FIGS. 34–45, the sole portion 522 is a modified version of the sole portion 22 of the first embodiment and is basically constructed of three parts. More specifically, the sole portion 522 has a mid sole 522*a* with an outer sole 522*b* molded thereon as seen in FIGS. 34–38 and a front catch 526 located at a front part of the mid sole 522*a* as seen in FIGS. 34, 39 and 40. The outer sole 522*b* is also molded onto the lower peripheral edge of the upper portion 524 such that the outer sole 522*b* fixedly and securely attaches the upper portion 524 to the mid sole 522*a*. The outer sole 522*b* is preferably constructed of a resilient rubber material that is suitable for forming the tread of the snowboard boot 514. As mentioned above, stitching can also be utilized to more securely fasten the upper portion 524 to the outer sole 522*b*.

As best seen in FIGS. 39–43, the mid sole 522*a* basically has a base portion 25 527, a pair (first and second) of rear catches 528*a* and 528*b*, and a pair (first and second) of strap attachment members 529*a* and 529*b*. In the most preferred embodiment, the first and second rear catches 528*a* and 528*b* and the first and second strap attachment members 529*a* and 529*b* are integrally formed with the base portion 527 of the mid sole 522*a* as a one-piece, unitary member. In other words, the mid sole 522*a* is preferably molded as a one-piece, unitary member with the first and second rear catches 528*a* and 528*b* and the first and second strap attachment members 529*a* and 529*b* being formed of a homogeneous material. The mid sole 522*a* is preferably constructed of a flexible but somewhat rigid material. For example, one suitable material for the mid sole 522*a* is a polyamide (PA) rubber with 35% glass fiber dispersed therein.

The base portion 527 of the mid sole 522 has a front toe section 527*a* with a front catch receiving recess 527*b* and a rear heel section 527*c*. Accordingly, the front catch 526 is located in the front catch receiving recess 527*b* of the base portion 527, while the front and rear catches 528*a* and 528*b* are located at the first and second lateral sides of the heel section 527*c* of the base portion 527. Similarly, the first and second strap attachment members 529*a* and 529*b* extend upwardly from the heel section 527*c* of the base portion 527. More preferably, the first and second strap attachment members 529*a* and 529*b* extend upwardly from the upper edges of the portions forming the first and second rear catches 528*a* and 528*b*.

The front catch 526 is preferably either molded into the mid sole 522*a* or attached thereto via fasteners (not shown). Alternatively, the front catch 526 can merely rest within the front catch receiving recess 527*b* and be held in place by an inner sole or liner and the wearer's foot.

Figure 33:
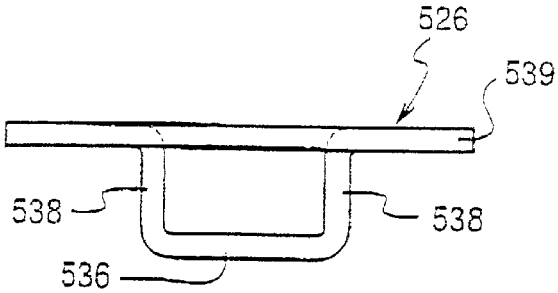
FIG. 33 is a front elevational view of the front catch illustrated in FIGS. 31 and 32 for the snowboard boot illustrated in FIG. 21.

As seen in FIGS. 31–34, the front catch 526 is basically a U-shaped member with a tongue portion 536 and a pair of leg portions 538 extending upwardly from the tongue portion 536. The leg portions 538 are coupled together by a mounting plate 539. The mounting plate 539 rests on the upwardly facing surface of the front catch receiving recess 527*b*, while the tongue portion 536 and the leg portions 538 extend through the opening 527*d* formed in the front catch receiving recess 527*b*. Preferably, the front catch 526 is constructed of a one-piece, unitary member with the tongue portion 536 and the leg portions 538 having a rectangular cross section as best seen in FIGS. 33 and 34. In the most preferred embodiment, the front catch 526 is preferably constructed of a hard rigid material, such as steel or any other suitable material. It will be apparent to those skilled in the art from this disclosure that the front catch 526 can be implemented in any number of ways, and the present invention is not limited to the particular implementations shown in the drawings, which are provided for merely purposes of illustration. Of course, it will be apparent to those skilled in the art that the construction of the front catch 526 will depend upon the particular binding being utilized.

As mentioned above and as seen best in FIGS. 38, 41 and 42, the rear catches 528*a* and 528*b* are molded with the mid sole 522*a* of the sole portion 522. The rear catches 528*a* and 528*b* are identical to the rear catches 28*a* and 28*b* of the first embodiment except that the rear catches 528*a* and 528*b* are molded into the mid sole 522*a* of a multi-part sole portion 522. In other words, the rear catches 528*a* and 528*b* are designed to engage the snowboard binding 512 at a plurality of engagement or locking positions having different heights relative to the snowboard binding 512 in a manner identical to the first embodiment. More specifically, the first rear catch 528*a* is formed by molding a plurality (only two illustrated) of longitudinally extending, substantially V-shaped grooves or notches 530*a* into a first lateral side of the mid sole 522*a* of the sole portion 522. Likewise, the second rear catch 528*b* is formed by molding a plurality (only two illustrated) of longitudinally extending, substantially V-shaped grooves 530*b* into a second opposite lateral side of the mid sole 522 of the sole portion 522.

Preferably, each of the notches or grooves 530*a* has a concave abutment surface 531*a* that is angled relative to the bottom surface of the base portion 527. Likewise, each of the notches or grooves 530*b* has a concave abutment surface 531*b* that is angled relative to the bottom surface of the base portion 527. Preferably, each of the abutment surfaces 531*a* or 531*b* generally forms an angle with the bottom surface of the base portion 527. In other words, the abutment surfaces 531*a* and 531*b* taper downwardly and curve outwardly from a center plane of the snowboard boot 514 and are configured to engage the snowboard binding 512 to prevent upward movement of the snowboard boot 514 relative to the snowboard boot binding 512. The notches or grooves 530*a* and 530*b* also preferably have a depth sufficient to prevent upward movement of the snowboard boot 514 relative to the snowboard boot binding 512 and are configured/shaped to mate with the snowboard boot binding 512 as discussed below.

At the front edge of each of the longitudinally extending, substantially V-shaped grooves 530*a* and 530*b* are stop surfaces 532*a* and 532*b* which limit rearward movement of the snowboard boot relative to the snowboard binding 512.

Of course, it will be apparent to those skilled in the art from this disclosure that the snowboard boot 514 can be designed to have additional engagement or locking positions at different heights, if needed and/or desired. For example, the snowboard boot 514 can be designed to have three different engagement positions with three different heights (i.e., three longitudinally extending, substantially V-shaped grooves), respectively. However, it should be appreciated from this disclosure that the present invention is not limited to the precise construction of the rear catches 528*a* and 528*b*. Rather, the rear catches 528*a* and 528*b* can be implemented in a number of ways, and the present invention is not limited to the particular implementations shown in the drawings, which are provided merely for purposes of illustration.

The first and second strap attachment members 529*a* and 529*b* include first and second flexible connecting portions 533*a* and 533*b* and first and second attachment portions 534*a* and 534*b* located at free ends of the first and second flexible connecting portions 533*a* and 533*b*, respectively. Each of the first and second attachment portions 534*a* and 534*b* has a plurality (two) of attachment holes 535*a* and 535*b*, respectively.

As seen in FIG. 21, a rear boot strap 537 is connected between the first and second attachment portions 534*a* and 534*b* of the first and second strap attachment members 529*a* and 529*b*. The rear boot strap 537 extends across the front ankle section of the upper portion 524 of the snowboard boot 514. Preferably, the rear boot strap 537 is constructed of two boot strap section 537*a* and 537*b* that are coupled together by a buckle 537*c* for adjusting the longitudinal length of the rear boot strap 537 between the first and second attachment portions 534*a* and 534*b*. More specifically, the first and second boot strap sections 537*a* and 537*b* have their first ends fixedly coupled to the first and second attachment portions 534*a* and 534*b* via fasteners 539 (only one shown) and their second ends adjustably coupled to each other by the buckle 537*c*.

The outer sole 522*b* is molded around the peripheral edge of the base portion 527 of the mid sole 522*a* and extends upwardly from the peripheral edge of the base portion 527 to be fixedly coupled to the foot section 524*a* of the upper portion 524. Moreover, the outer sole 522*b* is molded to surround the first and second rear catches 528*a* and 528*b* and to overlie a portion of the first and second flexible connecting portions 533*a* and 533*b* of the first and second strap attachment members 529*a* and 529*b*. Thus, the outer sole 522*b* provides additional support to the first and second rear catches 528*a* and 528*b* as well as additional support for the first and second strap attachment members 529*a* and 529*b*.

Referring again to FIGS. 21 and 22, the snowboard binding 512 is preferably a highback binding that applies a forward leaning force on the snowboard boot 514. The snowboard binding 512 uses many of the same parts as the first embodiment. Thus, the parts of the snowboard binding 512 that are identical to the parts of the snowboard binding 12 of the first embodiment will be given the same reference numerals. Moreover, the modifications (the second, third and fourth embodiments) to the first embodiment can also be applied to the snowboard binding 512.

The snowboard binding 512 is attached to the top or upper surface of the snowboard 16 via four fasteners or screws 18 in a conventional manner. The longitudinal axis of the snowboard 16 is represented by the centerline A in FIG. 21. The snowboard binding 512 basically has a base member 40, a front binding member 542 and a pair (first and second) of rear binding members 44*a* and 44*b* that form a rear binding arrangement. The base member 40 has a front portion, a rear portion and a longitudinal axis B extending between the front and rear portions. The front binding member 542 is movably coupled to the base member 40 between a release position and a latched position. The pair (first and second) of rear binding members 44*a* and 44*b* are coupled to opposite lateral sides of the base member 40 as discussed in more detail above.

As in the first embodiment discussed above, the base member 40 of the fifth embodiment basically includes a base plate 46 adjustably coupled to the snowboard 16 via the adjustment disk 20, a heel cup 48 adjustably coupled to the base plate 46 and a highback 50 adjustably coupled to the heel cup 48. The snowboard binding 512 is preferably adjustably coupled to the snowboard 16 via the adjustment disk 20. The rear binding members 44*a* and 44*b* are movable relative to the base member 40 to selectively hold the snowboard boot 514 thereto. The rear binding members 44*a* and 44*b* are arranged to move laterally apart relative to each other from the initial rest positions to the guide or coupled positions upon application of a force in a direction substantially towards the base member 40 in the same manner as the first embodiment discussed above. The rear binding members 44*a* and 44*b* are also arranged to move laterally toward each other or together to one of the locked or latched positions upon removal of the force in the same manner as the first embodiment discussed above. Thus, the rear binding members 44*a* and 44*b* are arranged to selectively hold the snowboard boot 514 in a plurality of engagement or locked or latched positions having different heights above the base member 40 in the same manner as the first embodiment discussed above.

Figure 22:
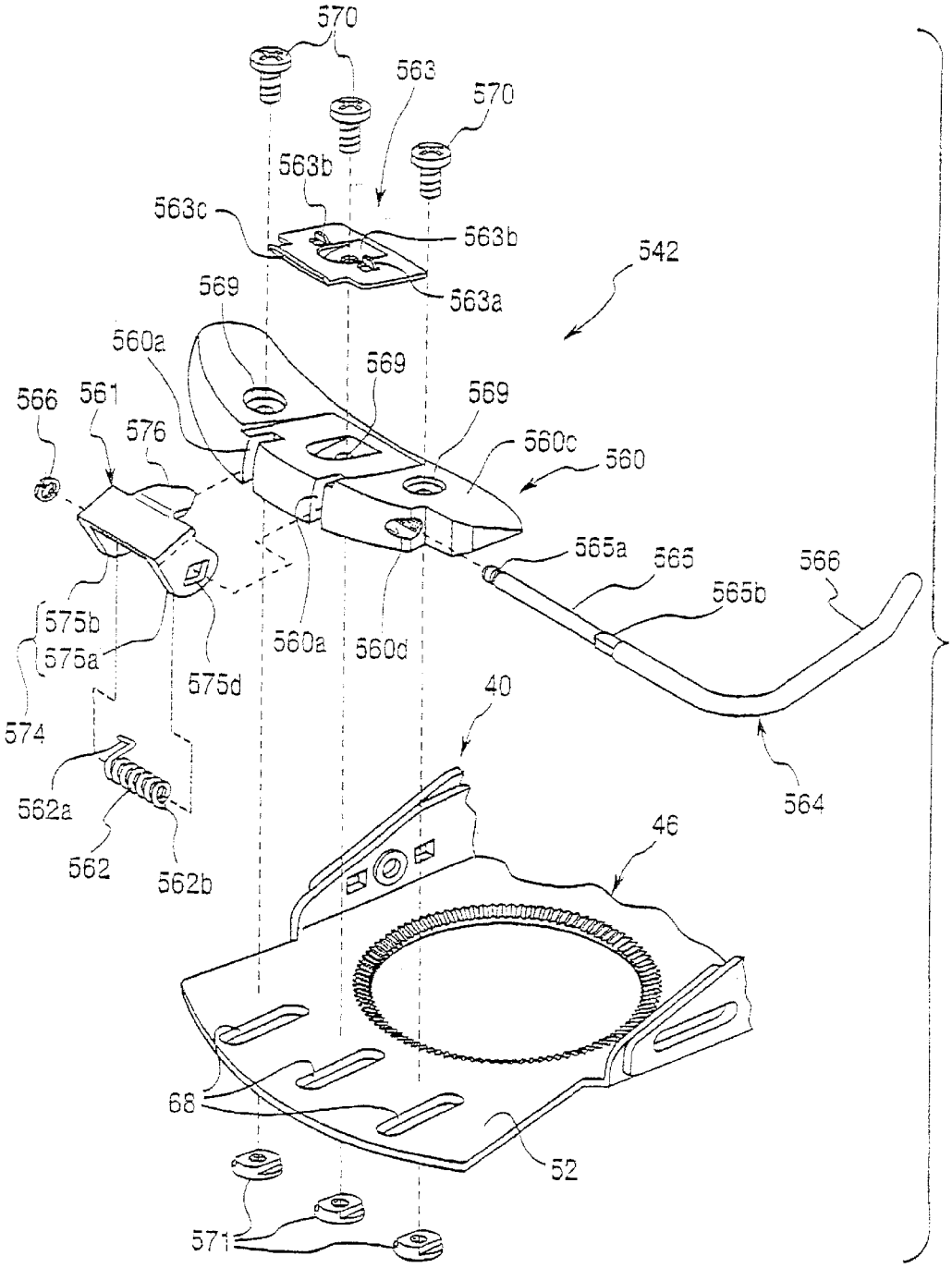
FIG. 22 is a partially exploded perspective view of the front binding member for the snowboard binding illustrated in FIG. 21.
Figure 23:
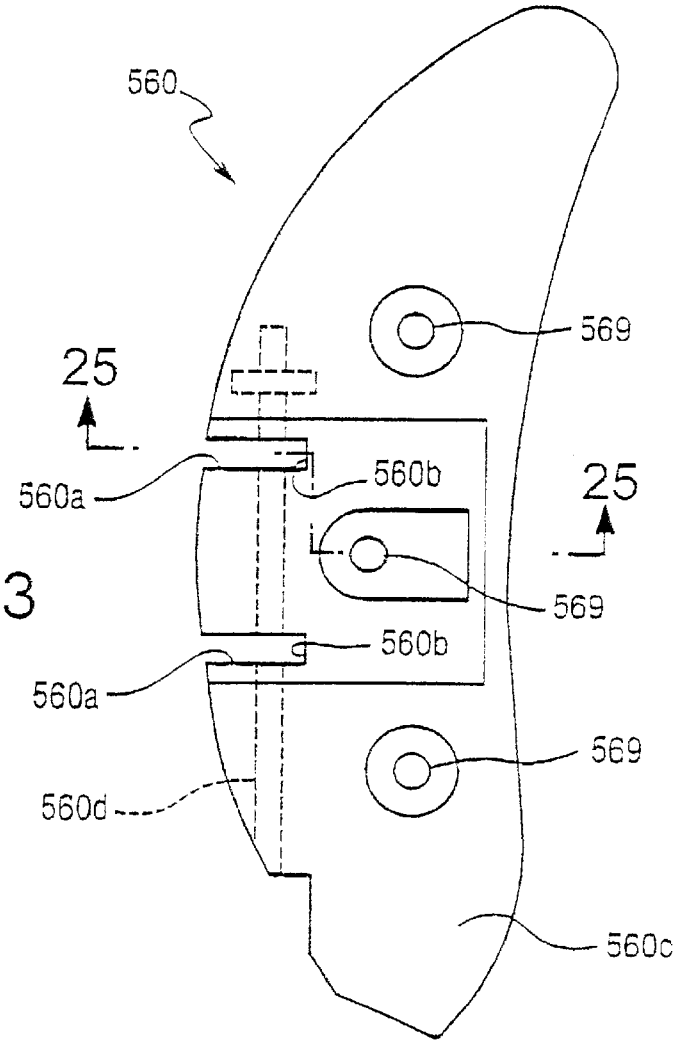
FIG. 23 is a top plan view of the front binding plate of the front binding member for the snowboard binding illustrated in FIG. 21.
Figure 24:
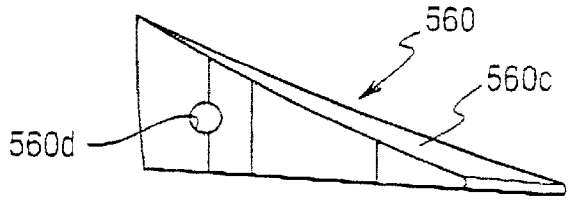
FIG. 24 is a side elevational view of the front binding plate illustrated in FIG. 23 for the snowboard binding illustrated in FIG. 21.
Figure 25:
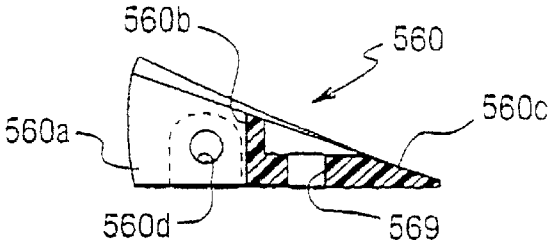
FIG. 25 is a cross sectional view of the front binding plate illustrated in FIGS. 23 and 24 for the snowboard binding illustrated in FIG. 21 as seen along section line 25—25 of FIG. 23.
Figure 26:
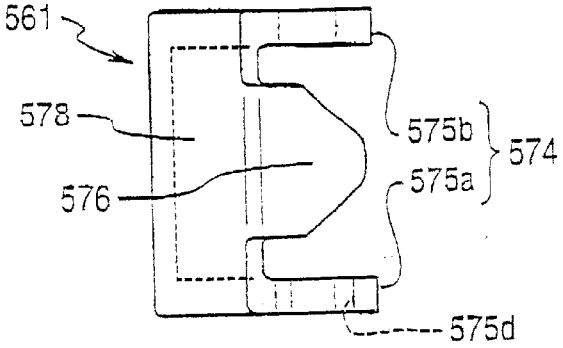
FIG. 26 is a top plan view of the front claw of the front binding member for the snowboard binding illustrated in FIG. 21.
Figure 27:
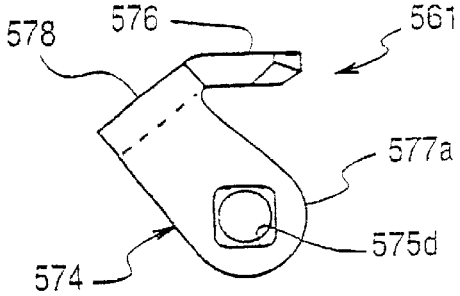
FIG. 27 is a side elevational view of the front claw illustrated in FIG. 26 for the snowboard binding illustrated in FIG. 21.

As best seen in FIG. 22, the front binding member 542 basically includes a front binding plate 560, a front claw 561, a front biasing member 562, a front stop member 563 and the release lever 564. The front claw 561 is movably coupled to the front portion of the base member 40 between a release position and a latched position by the front binding plate 560. The front stop member 563 is fixedly coupled to the front portion of the base member 40 adjacent the front claw 561 by the front binding plate 560.

As seen in FIGS. 21, the mounting portion 52 of the base plate 46 has the front binding plate 560 fixedly coupled thereto to form a front portion of the base plate 46. The front claw 561 is movably coupled to the binding plate 560. Thus, when the front binding plate 560 is fixedly coupled to the mounting portion 52, the front claw 561 is movably (pivotally) coupled to the base plate 46 of the base member 40. The front claw 561 is preferably pivotally coupled to the front binding plate 560 via the front release lever 564 which functions as a front pivot pin for the front claw 561. The biasing member 562 is arranged on the front release lever 564 to bias the front claw 561 toward an engaged or latched position. The control or release lever 564 is preferably non-rotatably coupled to the front claw 561 to move the front claw 561 against the biasing or urging force of the biasing member or spring 562 from the latched position toward the release position.

As best seen in FIGS. 22–25, the binding plate 560 includes a pair of openings or slots 560*a* formed therein, which are configured to partially receive the front claw 561. The slots 560*a* form a pair of stop surfaces 560*b* located at the rearmost edges of the slots 560*a*. The stop surfaces 560*b* normally hold the front claw 561 in the latched position. Moreover, because the pivot axis of the front claw 561 is below bottom surface of the binding plate 560, the front claw 561 can rotate out of contact with the front catch 526. The bottom surface of base member 40 forms an additional stop surface when the front claw 561 is in the release position. In this manner, the front claw 561 can rotate about ninety degrees from the latched position where the front binding flange 576 is substantially horizontal to the release position where the front binding flange 576 is substantially vertical.

The front binding plate 560 has an inclined upper surface 560*c* that slopes upwardly along the longitudinal axis B of the base member 40 as the inclined upper surface 560*c* extends towards a front end of the base member 40.

Additionally, as best seen in FIGS. 21 and 22, the front binding plate 560 is preferably adjustable (along longitudinal axis B) relative to the mounting portion 52 of the base plate 46. More specifically, the mounting portion 52 includes a plurality (three) of slots 68, while the binding plate 560 includes a plurality (three) through holes 569. The fasteners or attachment screws 570 are inserted through the holes 569 and the slots 68 and attached to the nuts 571 to fixedly couple the front binding plate 560 to the mounting portion 52 in an adjustable manner along longitudinal axis B of the base member 40. Thus, the front binding member 542 can be selectively coupled at different longitudinal positions relative to base member 40. Of course, it will be apparent to those skilled in the art that various other structures could be utilized to adjust the longitudinal position of the front binding member 542. Moreover, it will be apparent to those skilled in the art that the binding plate 560 could be integrally formed with the base plate 46 if needed and/or desired.

As best seen in FIGS. 21, 22, 26 and 27, the front claw 561 is an inverted U-shaped member having a mounting portion 574, a binding flange 576 and a connecting portion 578. The front claw 561 is urge to the latched position by the biasing member or spring 562 so as to position the binding flange 576 above the ramp surface of the front stop member 563. The binding flange 576, the ramp surface 563*c* and the tabs or stops 563*b* form a front cleat receiving area therebetween. The release lever 564 is fixedly coupled to the front claw 561 to move the front claw 561 from the latched position to the release position upon application of a force on the release lever 564 that is greater than the urging force of the front biasing member or spring 562.

Figure 28:
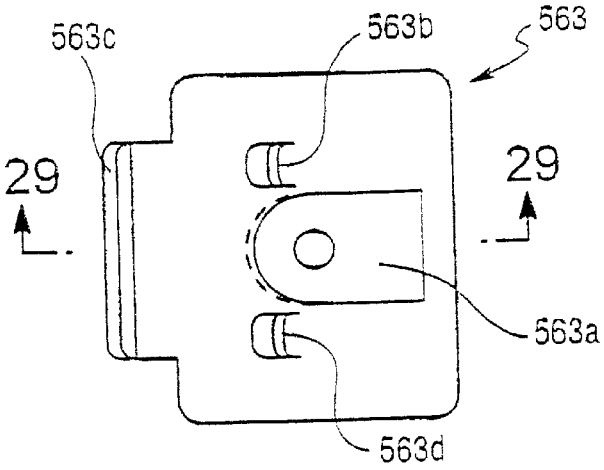
FIG. 28 is a top plan view of the front stop member of the front binding member for the snowboard binding illustrated in FIG. 21.
Figure 29:
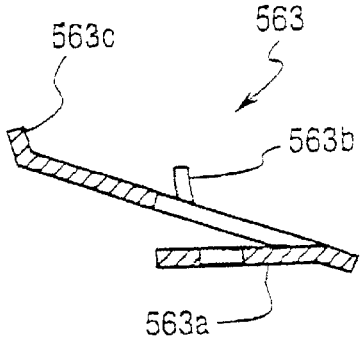
FIG. 29 is a cross sectional view of the front stop member illustrated in FIG. 28 for the snowboard binding illustrated in FIG. 21 as seen along section line 29—29 of FIG. 28.
Figure 30:
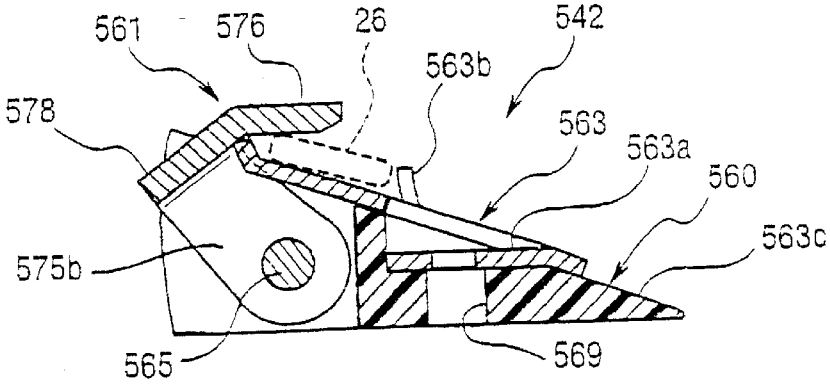
FIG. 30 is a cross sectional view of the front binding member for the snowboard binding illustrated in FIG. 21 as seen along section line 30—30 of FIG. 21.
Figure 31:
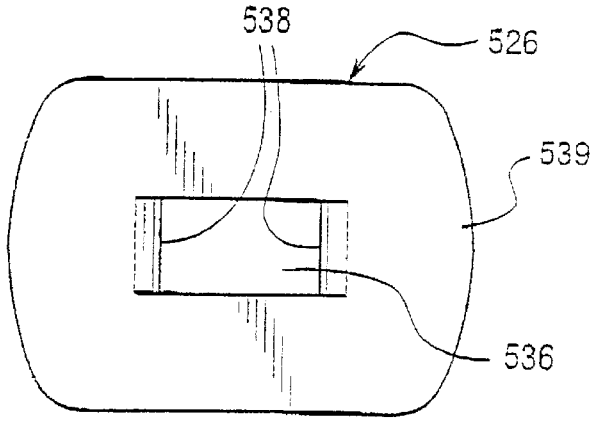
FIG. 31 is a top plan view of the front catch for the snowboard boot illustrated in FIG. 21.
Figure 32:
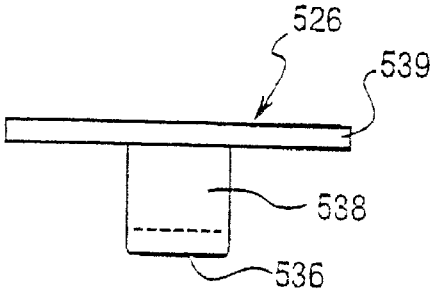
FIG. 32 is a side elevational view of the front catch illustrated in FIG. 31 for the snowboard boot illustrated in FIG. 21.

As best seen in FIGS. 28–30 the front stop member 563 is preferably a metal plate member that is bent to form a mounting plate 563*a* with a pair of tabs or stops 563*b* and a ramp surface 563*c*. The mounting plate 563*a* of the front stop member 563 is fixedly coupled to the front binding plate 560 and the mounting portion 52 of the base plate 46 by one of the fasteners or attachment screws 570. The tabs or stops 563*b* form a forwardly facing stop surface that is spaced rearwardly from the latching surface of the front claw 561 to define part of the front cleat receiving area therebetween. The ramp surface 563*c* extending upwardly at an acute angle from mounting plate 563*a*. When the front stop member 563 is mounted on the base member 40, the ramp surface 563*c* is inclined upwardly relative to the base member 40 to assist in the release of the front catch 526 from the front claw 561.

As best seen in FIG. 22, the release lever 564 basically includes a pivot pin section 565 pivotally supported in bore 560*d*, and a handle or control section 566 extending perpendicularly from the pivot pin section 565. In other words, the pivot pin section 565 of the release lever 564 forms the front pivot pin of the front claw 561. Thus, the release lever 564 is integrally formed as a one-piece, unitary member. The pivot pin section 565 preferably includes an annular recess 65*a* formed at a free end thereof. A suitable retaining member or C-clip 566 is received in the annular recess 565*a* to secure the release lever 564 and the front claw 561 to the binding plate 560, with the spring 562 arranged therebetween.

As best seen in FIGS. 21, 22, 26 and 27, the mounting portion 574 of the front claw 561 is non-rotatably mounted on the pivot pin section 565 of the release lever 564 for rotation between a latched position and a release position about a front pivot axis. The front pivot axis is arranged below the binding plate 560 such that front claw 561 can be moved out of engagement with the front catch 526 (i.e. to the release position). The biasing member or spring 562 applies an urging force on the front claw 561 to urge the front claw 561 to the latched position. The front claw 561 includes a lower latching surface configured to engage an upper surface of the tongue portion 536 of the front catch 526 of the snowboard boot 514. The connecting portion 578 extends between the binding plate 576 and the mounting portion 574.

More specifically, the mounting portion 574 is preferably formed of a pair (first and second) mounting flanges 575*a* and 575*b*. The mounting flange 575*a* is designed to engage a first end 562*a* of the spring 562. The other end (second end) 562*b* of spring 562 is designed to be received in a transverse hole (not shown) formed in the mounting plate 560. Thus, the spring 562 is preloaded to urge the front binding member 542 towards the latched position to selectively hold the front catch 526 of the snowboard boot 514. Additionally, at least one of the mounting flanges 575*a* and 575*b* preferably includes a noncircular (square) opening 575*d* to non-rotatably receive a noncircular portion 565*b* of the release lever 564.

Mounting and dismounting the snowboard boot 514 with the snowboard binding 512 will now be discussed in more detail. When the rider wants to enter the snowboard binding 512, the boot 514 should be slightly inclined. The front catch 526 is first engaged with the front claw 561. Specifically, the front catch 526 is positioned beneath the front binding flange 576. Then the rider moves the rear portion of the snowboard boot 514 in a direction substantially towards the base plate 46. In other words, the snowboard boot 514 pivots rearwardly about the front catch 26 such that the rear of the boot 514 moves substantially toward the base member 40.

This movement of the snowboard boot 514 causes the rear binding members 44*a* and 44*b* to pivot against the biasing force of the springs 90*a* and 90*b*, respectively. Thus, the rear tooth portions 86*a* and 86*b* move laterally away from longitudinal axis B into guide or coupled positions (first and second guide or coupled positions, respectively) such that the snowboard boot 514 can be moved downwardly. Once the rear catches 528*a* and 528*b* move a predetermined distance, the rear tooth portions 86*a* and 86*b* move from the (first and second) guide or coupled positions to (first and second) locking or latching positions. Thus, the snowboard boot 514 is in a first locked or latched position. In this first locked or latched position, the rear of the sole portion 522 is slightly spaced from the mounting portion 52 of the base plate 46. Thus an obstruction, such as snow, mud or sand can be accommodated if needed. The snowboard boot 14 can be further moved into a second locked or latched position, if no obstruction prevents such movement. In this second locked or latched position, the rear tooth portions 86*a* and 86*b* move from intermediate (first and second) guide or coupling positions (not shown) to additional (first and second) locking or latching positions, respectively. Thus, the snowboard boot 514 is in a second locked or latched position.

Release of the snowboard boot 514 from snowboard binding 512 will now be discussed in more detail. The snowboard binding 512 can easily release the snowboard boot.514 therefrom, when the snowboard boot 514 is in either of the locked or latched positions. Specifically, the release lever 564 is pivoted in order to move the front claw 561 from the latched position to the release position. Thus, the front catch 526 of the snowboard boot 514 is released from the snowboard binding 512. However, the rear binding members 44*a* and 44*b* remain in the engagement or locking positions. In order to completely, detach the snowboard boot 514 from snowboard binding 512, the snowboard boot 514 is then moved longitudinally (i.e. along longitudinal axis B) such that the tooth portions 86*a* and 86*b* slide in notches or grooves 530*a* and 530*b*, respectively. After the boot 514 is moved a sufficient distance, the tooth portions 86*a* and 86*b* will not engage or lock the notches or grooves 530*a* and 530*b*. Thus the snowboard boot 514 can be completely released from the snowboard binding 512.

SIXTH EMBODIMENT

Referring now to FIGS. 46–96, a snowboard binding system 610 is illustrated in accordance with a sixth embodiment of the present invention. The snowboard binding system 610 basically includes a modified snowboard binding 612 and a modified snowboard boot 614.

The snowboard binding 612 of this sixth embodiment is substantially identical to the snowboard binding 12 of the first embodiment, except that the front binding arrangement of the snowboard binding 612 has been modified from the front binding arrangement of the snowboard binding 12 of the first embodiment as discussed below and guide features have been added to aid in the disengagement of the snowboard boot 614 from the snowboard binding 612. Thus, the remaining parts of the snowboard binding 612 are substantially identical to the snowboard binding 12 of the first embodiment. Since the snowboard binding 612 of the sixth embodiment is substantially identical to the snowboard binding 12 of the first embodiment, the snowboard binding 612 will not be discussed or illustrated in detail herein. Rather, the following description will focus mainly on the differences of the snowboard binding 612 from the snowboard binding 12. Moreover, it will be apparent to those skilled in the art that most of the descriptions of the snowboard binding 12 of the first embodiment apply to the snowboard binding 612 of this sixth embodiment.

The snowboard boot 614 of this sixth embodiment is substantially identical to the snowboard boot 14 of the first embodiment, except that the front binding arrangement of the snowboard boot 614 has been modified from the front binding arrangement of the snowboard boot 14 of the first embodiment as discussed below and guide features have been added to aid in the engagement and disengagement between the snowboard boot 614 and the snowboard binding 612. Thus, the remaining parts of the snowboard boot 614 are substantially identical to the snowboard boot 14 of the first embodiment. Since the snowboard boot 614 of the sixth embodiment is substantially identical to the snowboard boot 14 of the first embodiment, the snowboard boot 614 will not be discussed or illustrated in detail herein. Rather, the following description will focus mainly on the differences of the snowboard boot 614 from the snowboard boot 14. Moreover, it will be apparent to those skilled in the art that most of the descriptions of the snowboard boot 14 of the first embodiment apply to the snowboard boot 614 of this sixth embodiment.

Similar to the snowboard binding 12, the snowboard binding 612 is attached to the top or upper surface of the snowboard 16 via four fasteners or screws 18 in a conventional manner (FIG. 1). It will be apparent to those skilled in the art from this disclosure that a pair of snowboard binding systems 610 are utilized in conjunction with the snowboard 16 such that the rider has both feet firmly attached to the snowboard 16. Preferably, two adjustment disks 620 are used to adjustably couple the pair of snowboard binding systems 610 to the snowboard 16 via the screws 18. For the sake of brevity, only a single snowboard binding system 610 will be discussed and/or illustrated herein.

Turning first to the snowboard boot 614 of the present invention, preferably the snowboard boot 614 is a relatively soft or flexible snowboard boot. Soft snowboard boots are well known in the art, and thus, will not be discussed or illustrated herein. The snowboard boot 614 will not be discussed or illustrated in detail herein, except for the new features of the snowboard boot 614 that relate to snowboard binding system 610 of the present invention. Basically, the snowboard boot 614 is a soft boot and has a sole portion 622 made of a stiff rubber-like material, and a flexible upper portion 624 constructed of a variety of materials, such as plastic materials, leather and/or synthetic leather materials. The upper portion 624 is basically constructed of a flexible material and is fixedly attached to the sole portion 622 via adhesive molding and/or stitching (not shown). Thus, the upper portion 624 of the snowboard boot 614 should be somewhat flexible. The upper portion 624 has a foot section 624*a* fixedly coupled to the sole portion 622 and a leg section 624*b* extending upwardly from the foot section 624*a*. The upper portion 624 is not critical to the present invention, and thus, will not be discussed or illustrated in further detail herein.

As seen in FIGS. 46–48 and 56–62, the sole portion 622 is basically constructed of three parts. More specifically, the sole portion 622 has a mid sole 622*a* with an outer sole 622*b* molded thereon, and a front catch 626 located at a front part of the mid sole 622*a*. The outer sole 622*b* is also molded onto the lower peripheral edge of the upper portion 624 such that the outer sole 622*b* fixedly and securely attaches the upper portion 624 to the mid sole 622*a*. The outer sole 622*b* is preferably constructed of a resilient rubber material that is suitable for forming the tread of the snowboard boot 614. As mentioned above, stitching can also be utilized to more securely fasten the upper portion 624 to the outer sole 622*b*.

As best seen in FIGS. 56–62, the mid sole 622*a* basically has a base or foot portion 627, and first and second lateral side portions that include first and second rear catches 628*a* and 628*b*, and first and second strap attachment members 629*a* and 629*b*. In the most preferred embodiment, the first and second rear catches 628*a* and 628*b* and the first and second strap attachment members 629*a* and 629*b* are integrally formed with the base portion 627 of the mid sole 622*a* as a one-piece, unitary member. In other words, the mid sole 622*a* is preferably molded as a one-piece, unitary member with the first and second rear catches 628*a* and 628*b* and the first and second strap attachment members 629*a* and 629*b* being formed of a homogeneous material. The mid sole 622*a* is preferably constructed of a flexible but somewhat rigid material. For example, one suitable material for the mid sole 622*a* is a polyamide (PA) rubber with 35% glass fiber dispersed therein.

The base or foot portion 627 of the mid sole 622*a* has a front toe section 627*a* with a front catch receiving recess 627*b* and a rear heel section 627*c*. Accordingly, the front catch 626 is located in the front catch receiving recess 627*b* of the base portion 627, while the front and rear catches 628*a* and 628*b* are located at the first and second lateral sides of the heel section 627*c* of the base portion 627. Similarly, the first and second strap attachment members 629*a* and 629*b* extend upwardly from the heel section 627*c* of the foot portion 627. More preferably, the first and second strap attachment members 629*a* and 629*b* extend upwardly from the upper edges of the portions forming the first and second rear catches 628*a* and 628*b*.

The mid sole 622*a* is also provided with several guide features to aid in stepping into and stepping out of the snowboard boot binding 612. A first guide feature of the mid sole 622*a* includes a pair of front catch guide flanges 630. Specifically, the bottom surface of the mid sole 622*a* has the front catch guide flanges 630 extending outwardly therefrom. The front catch guide flanges 630 are located forwardly and laterally relative to the front catch 626 that is coupled to the mid sole 622*a*. The front catch guide flanges 630 are preferably integrally formed as a onepiece, unitary member with the remainder of the mid sole 622*a*. The front catch guide flanges 630 extend through the outer sole 622*b*. The front catch guide flanges 630 are angled to converge rearwardly such that the rearward ends of the front catch guide flanges 630 are located just forwardly of the front catch 626. Preferably, the front catch guide surfaces of the front catch guide flanges 630 are angled approximately 45° relative to the longitudinal axis B. In other words, the front catch guide flanges 630 have a pair of converging front catch guide surfaces that form a guide slot therebetween to aid in the engagement of the snowboard boot 614 to the snowboard boot binding 612. These front catch guide surfaces of the front catch guide flanges 630 have rearward ends that are laterally spaced apart by a distance that is slightly larger than the lateral dimension of the front catch 626.

A second guide feature provided by the mid sole 622*a* includes a pair of rear guide areas 631*a* and 631*b* which are located at first and second lateral edges of the bottom surface of the mid sole 622*a*. More specifically, the guide areas 631*a* and 631*b* are aligned with the rear catches 628*a* and 628*b*, respectively. The mid sole 622*a* is constructed of a more rigid material than the outer sole 622*b* and the mid sole 622*a* has a lower coefficient of friction than the material of the outer sole 622*b*. In other words, the outer sole 622*b* is constructed of a rubber material that partially overlies exterior facing surfaces of the mid sole 622*a* such that the guide areas 631*a* and 631*b* are exposed in an area adjacent the first and second lateral side portions (rear catches 628*a* and 628*b*). The guide areas 631*a* and 631*b* engage the snowboard boot binding 612 as discussed below to aid in the release of the snowboard boot 614 from the snowboard binding 612. More specifically, in order to release the snowboard boot 614 from the snowboard binding 612, the snowboard boot 614 is moved generally forwardly such that the snowboard boot 614 slides forwardly on the snowboard binding 612. In other words, the guide area 631*a* and 631*b* engage the snowboard binding 612 to provide for more smooth forward movement of the snowboard boot 614 on the snowboard binding 612. Therefore, the longitudinal length of the guide areas 631*a* and 631*b* should be long enough so that the outer sole 622*b* has limited contact with the snowboard binding 612 during disengagement of the snowboard boot 614 therefrom.

A third guide feature of the mid sole 622*a* includes a front guide element 632 projecting downwardly from the toe section 627*a* of the mid sole 622*a*. This front guide element 632 is located rearwardly of the front catch 626. The front guide element 632 is preferably a wedge-shaped member that gradually projects further downwardly from the front toe section 627*a* as the front guide element 632 approaches toward the rear heel section 627*c*. Similar to the guide surfaces 631*a* and 631*b*, the front guide element 632 aids in the disengagement of the snowboard boot 614 from the snowboard binding 612. Specifically, the front guide element 632 contacts the snowboard boot binding 612 such that forward movement of the snowboard boot 614 causes the snowboard boot 614 to move upwardly away from the snowboard binding 612.

As mentioned above and as seen best in FIGS. 58 and 62, the rear catches 628*a* and 628*b* are molded with the mid sole 622*a* of the sole portion 622. The rear catches 628*a* and 628*b* are identical to the rear catches 28*a* and 28*b* of the first embodiment except that the rear catches 628*a* and 628*b* are molded into the mid sole 622*a* of a multi-part sole portion 622. In other words, the rear catches 528*a* and 528*b* are designed to engage the snowboard boot binding 612 at a plurality of engagement or locking positions having different heights relative to the snowboard binding 612. More specifically, the first rear catch 628*a* is formed by molding a plurality of longitudinally extending, substantially V-shaped grooves or notches into a first lateral side of the mid sole 622*a* of the sole portion 622. Likewise, the second rear catch 628*b* is formed by molding a plurality of longitudinally extending, substantially V-shaped grooves into a second opposite lateral side of the mid sole 622*a* of the sole portion 622. The rear catches 628*a* and 628*b* are configured to engage the snowboard binding 612 to prevent upward movement of the snowboard boot 614 relative to the snowboard boot binding 612 similar to the first embodiment. Thus, the notches or grooves of the rear catches 628*a* and 628*b* have depths sufficient to prevent upward movement of the snowboard boot 614 relative to the snowboard boot binding 612 and are configured/shaped to mate with the snowboard boot binding 612 as discussed below.

This embodiment is illustrated with two different engagement positions with two different heights (i.e., two longitudinally extending, substantially V-shaped grooves), respectively. Of course, it will be apparent to those skilled in the art from this disclosure that the snowboard boot 614 can be designed to have additional engagement or locking positions at different heights, if needed and/or desired. Thus, it should be appreciated from this disclosure that the present invention is not limited to the precise construction of the rear catches 628*a* and 628*b*. Rather, the rear catches 628*a* and 628*b* can be implemented in a number of ways, and the present invention is not limited to the particular implementations shown in the drawings, which are provided merely for purposes of illustration.

Figure 46:
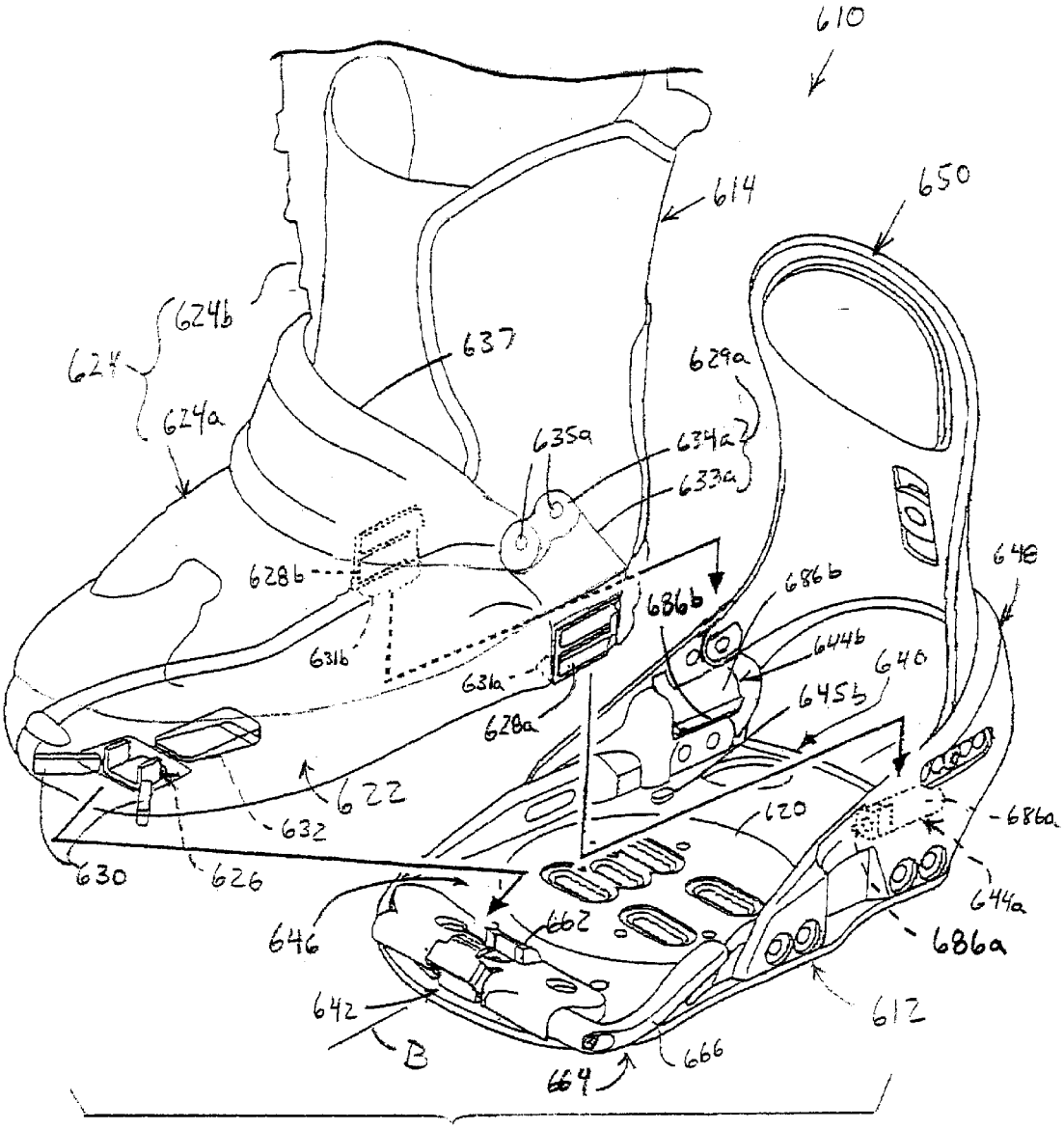
FIG. 46 is a top perspective view of a snowboard binding system having a snowboard binding adapted to be fixed to a snowboard and a snowboard boot in accordance with a sixth embodiment of the present invention, with arrows illustrating the step-in movements of the front and rear catches.
Figure 58:
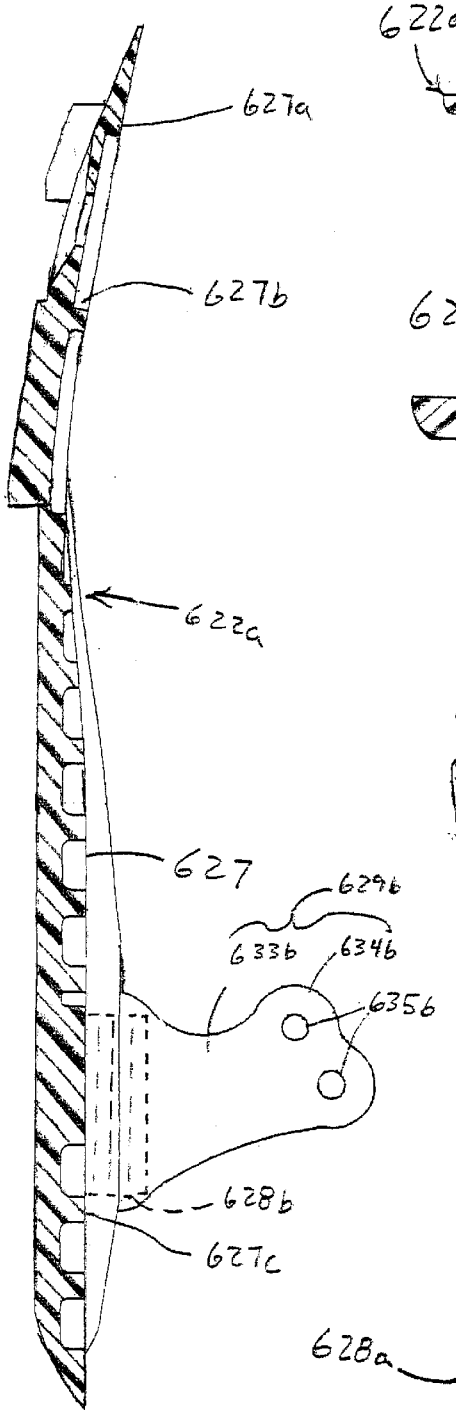
FIG. 58 is a cross-sectional view of the mid sole illustrated in FIGS. 56 and 57, as seen along section line 58—58 of FIG. 56.
Figure 59:
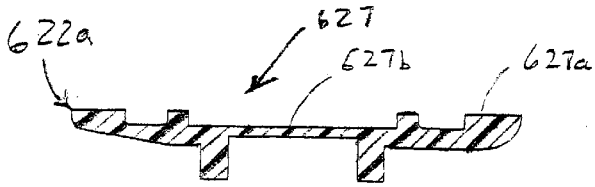
FIG. 59 is a cross-sectional view of the mid sole illustrated in FIGS. 56–58, as seen along section line 59—59 of FIG. 56.
Figure 60:
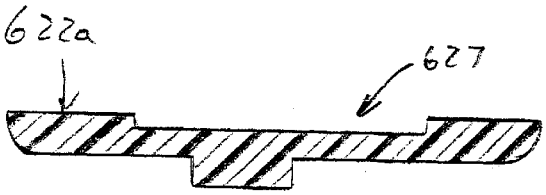
FIG. 60 is a cross-sectional view of the mid sole illustrated in FIGS. 56–59, as seen along section line 60—60 of FIG. 56.
Figure 61:
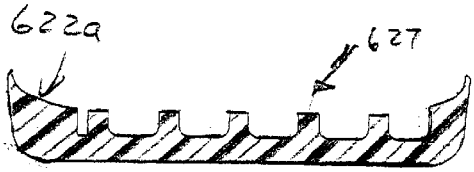
FIG. 61 is a cross-sectional view of the mid sole illustrated in FIGS. 56–60, as seen along section line 61—61 of FIG. 56.
Figure 62:
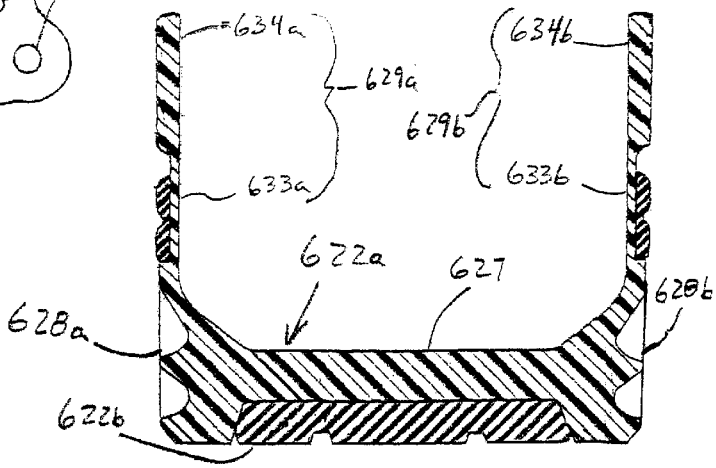
FIG. 62 is a cross-sectional view of the mid sole illustrated in FIGS. 56–61, as seen along section line 62—62 of FIG. 56, with an outer sole coupled thereto for the purpose of illustration.

As seen in FIGS. 58 and 62, the first and second strap attachment members 629*a* and 629*b* include first and second flexible connecting portions 633*a* and 633*b* and first and second attachment portions 634*a* and 634*b* located at free ends of the first and second flexible connecting portions 633*a* and 633*b*, respectively. Each of the first and second attachment portions 634*a* and 634*b* has a plurality (two) of attachment holes 635*a* and 635*b*, respectively. As seen in FIG. 46, a rear boot strap 637 is connected between the first and second attachment portions 634*a* and 634*b* of the first and second strap attachment members 629*a* and 629*b*. The rear boot strap 637 extends across the front ankle section of the upper portion 624 of the snowboard boot 614. Preferably, the rear boot strap 637 is constructed of two boot strap sections that are coupled together by a buckle for adjusting the longitudinal length of the rear boot strap 637 between the first and second attachment portions 634*a* and 634*b*. More specifically, the rear boot strap 637 is identical to the boot strap 537 discussed above.

The outer sole 622*b* is molded around the peripheral edge of the base portion 627 of the mid sole 622*a* and extends upwardly from the peripheral edge of the base portion 627 to be fixedly coupled to the foot section 624*a* of the upper portion 624. Moreover, the outer sole 622*b* is molded to surround the first and second rear catches 628*a* and 628*b* and to overlie a portion of the first and second flexible connecting portions 633*a* and 633*b* of the first and second strap attachment members 629*a* and 629*b*. Also, as mentioned above, the outer sole 622*b* is molded around the mid sole 622*a* such that the guide areas 631*a* and 631*b* of the foot portion 627 of the mid sole 622*a* are exposed. Thus, the outer sole 622*b* provides additional support to the first and second rear catches 628*a* and 628*b* as well as additional support for the first and second strap attachment members 629*a* and 629*b*.

The front catch 626 is preferably either molded into the mid sole 622*a* or attached thereto via fasteners (not shown). Alternatively, the front catch 626 can merely rest within the front catch receiving recess 627*b* and be held in place by an inner sole or liner and the wearer's foot. The front catch 626 is configured to engage a portion of the snowboard binding 612, as discussed below in more detail.

Figure 54:
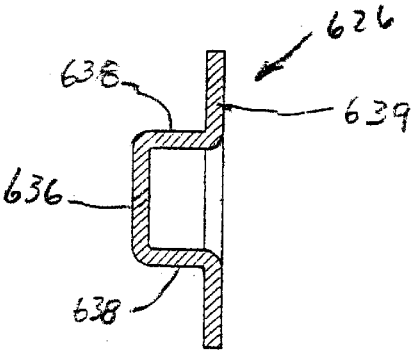
FIG. 54 is a cross-sectional view of the front catch illustrated in FIGS. 50–53, as seen along section line 54—54 of FIG. 50.
Figure 55:
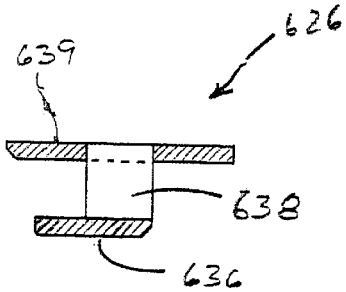
FIG. 55 is a cross-sectional view of the front catch illustrated in FIGS. 50–54, as seen along section line 55—55 of FIG. 50.
Figure 56:
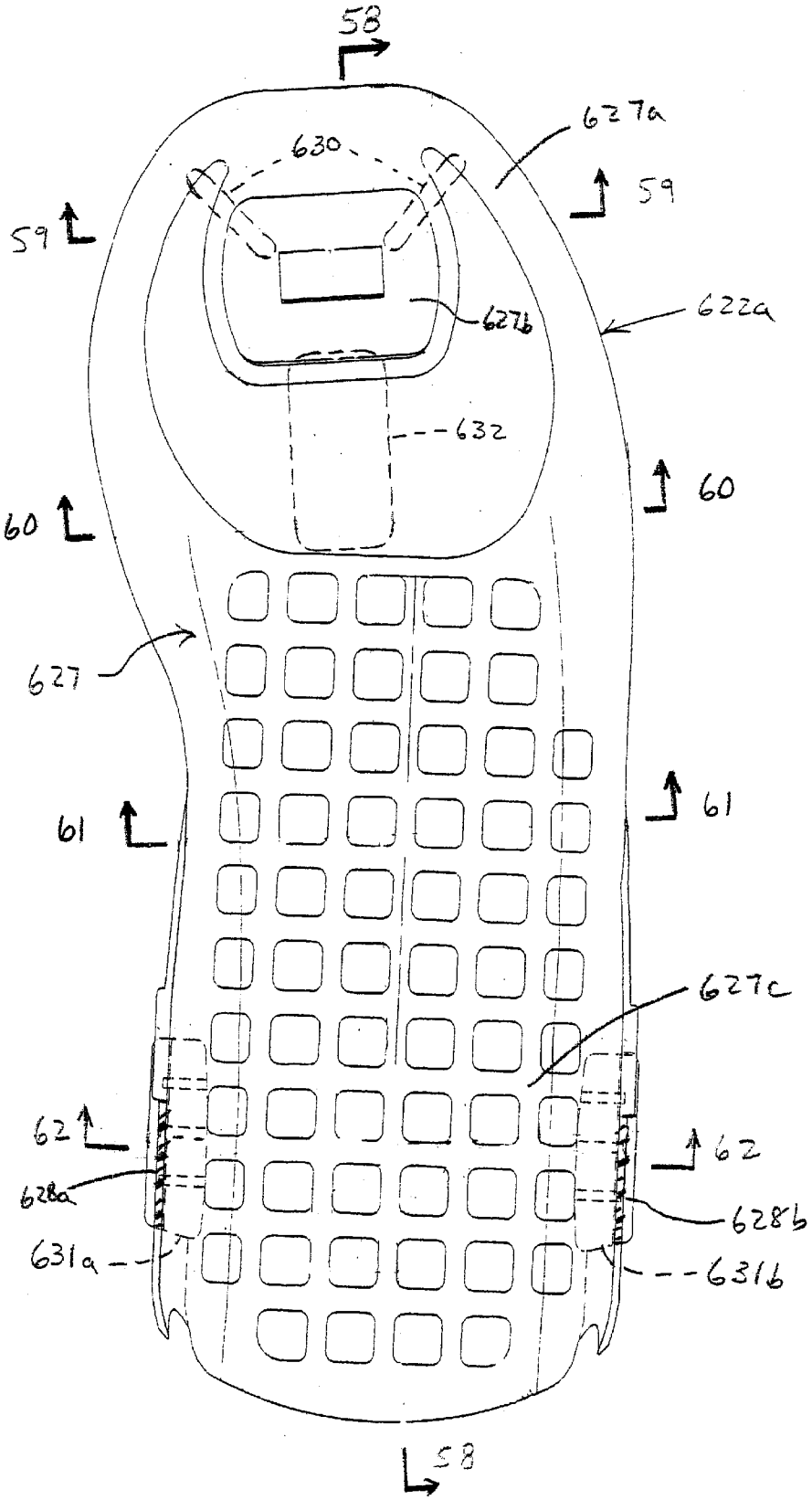
FIG. 56 is a top plan view of the mid sole (of the snowboard boot) of the snowboard binding system illustrated in FIGS. 46 and 47.
Figure 57:
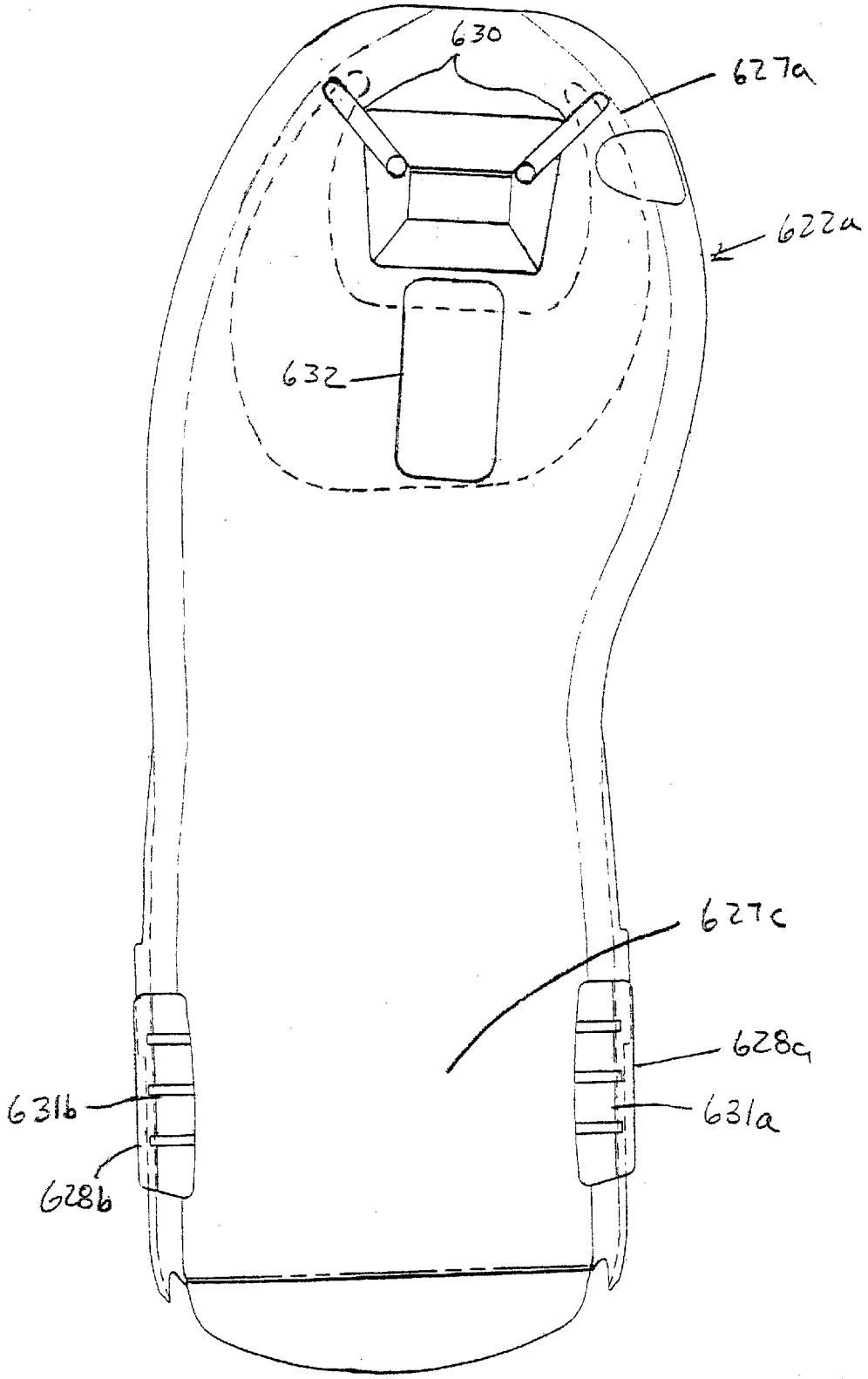
FIG. 57 is a bottom plan view of the mid sole illustrated in FIG. 56.

As seen in FIGS. 50–55, the front catch 626 is basically a U-shaped member with a tongue portion 636 and a pair of leg portions 638 extending upwardly from the tongue portion 636. The leg portions 638 are coupled together by a mounting plate 639. The mounting plate 639 rests on the upwardly facing surface of the front catch receiving recess 627*b*, while the tongue portion 636 and the leg portions 638 extend through the opening 627*d* formed in the front catch receiving recess 627*b*. Preferably, the front catch 626 is constructed of a one-piece, unitary member with the tongue portion 636 and the leg portions 638 having a rectangular cross section as best seen in FIGS. 54 and 56. In the most preferred embodiment, the front catch 626 is preferably constructed of a hard rigid material, such as steel or any other suitable material. It will be apparent to those skilled in the art from this disclosure that the front catch 626 can be implemented in any number of ways, and the present invention is not limited to the particular implementations shown in the drawings, which are provided for merely purposes of illustration. Of course, it will be apparent to those skilled in the art that the construction of the front catch 626 will depend upon the particular binding being utilized.

Figure 52:
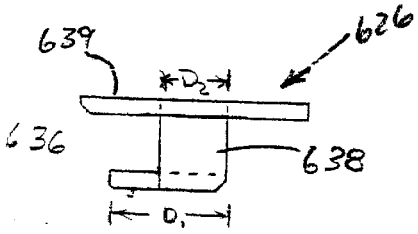
FIG. 52 is a side elevational view of the front catch illustrated in FIGS. 50 and 51.
Figure 53:
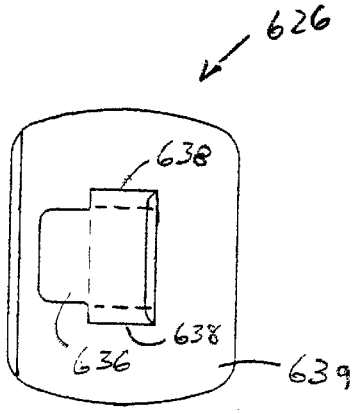
FIG. 53 is a bottom plan view of the front catch illustrated in FIGS. 50–52.

As seen in FIG. 52, the tongue portion 636 has a forward to rearward dimension $D_1$ that is larger than the forward to rearward dimensions $D_2$ of the leg portions 638. By having an elongated tongue portion 636, the front catch 626 can be more easily engaged with the snowboard boot binding 612 as discussed below. Preferably, the tongue portion 636 and the pair of leg portions 638 have generally rectangular cross sections as seen along a section line that is parallel to the longitudinal axis B. The tongue portion 636 not only secures the front portion of the snowboard boot 614 to the snowboard boot binding 612, but also engages the snowboard boot binding 612 to prevent forward and/or rearward movement as explained below.

Referring again to FIGS. 46–49, the snowboard binding 612 preferably has a base member 640, a front binding member 642 and a pair of (first and second) rear binding members 644*a* and 644*b*. The front binding member 642 is movably coupled to the base member 640 between a release position and a latched position. The first and second rear binding members 644*a* and 644*b* form a rear binding arrangement. The first and second rear binding members 644*a* and 644*b* are coupled to opposite lateral sides of the base member 640 as discussed in more detail below.

The base member 640 basically includes a base plate 646 adjustably coupled to the snowboard 16 via the adjustment disk 620, a heel cup 648 adjustably coupled to the base plate 646 and a highback 650 adjustably coupled to the heel cup 648. The snowboard binding 612 is preferably adjustably coupled to the snowboard 16 via the adjustment disk 620. The rear binding members 644*a* and 644*b* are movable relative to the base member 640 to selectively hold the snowboard boot 614 thereto. The rear binding members 644*a* and 644*b* are arranged to move laterally apart relative to each other from the initial rest positions to the guide positions upon application of a force in a direction substantially towards the base member 640. The rear binding members 644*a* and 644*b* are also arranged to move laterally toward each other or together to one of the locked or latched positions upon removal of the force. Thus, the rear binding members 644*a* and 644*b* are arranged to selectively hold the snowboard boot 614 in a plurality of engagement or locked or latched positions having different heights above the base member 640.

The rear binding members 644*a* and 644*b* operate in the same manner as the prior embodiments. Also, the parts of the rear binding member 644*a* and 644*b* are functionally identical to the prior embodiments. In other words, the rear binding members 644*a* and 644*b* are designed to cooperate with the rear catches 628*a* and 628*b*, respectively, in a manner identical to the first embodiment. More specifically, the rear binding member 644*a* includes a tooth portion 686*a* identical to the tooth portion 86*a* of the first embodiment. Thus, the rear binding member 644*a* includes a latching surface (not shown) identical to the latching surface 87*a* of the first embodiment. Likewise, the rear binding member 644*b* includes a tooth portion 686*b* identical to the tooth portion 86*b* of the first embodiment. Thus, the rear binding member 644*b* includes a latching surface (not shown) identical to the latching surface 87*b* of the first embodiment. In other words, portions of the rear binding members 644*a* and 644*b* have been slightly modified to be used with the heel cup 648, as discussed below.

The base plate 646 is also provided with a guide feature to aid in the disengagement of the snowboard boot 614 from the snowboard boot binding 612. Specifically, a pair of guide protrusions or members 645*a* and 645*b* are provide at the lateral edges of the base plate 646 adjacent the first and second rear binding members 644*a* and 644*b*, respectively. The first and second guide protrusions 645*a* and 645*b* have first and second boot support surfaces at their free ends. In other words, the upper surfaces of the guide protrusions 645*a* and 645*b* form an upper boot support surface that holds the sole portion 622 of the snowboard boot 614 above the base plate 646. The guide protrusions 645*a* and 645*b* are located so as to contact the forward ends of the guide areas 631*a* and 631*b* of the mid sole 622*a*, when the snowboard boot 614 is in the engaged position relative to the snowboard boot binding 612. In other words, when the snowboard boot 614 is in the normal riding position relative to the snowboard boot binding 612, the guide areas 631*a* and 631*b* rest on top of the boot support surfaces of the guide protrusions 645*a* and 645*b* of the base plate 646. When the snowboard boot 614 is moved forwardly relative to snowboard boot binding 612 (i.e., during disengagement), the guide areas 631*a* and 631*b* slide along the boot support surfaces of the guide protrusions 645*a* and 645*b*, respectively. As mentioned above, since the mid sole 622*a* is constructed of a material having a relatively low coefficient of friction, the snowboard boot 614 can be easily slid forwardly along the base plate 646. In the preferred embodiment, the guide protrusions 645*a* and 645*b* are integrally formed with the base member 646 as a one-piece, unitary member. For example, the guide protrustions 645*a* and 645*b* can be stamped into the base plate 646. In the preferred embodiments, the boot support surfaces of the guide protrusions 645*a* and 645*b* are elongated surfaces having widths arranged perpendicular to the longitudinal axis B lengths arranged parallel to the longitudinal axis B. Moreover, the guide protrusions 645*a* and 645*b* are preferably substantially identical in shape (an oblong shape in top plan view). Since the guide protrusions 645*a* and 645*b* normally contact the guide areas 631*a* and 631 b, the guide protrusions 645*a* and 645*b* are most preferably located substantially beneath the forward end of the rear binding members 644*a* and 644*b*.

Figure 63:
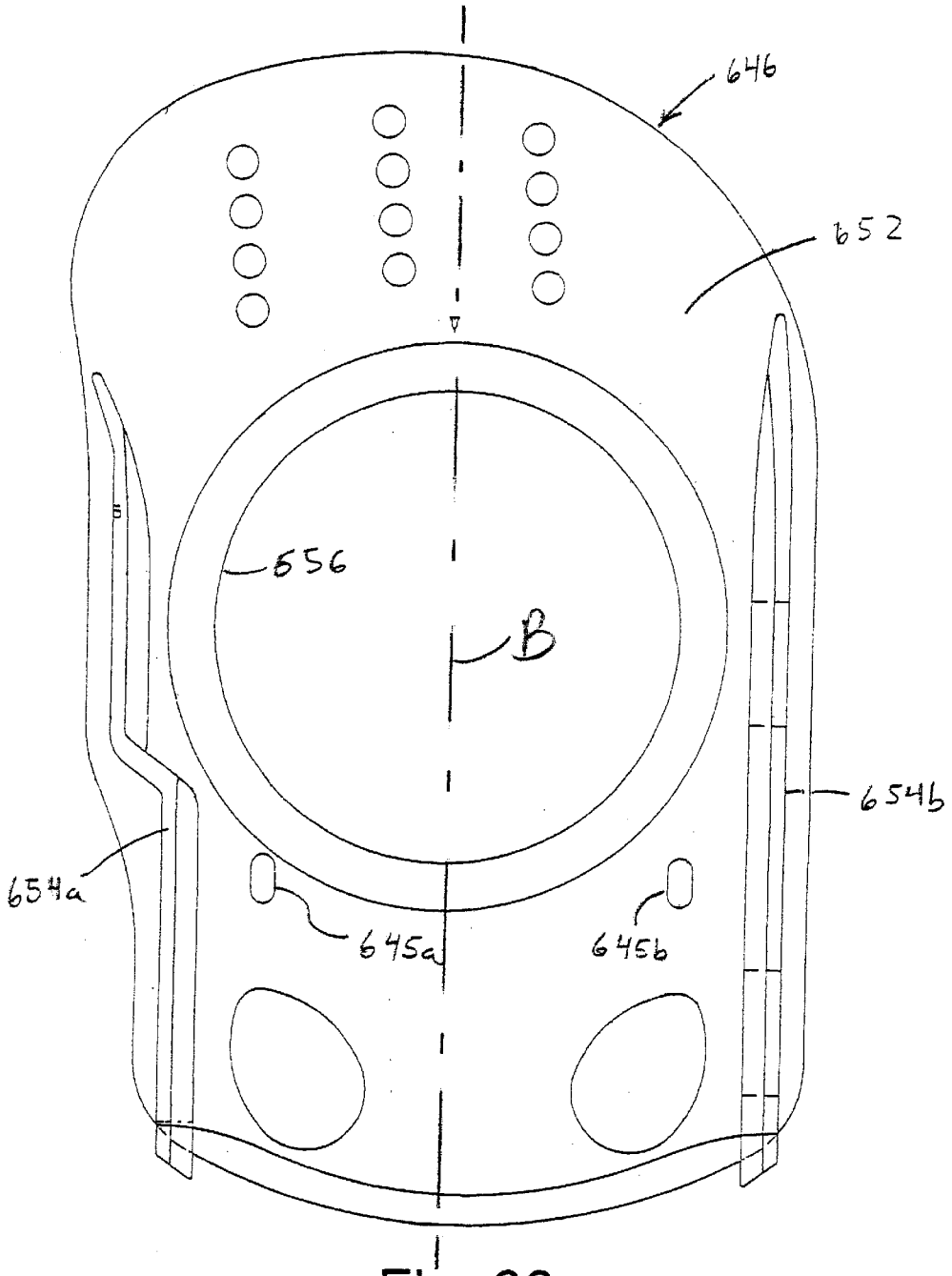
FIG. 63 is a top plan view of the base member (of the snowboard binding) of the snowboard binding system illustrated in FIGS. 46 and 47.
Figure 64:
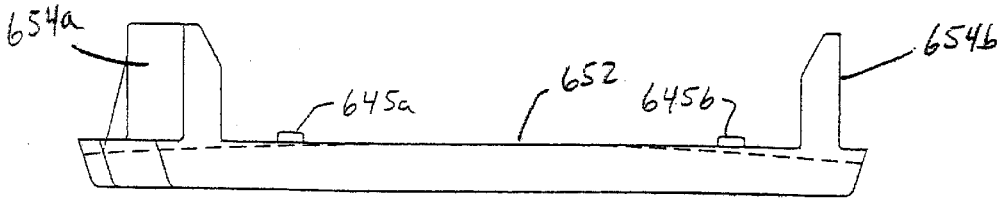
FIG. 64 is a rear elevational view of the base member illustrated in FIG. 63.
Figure 65:
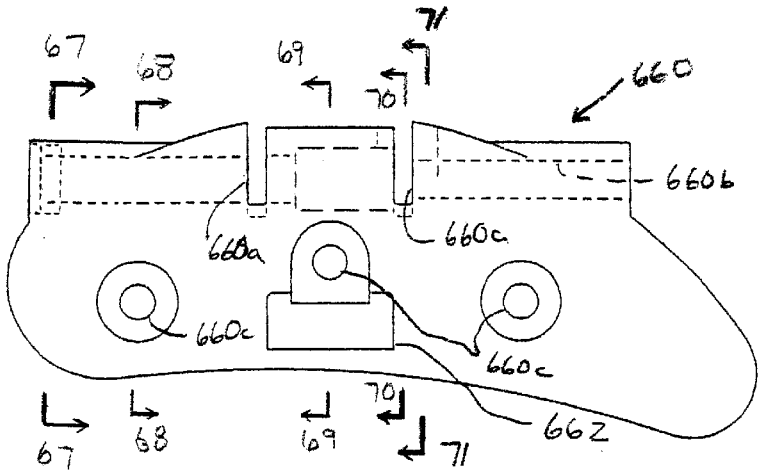
FIG. 65 is a top plan view of the front binding plate (of the front binding arrangement of the snowboard binding) of the snowboard binding system illustrated in FIGS. 46 and 47.
Figure 66:
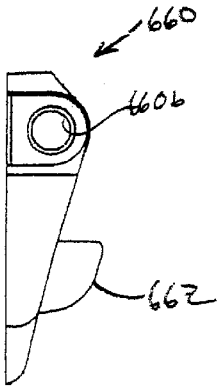
FIG. 66 is a first side elevational view of the front binding plate illustrated in FIG. 65.
Figure 67:
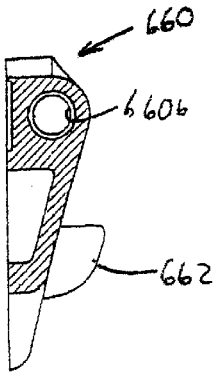
FIG. 67 is a cross-sectional view of the front binding plate illustrated in FIGS. 65 and 66, as seen along section line 67—67 of FIG. 65.
Figure 68:
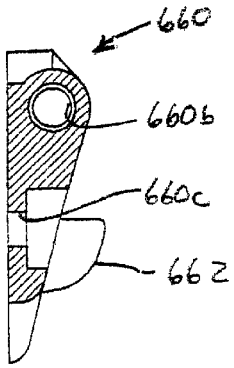
FIG. 68 is a cross-sectional view of the front binding plate illustrated in FIGS. 65–67, as seen along section line 68—68 of FIG. 65.
Figure 69:
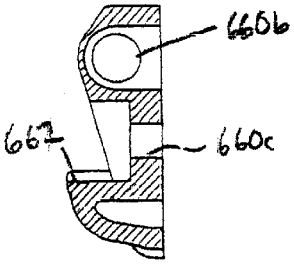
FIG. 69 is a cross-sectional view of the front binding plate illustrated in FIGS. 65–68, as seen along section line 69—69 of FIG. 65.
Figure 70:
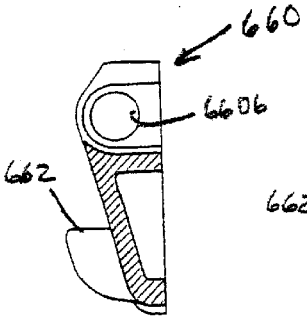
FIG. 70 is a cross-sectional view of the front binding plate illustrated in FIGS. 65–69, as seen along section line 70—70 of FIG. 65.
Figure 71:
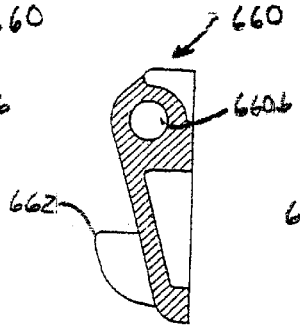
FIG. 71 is a cross-sectional view of the front binding plate illustrated in FIGS. 65–70, as seen along section line 71—71 of FIG. 65.
Figure 72:
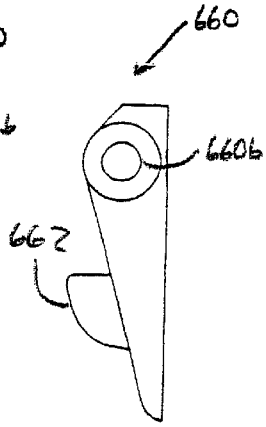
FIG. 72 is a second (opposite) side elevational view of the front binding plate illustrated in FIGS. 65–71.
Figure 73:
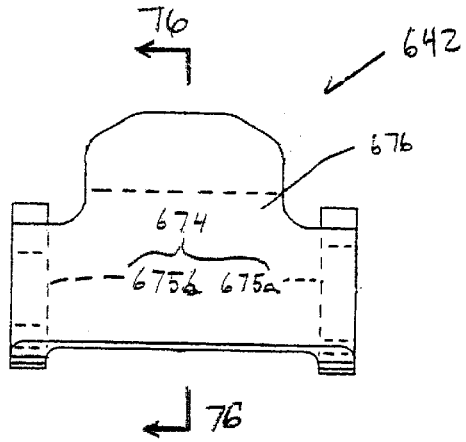
FIG. 73 is a top plan view of the front claw (of the front binding arrangement of the snowboard binding) of the snowboard binding system illustrated in FIGS. 46 and 47.

As seen in FIGS. 63 and 64, the base plate 646 of the base member 640 preferably has a mounting portion 652 and a pair of (first and second) side attachment sections 654*a* and 654*b*. Preferably, the base plate 646 is constructed of a hard, rigid material. Examples of suitable hard rigid materials for the base plate 646 include various metals as well as carbon and/or a metal/carbon combination. In the preferred embodiment, the mounting portion 652 and the side attachment sections 654*a* and 654*b* are formed by bending a metal sheet material. Thus, the base plate 646 (the mounting portion 652 and the side attachment sections 654*a* and 654*b*) is a one-piece, unitary member. Of course, the side attachment sections 654*a* and 654*b* can be constructed as a one-piece, unitary member that is attached to 646 (the mounting portion 652, if needed and/or desired. The side attachment sections 654*a* and 654*b* are preferably substantially parallel to each other and perpendicular to the mounting portion 652. Alternatively, the side attachment sections 654*a* and 654*b* can taper slightly outwardly from (i.e. away from) each other from the rear portion of the snowboard binding 612 toward the front portion of the snowboard binding 612, as discussed below in reference to another embodiment of the present invention. The mounting portion 652 has a central opening 656 for receiving the adjustment disk 620 therein. Preferably, the opening 656 has a beveled edge that is serrated to form teeth for engaging a corresponding bevel edge with mating teeth of the adjustment disk 620.

Figure 47:
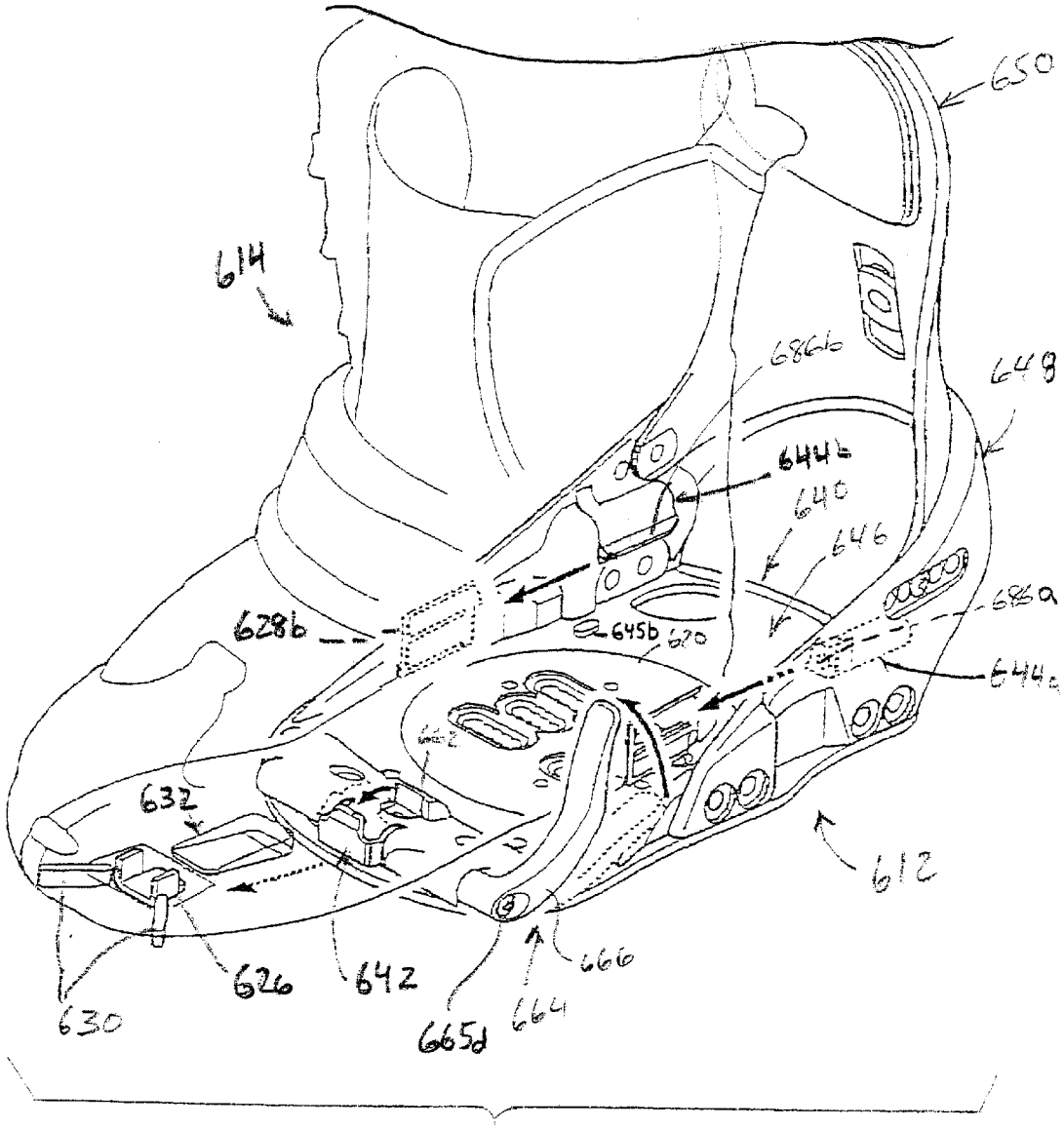
FIG. 47 is a top perspective view of the snowboard binding system illustrated in FIG. 46, with arrows illustrating the step-out movements of the front and rear catches and rotation of the front binding arrangement.
Figure 48:
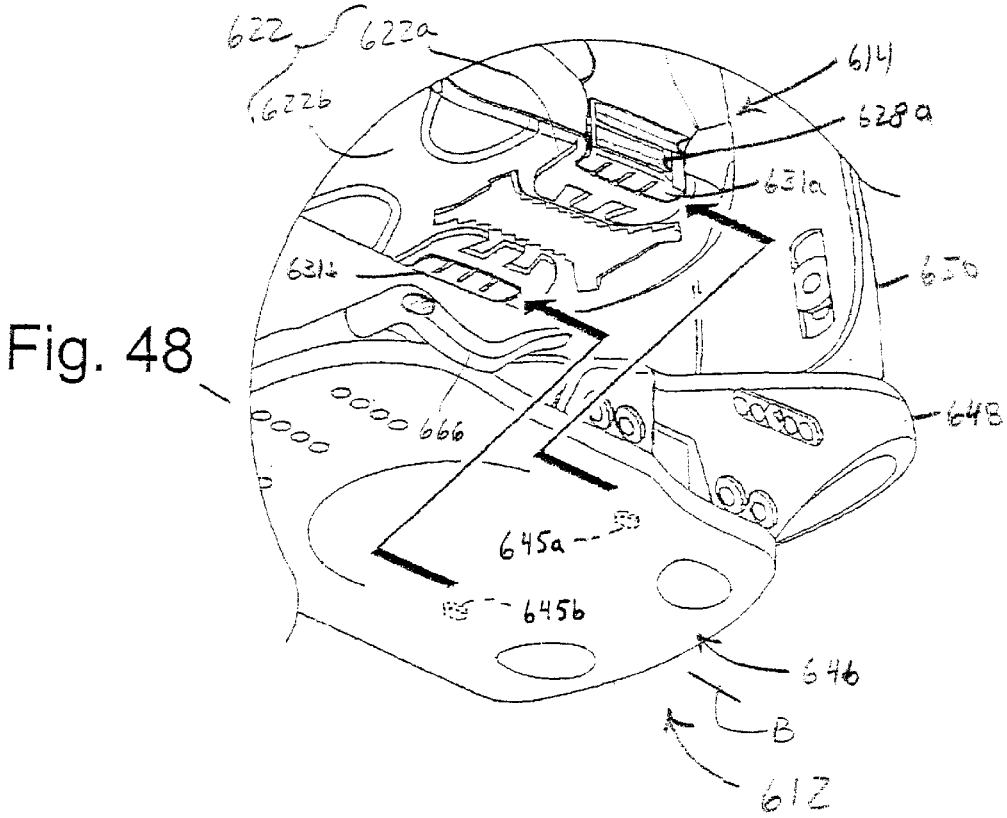
FIG. 48 is a partial, bottom perspective view of the snowboard binding system illustrated in FIGS. 46 and 47, with arrows illustrating the step-out sliding movement of the rear catch relative to a pair of rear guide members.
Figure 49:
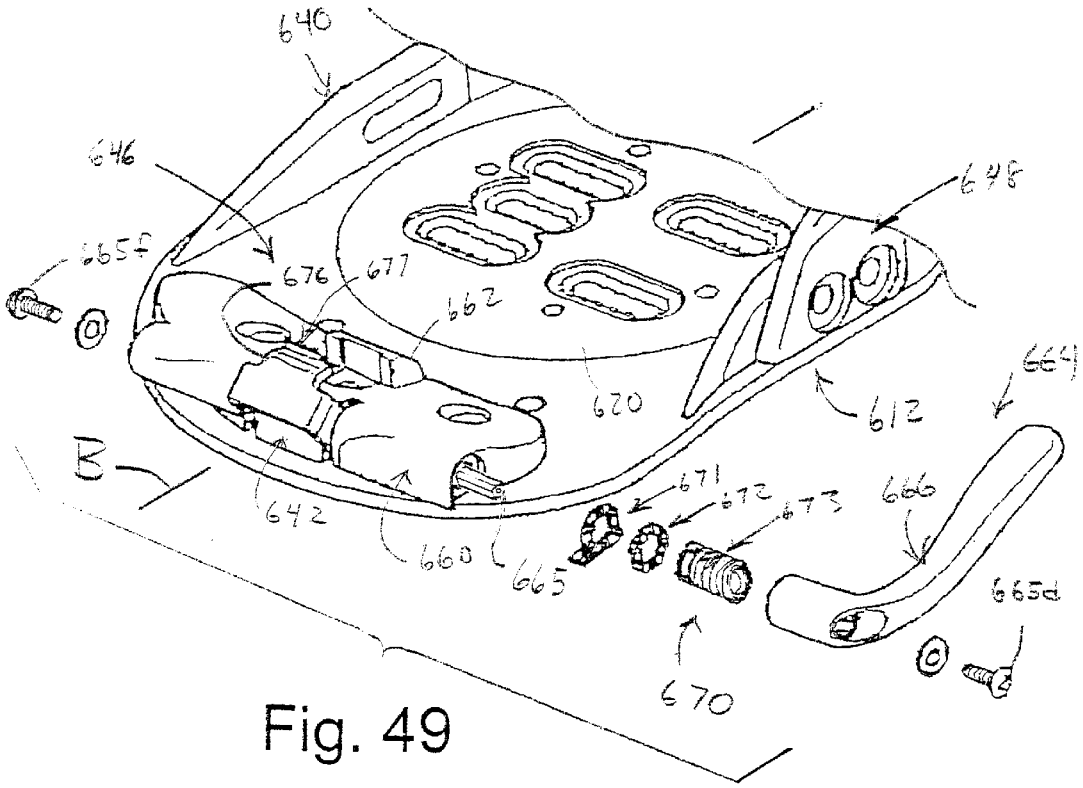
FIG. 49 is an enlarged, partially exploded top perspective view of the front binding arrangement of the snowboard binding system illustrated in FIGS. 46 and 47.
Figure 50:
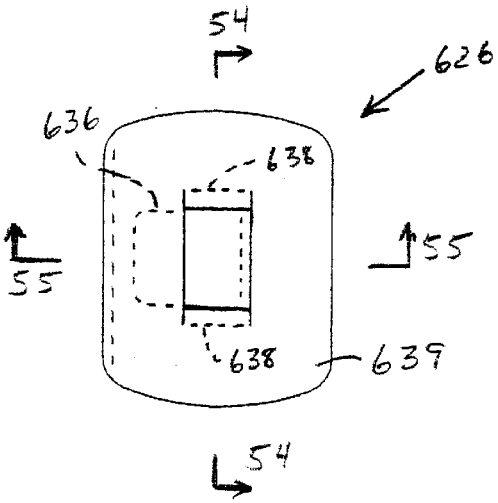
FIG. 50 is an enlarged, top plan view of the front catch (of the snowboard boot) of the snowboard binding system illustrated in FIGS. 46 and 47.
Figure 51:
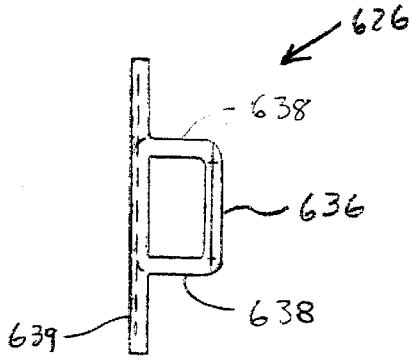
FIG. 51 is a front elevational view of the front catch illustrated in FIG. 50.

As seen in FIGS. 46, 47 and 49, the mounting portion 652 of the base plate 646 has a front binding plate 660 fixedly coupled thereto to form a front portion of the base plate 646. The front binding member 642 is movably coupled to the binding plate 660. Thus, when the binding plate 660 is fixedly coupled to the mounting portion 652, the front binding member 642 is movably coupled to the base plate 646 of the base member 640. The base member 640 has a longitudinal center axis B extending between the front portion of the base member 640 (i.e., the binding plate 660) and the rear portion of the base member 640 (i.e., the heel cup 648 and the highback 650). The front binding member 642 is preferably pivotally coupled to the binding plate 660 via a front release lever 664 which functions as a front pivot pin for the front binding member 642.

The binding plate 660 includes a front guide member or ramp 662 extending upwardly relative to the upper surface of the front portion of the base plate 646. The front guide member 662 is located immediately rearwardly of the front binding member 642. The front guide member 662 is designed to engage the front guide element 632 of the snowboard boot 614 during disengagement of the snowboard boot 614 from the snowboard binding 612. In other words, forward movement of the snowboard boot 614 causes the front guide element 632 of the sole portion 622 to engage the front guide member 662 of the snowboard binding 612. Thus, the front guide member 662 cooperates with the front guide element 632 to move the snowboard boot 614 upwardly such that the front catch 626 moves out of engagement with the front binding member 642.

Figure 79:
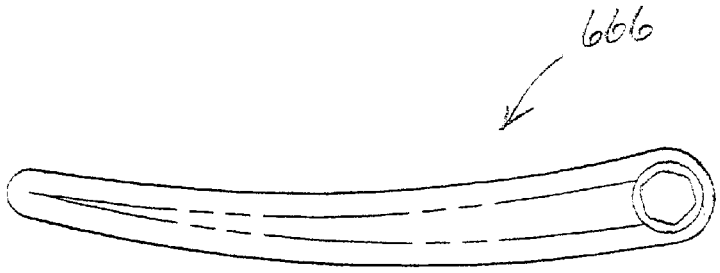
FIG. 79 is an outside elevational view of the release lever (of the front binding arrangement and indexing mechanism of the snowboard binding) of the snowboard binding system illustrated in FIGS. 46 and 47.
Figure 80:
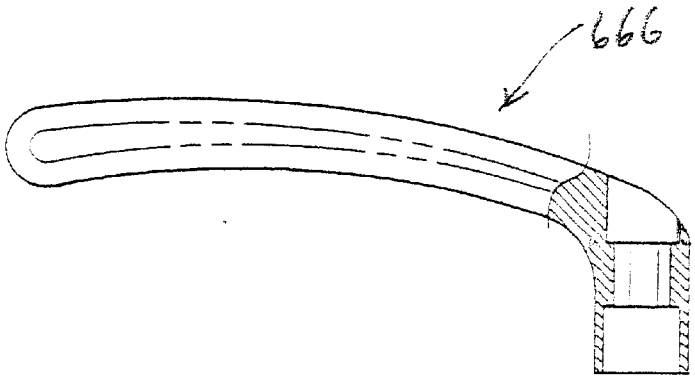
FIG. 80 is a top plan view of the release lever illustrated in FIG. 79, with portions illustrated in cross-section for the purpose of illustration.
Figure 81:
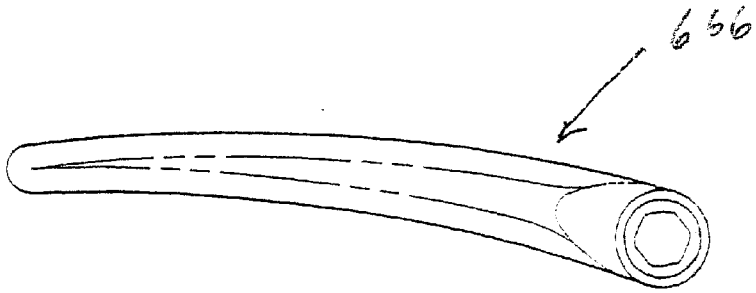
FIG. 81 is an inside elevational view of the release lever illustrated in FIGS. 79 and 80.
Figure 82:
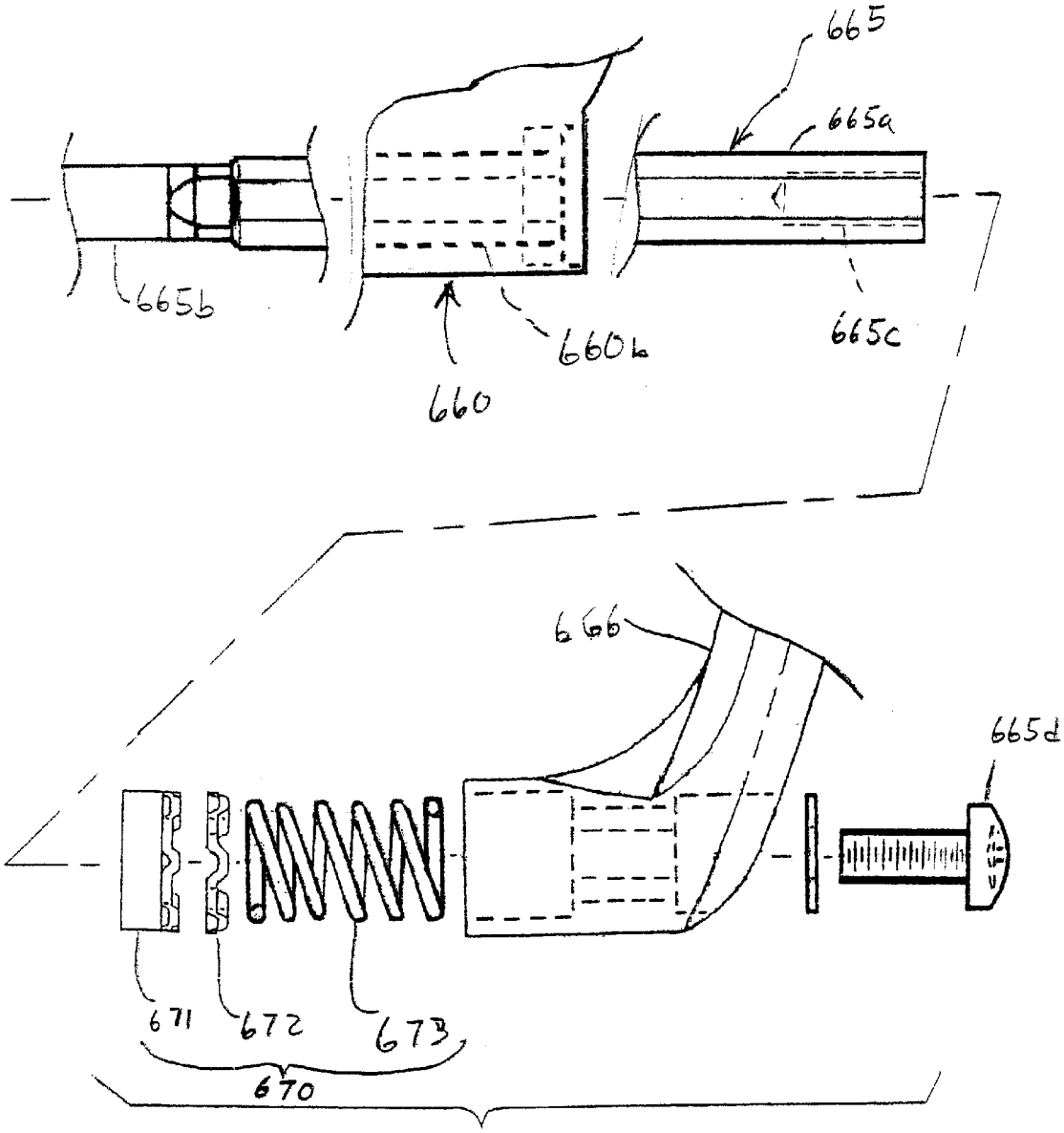
FIG. 82 is an enlarged, partial exploded view of the indexing mechanism (of the front binding arrangement of the snowboard binding) of the snowboard binding system illustrated in FIGS. 46 and 47.

Referring now to FIGS. 49 and 79–92, the release lever 664 basically includes a pivot pin section 665 (FIG. 85) and a handle or control section 666 (FIGS. 79–81). In other words, a part of the release lever 664 (pivot pin section 665) forms the front pivot pin of the front binding member 642. Thus, the release lever 664 is formed of two pieces in this embodiment.

Figure 85:
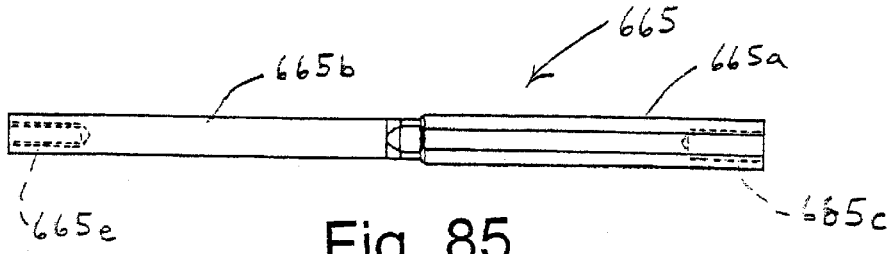
FIG. 85 is an elevational view of the shaft (of the front binding arrangement and indexing mechanism) of the snowboard binding illustrated in FIGS. 46, 47, 49 and 82–84.
Figure 86:
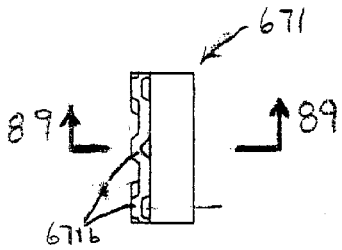
FIG. 86 is a top plan view of the first index part (of the front binding arrangement and indexing mechanism) of the snowboard binding illustrated in FIGS. 46, 47, 49 and 82–84.
Figure 87:
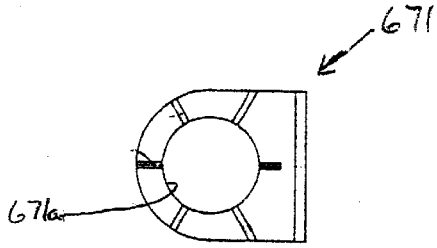
FIG. 87 is an inside elevational view of the first index part illustrated in FIG. 86.
Figure 88:
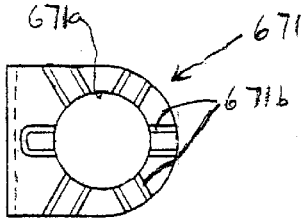
FIG. 88 is an outside elevational view of the first index part illustrated in FIGS. 86 and 87.
Figure 89:
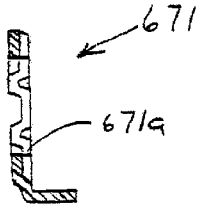
FIG. 89 is cross-sectional view of the first index part illustrated in FIGS. 86–88, as seen along section line 89—89 of FIG. 86.

As seen in FIG. 85, the pivot pin section 665 has a first noncircular part 665*a* with a hexagonal cross section and a second circular part 665*b* with a circular cross section. An intermediate part with a square cross section is located between the first and second parts 665*a* and 665*b*. The free end of the first noncircular part 665*a* has a threaded bore 665*c* for threadedly receiving bolt 665*d* therein. The free end of the circular part 665*b* also has a threaded bore 665*e* for threadedly receiving bolt 665*f* therein. The bolt 665*d* secures the handle section 666 to the pivot pin section 665. The bolt 665*f* pivotally secures the release lever 664 to the binding plate 660 such that the release lever 664 can move between a release position and a latched position.

In this embodiment, there is no return spring. Rather, in this embodiment, an indexing mechanism 670 is utilized to hold the release lever 664 in at least both the release position and the latch position. The index mechanism 670 basically includes a first index part or member 671, a second index part or member 672 and a compression spring or biasing member 673. The index mechanism 670 is mounted on the noncircular part 665*a* of the pivot section 665 of the release lever 664.

As seen in FIGS. 86–89, the first index part 671 is non-movable engaged with the mounting plate 660 and has a center opening 671*a* that allows the noncircular part 665*a* of the pivot section 665 to freely rotate therein. The first index part 671 has a plurality of radially formed protrusions 671*b* that form ratchet teeth for engaging the second index part 672.

Figure 90:
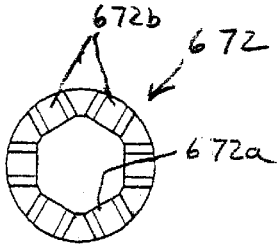
FIG. 90 is an outside elevational view of the second index part (of the front binding arrangement and indexing mechanism) of the snowboard binding illustrated in FIGS. 46, 47, 49 and 82–84.
Figure 91:
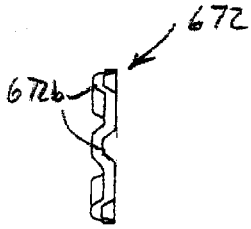
FIG. 91 is a top plan view of the second index part illustrated in FIG. 90.
Figure 92:
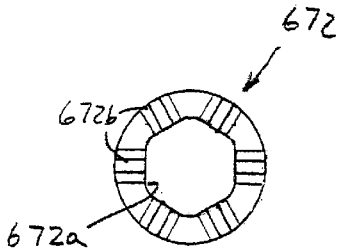
FIG. 92 is an inside elevational view of the second index part illustrated in FIGS. 90 and 91.
Figure 93:
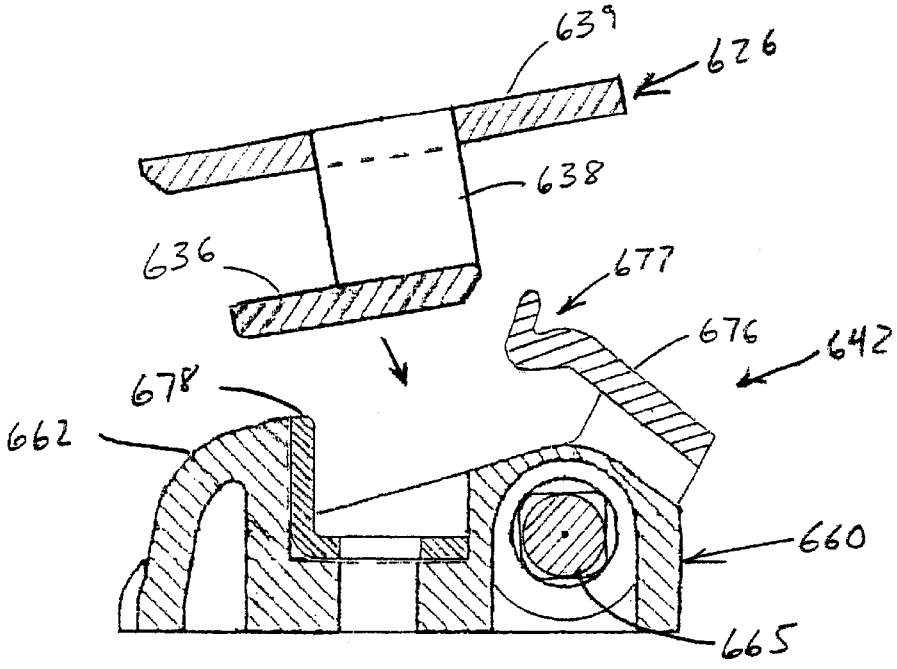
FIG. 93 is an enlarged, partial cross-sectional view of the front claw and front catch of the snowboard binding system illustrated in FIGS. 46 and 47, prior to engagement therebetween.
Figure 94:
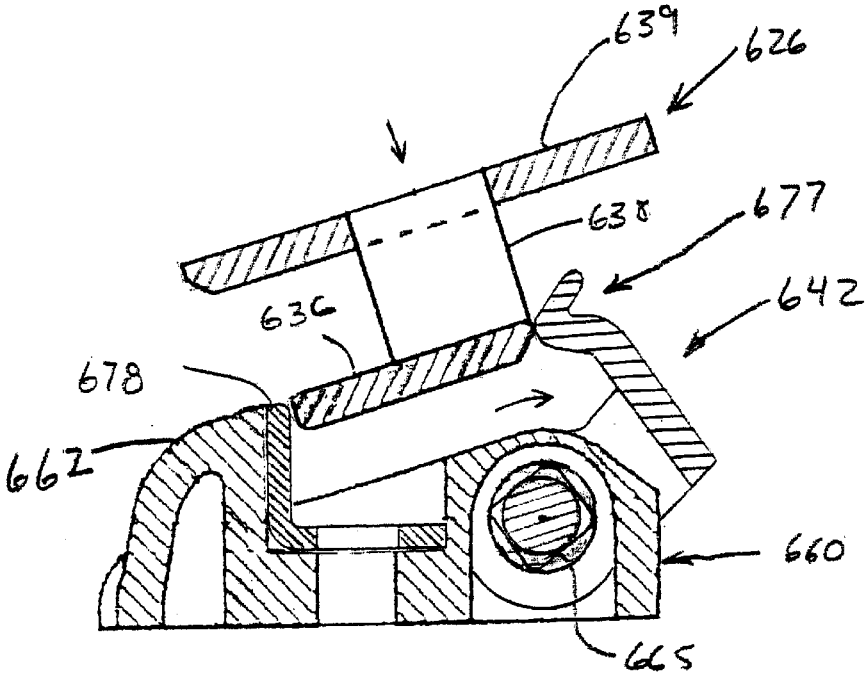
FIG. 94 is an enlarged, partial cross-sectional view of the front claw and front catch of the snowboard binding system illustrated in FIGS. 46 and 47, with the front claw and front catch in intermediate positions.

As seen in FIGS. 90–92, the second index part 672 is nonrotatably secured on the noncircular part 665*a* of the pivot section 665 of the release lever 664. Thus, the second index part 672 rotates with the release lever 664, while the first index part 671 remains stationary. The second index part 672 has a noncircular opening 672*a* that is sized to retain the second index part 672 on the noncircular part 665*a* of the pivot pin section 665. The second index part 672 has a plurality of radially extending projections 672*b* that form ratchet teeth. The projections or ratchet teeth 672*b* of the second index part 672 engage the protrusions or ratchet teeth 671*b* of the first index part so as to lock the release lever 664 in the release position and the latch position.

Figure 83:
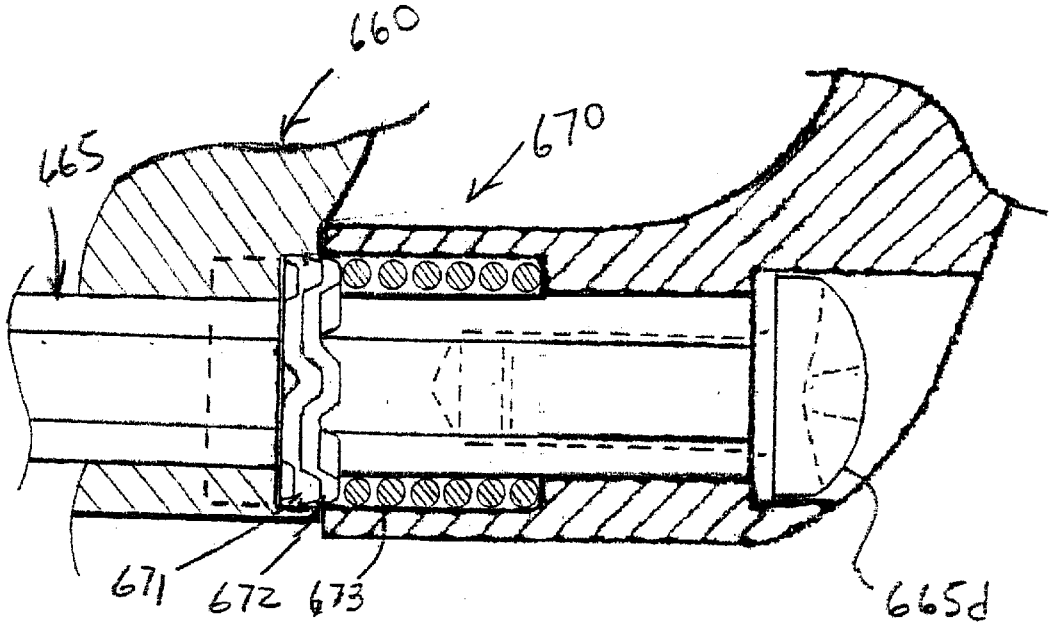
FIG. 83 is an enlarged, partial cross-sectional view of the indexing mechanism illustrated in FIG. 82, with the indexing mechanism assembled and ratchet teeth in a "meshed" (i.e. non-rotated and non-axially displaced) arrangement.
Figure 84:
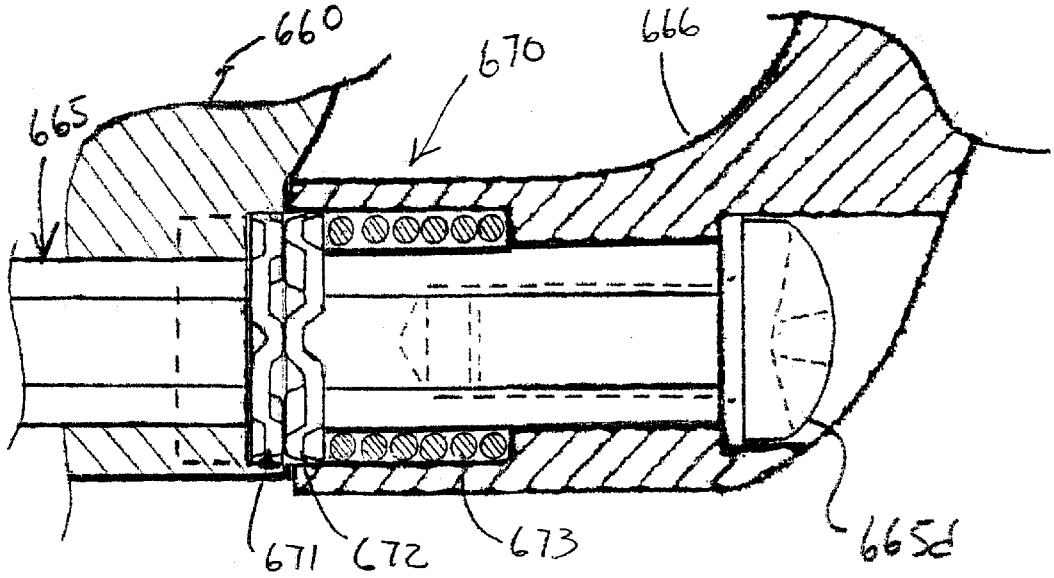
FIG. 84 is an enlarged, partial cross-sectional view of the indexing mechanism illustrated in FIG. 82, with the indexing mechanism assembled and ratchet teeth in a "non-meshed" (i.e. rotated and axially displaced) arrangement.

As seen in FIGS. 83 and 84, the compression spring 673 is positioned around the noncircular part 665*a* of the pivot section 665 for biasing the first and second index parts 671 and 672 together. More specifically, one end of the compression spring 673 engages the control section 666 of the release lever 664 while the other end of the compression spring 673 contacts the second index part 672. Thus, when the control section 666 of the release lever 664 is rotated between the release position and the latch position, the second index part 672 is moved axially against the force of the compression spring 673 to permit the movement of the control section 666 of the release lever 664.

Additionally, the binding plate 660 is preferably adjustable (along longitudinal axis B) relative to the mounting portion 652 of the base plate 646 in the same manner as the first embodiment. Thus, the front binding member 642 can be selectively coupled at different longitudinal positions relative to the base member 640. Of course, it will be apparent to those skilled in the art that various other structures could be utilized to adjust the longitudinal position of the front binding member 642. Moreover, it will be apparent to those skilled in the art that the binding plate 660 could be integrally formed with the base plate 646 if needed and/or desired.

As best seen in FIGS. 73–76, the front binding member 642 basically includes a mounting portion 674 with a binding flange or front claw 676 integrally formed therewith. The mounting portion 674 is non-rotatably mounted on the pivot pin section 665 of the release lever 664 for rotation between a latched position and a release position about a front pivot axis. The front pivot axis is arranged below the binding plate 660 such that front claw 676 can be moved out of engagement with the front catch member 626 (i.e. to the release position). The front claw 676 includes a lower surface configured to engage an upper surface of the tongue portion 636 of the front catch 626 of the snowboard boot 614. The connecting portion 678 extends between the front claw 676 and the mounting portion 674.

Figure 74:
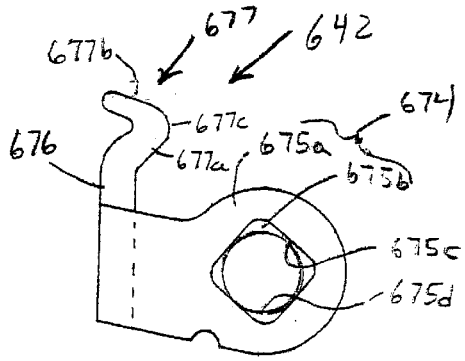
FIG. 74 is a side elevational view of the front claw illustrated in FIG. 73.
Figure 75:
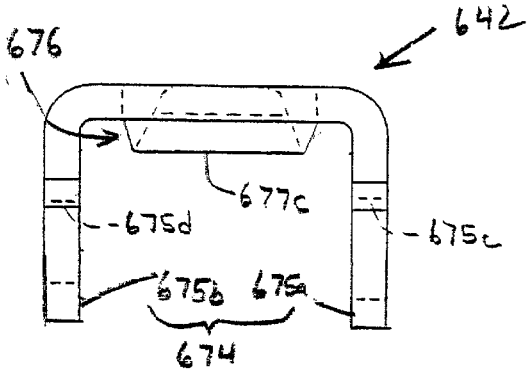
FIG. 75 is a front elevational view of the front claw illustrated in FIGS. 73 and 74.
Figure 76:
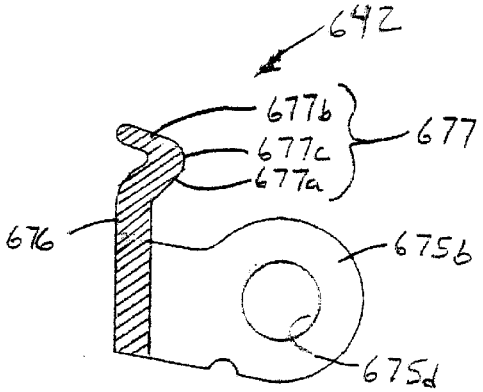
FIG. 76 is a cross-sectional view of the front claw illustrated in FIGS. 73–75, as seen along section line 76—76 of FIG. 73.
Figure 77:
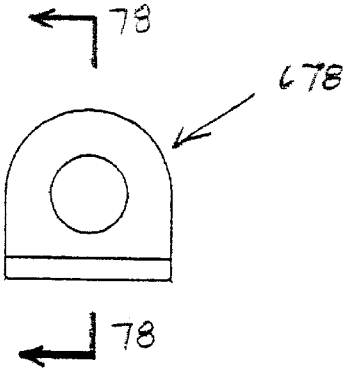
FIG. 77 is a top plan view of the front stop plate (of the front binding arrangement of the snowboard binding) of the snowboard binding system illustrated in FIGS. 46 and 47.
Figure 78:
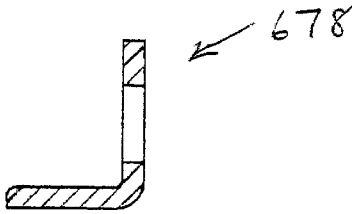
FIG. 78 is a cross-sectional view of the front stop plate illustrated in FIG. 77, as seen along section line 78—78 of FIG. 77.
Figure 95:
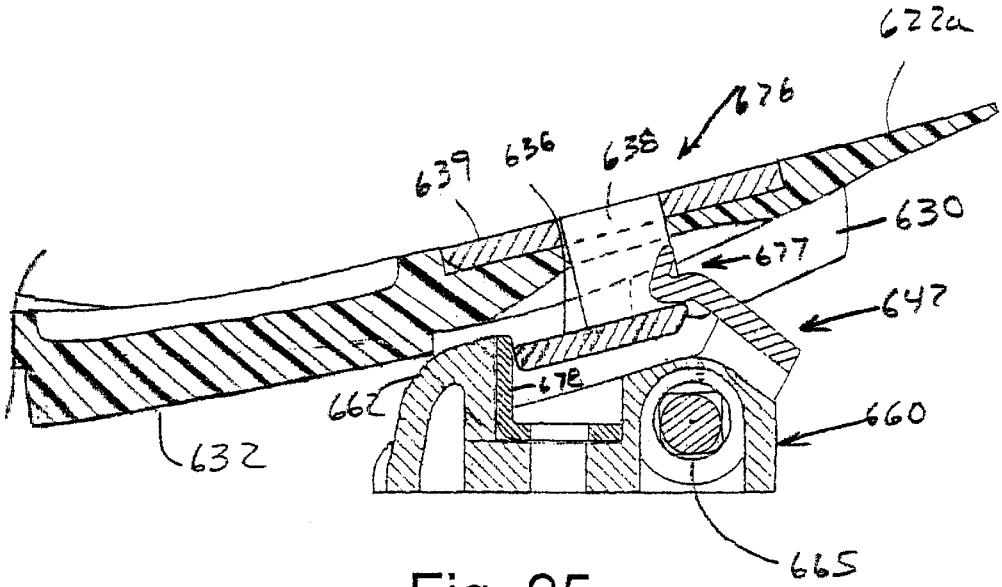
FIG. 95 is an enlarged, partial cross-sectional view of the front claw and front catch (coupled to the mid sole) of the snowboard binding system illustrated in FIGS. 46 and 47, with the front claw in a latched position engaging the front catch.
Figure 96:
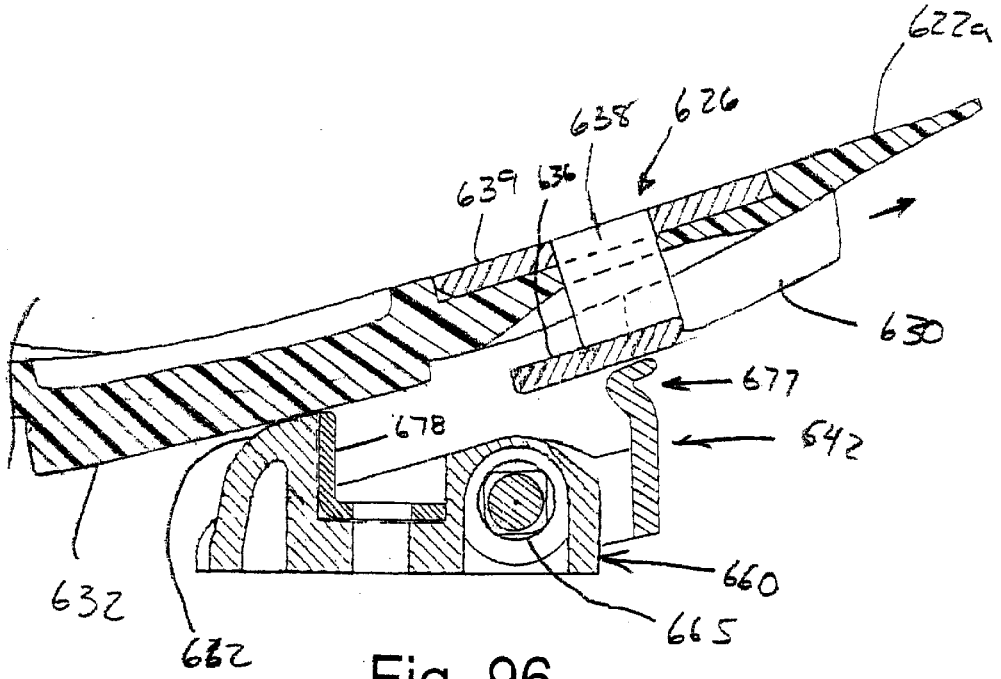
FIG. 96 is an enlarged, partial cross-sectional view of the front claw and front catch (coupled to the mid sole) of the snowboard binding system illustrated in FIGS. 46 and 47, with the front claw in a release position and the sole in an intermediate releasing position.
Figure 97:
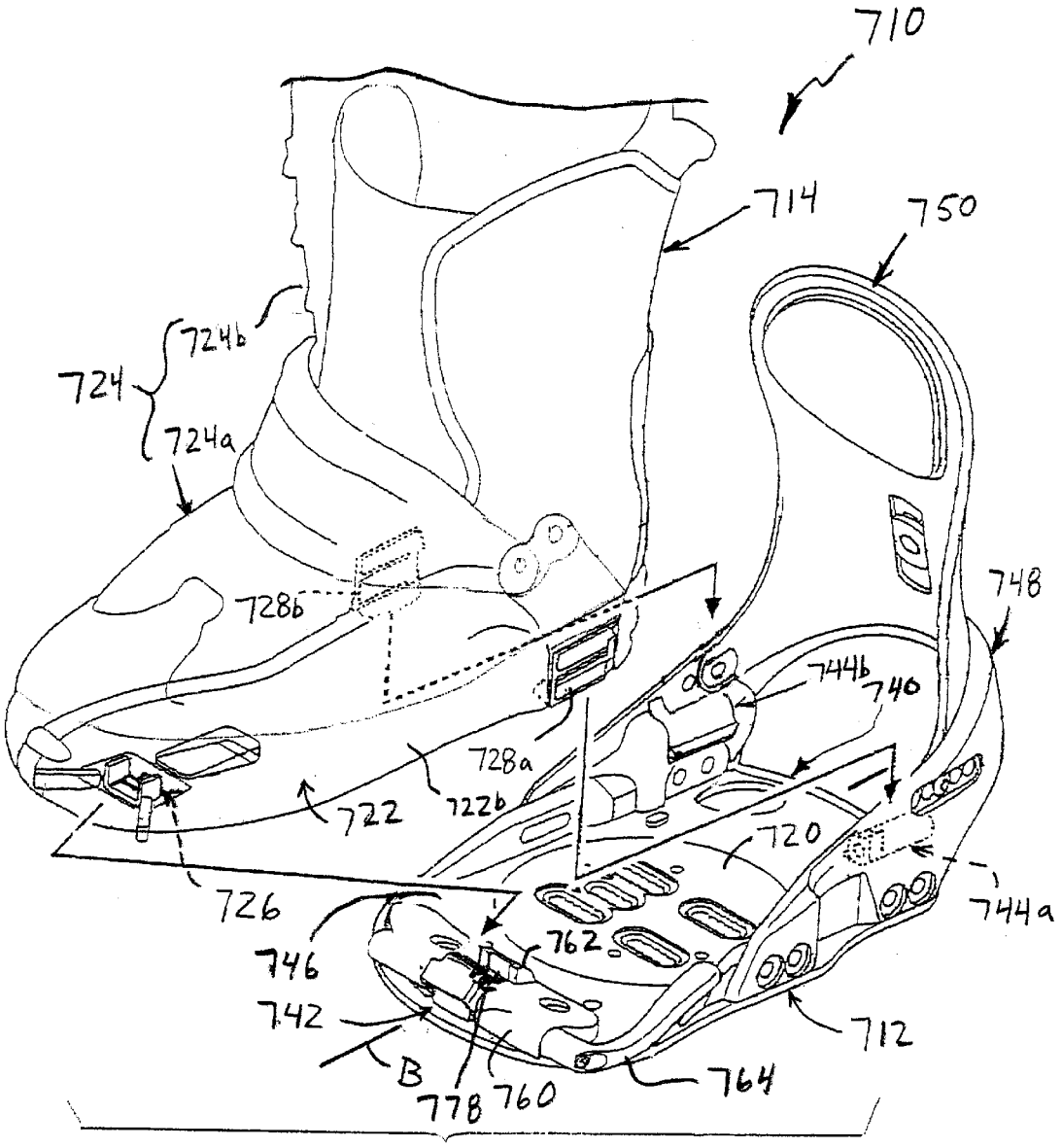
FIG. 97 is a top perspective view of a snowboard binding system having a snowboard binding adapted to be fixed to a snowboard and a snowboard boot in accordance with a seventh embodiment of the present invention, with arrows illustrating the step-in movements of the front and rear catches.
Figure 98:
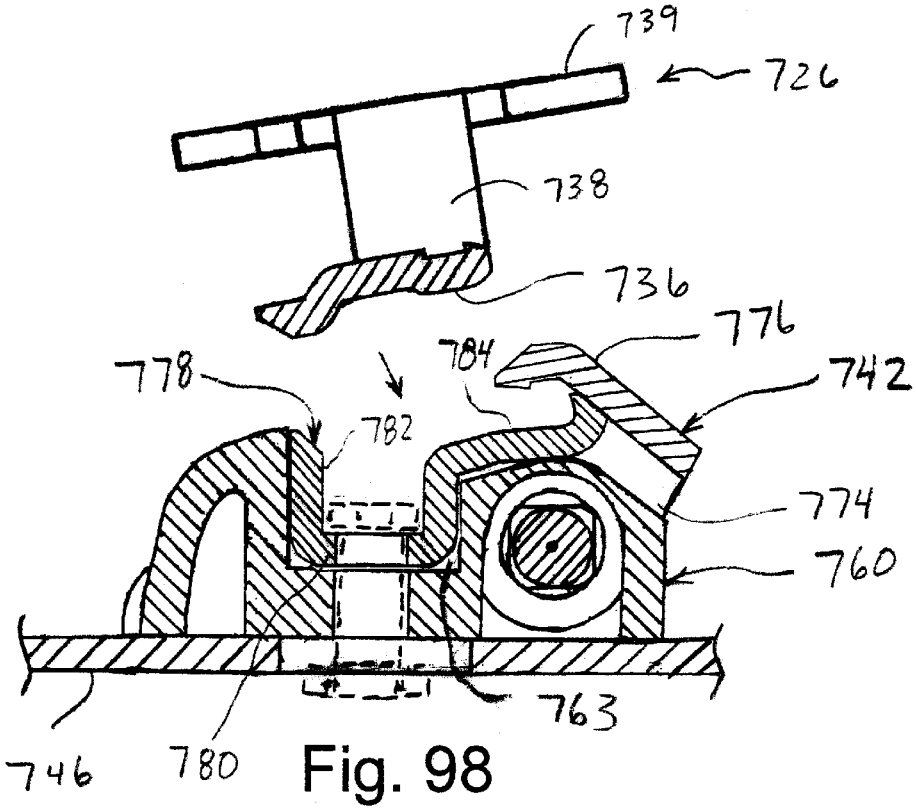
FIG. 98 is an enlarged, partial cross-sectional view of the front binding member (front claw), front stop member and front catch of the snowboard binding system illustrated in FIG. 97, prior to engagement therebetween.
Figure 99:
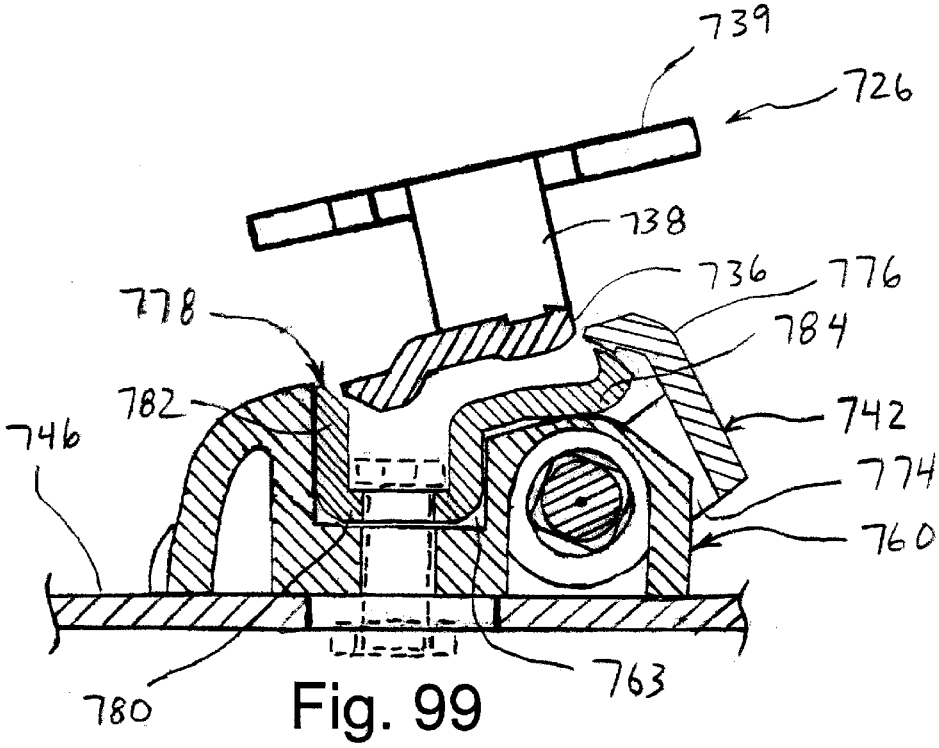
FIG. 99 is an enlarged, partial cross-sectional view of the front binding member (front claw), front stop member and front catch of the snowboard binding system illustrated in FIG. 97, with the front claw and front catch in intermediate positions.

As seen in FIGS. 74 and 76, the front claw 676 has a generally V-shaped free end 677 with first and second parts 677*a* and 677*b* extending from an apex 677*c*. The first part 677*a* of the V-shaped free end 677 forms a catch engaging surface located between the mounting portion 674 and the apex 677*c*. The second part 677*b* of the V-shaped free end 677 forms a guide surface located between the apex 677*c* and a free edge 677*d* of the V-shaped free end 677. The catch engaging surface of the first part 677*a* faces generally towards the base plate 646. The guide surface of the second part 677*b* faces generally away from the base plate 646. The V-shaped free end 677 is designed such that the guide surface of the second part 677*b* aids in the engagement of the front catch 626 with the front claw 676. In other words, the tongue portion 636 of the front catch 626 can easily slide along the guide surface of the second part 677*b* to allow for easy entry of the front catch 626 beneath the front claw 676. When the front catch 626 is located in the area beneath the front claw 676, the release lever 664 can be manually rotated to move the front claw 676 from a latch position as seen in FIG. 95 to a release position as seen in FIG. 96. In the latched position, the tongue portion 636 engages the forward facing surface of the stop plate 678 to prevent rearward movement of the front catch 626 relative to the front claw 676. The stop plate 678 is illustrated in FIGS. 77 and 78.

The mounting portion 674 is preferably formed of a pair (first and second) mounting flanges 675*a* and 675*b*. Additionally, the mounting flange 675*a* preferably includes a noncircular (square) opening 675*c* to nonrotatably receive the square part of the pivot pin section 665 of the release lever 664 while the mounting flange 675*b* has a circular opening 675*d* to receive the circular part 665*b*.

As best seen in FIGS. 65–72, the binding plate 660 includes a pair of openings or slots 660*a* formed therein, which are configured to partially receive the front claw 676. The slots 660*a* form a pair of stop surfaces located at the rearmost edges of the slots 660*a*. The front binding plate 660 also preferably includes a pivot bore 660*b* that pivotally supports the pivot pin section 665 with the handle or control section 666 extending substantially perpendicularly from the pivot pin section 665. The binding plate 660 also preferably has three mounting holes 660*c* for receiving fasteners that secure the front binding plate 660 to the base plate 646. The stop plate 678 is mounted on the center fastener adjacent to the front guide element 662.

As best seen in FIGS. 46 and 47, the first and second rear binding members 644*a* and 644*b* are preferably movably coupled to the heel cup 648 of the base member 640. The heel cup 648 is adjustably coupled to the attachment sections 654*a* and 654*b* of the base plate 646 to form first and second side attachment portions. Thus, the rear binding members 644*a* and 644*b* are movably coupled to the base plate 646. Thus, the rear binding members 644*a* and 644*b* are adjustably and movably coupled to the base member 640.

The rear binding members 644*a* and 644*b* are preferably substantially mirror images of each other. The rear binding member 644*a* basically includes the first tooth portion 686*a* extending from a first body portion mounted on a first pivot pin and biased toward a locked or latched position from a guide or coupled position by a first biasing member or torsion spring. A first stop member also extends from the body portion. The first tooth portion 686*a*, the first body portion and the first stop member form a first latch member functionally identical to the first latch member of the first embodiment. The rear binding member 644*b* basically includes the second tooth portion 686*b* mounted on a pivot pin and biased toward a locked or latched position from guide or coupled position by a second biasing member or torsion spring. A second stop member also extends from the body portion. The second tooth portion 686*b*, the second body portion and the second stop member form a second latch member functionally identical to the second latch member of the first embodiment.

The heel cup 648 is preferably constructed of a hard rigid material. Examples of suitable hard rigid materials for the heel cup 648 include various metals, as well as carbon and/or a metal/carbon combination. The heel cup 648 is an arcuate member that is attached to the side attachment sections 654*a* and 654*b*, respectively, of the base plate 646.

The highback 650 is a rigid member constructed of a hard rigid material. Examples of suitable hard rigid materials for the highback 650 include a hard rigid plastic material or various composite types of materials. Of course, the highback 650 could also be constructed of various metals. The highback 650 has a substantially U-shaped bottom portion with a pair of holes for receiving fasteners to allow adjustment of the highback 650 about a vertical axis. The highback 650 is pivotally coupled to the heel cup 648 by fasteners. The connections between the highback 650, the heel cup 648 and the base plate 646 are relatively conventional. Accordingly, it will be apparent to those skilled in the art that these members could be attached in any number of ways, and that the present invention should not be limited to any particular implementation of these connections.

SEVENTH EMBODIMENT

Referring now to FIGS. 97–120, a snowboard binding system 710 is illustrated in accordance with a seventh embodiment of the present invention. The snowboard binding system 710 basically includes a modified snowboard binding 712 and a modified snowboard boot 714. The snowboard binding system 710 of this seventh embodiment is substantially identical to the snowboard binding system 610 of the sixth embodiment. In particular, the snowboard binding system 710 is identical to the snowboard binding system 610 of the sixth embodiment, except that the front coupling arrangement between the snowboard boot 714 and the snowboard binding 712 have been modified from the snowboard binding system 610. The remaining parts of the snowboard binding 712 and the snowboard boot 714 are identical to the snowboard binding 612 and the snowboard boot 614, respectively. Thus, the remaining parts of the snowboard binding 712 and the snowboard boot 714 will not be discussed and/or illustrated in detail herein. Rather, the following description will focus mainly on the differences of the snowboard binding system 710 from the snowboard binding system 610. Moreover, it will be apparent to those skilled in the art from this disclosure that the descriptions and illustrations of the snowboard binding system 610, apply to the snowboard binding system 710 of this seventh embodiment except as discussed below.

Turning first to the modified snowboard boot 714, the snowboard boot 714 of the present invention is preferably a relatively soft or flexible snowboard boot. The snowboard boot 714 will not be discussed or illustrated in detail herein, except for the new features of the snowboard boot 714 that relate to snowboard binding system 710 of this seventh embodiment of the present invention. Basically, the snowboard boot 714 has a sole portion 722 made of a stiff rubber-like material, and a flexible upper portion 724 constructed of a variety of materials, such as plastic materials, leather and/or synthetic leather materials. The upper portion 724 is basically constructed of a flexible material that is fixedly attached to the sole portion 722 via adhesive molding and/or stitching (not shown). Thus, the upper portion 724 of the snowboard boot 714 should be somewhat flexible. The upper portion 724 has a foot section 724*a* fixedly coupled to the sole portion 722 and a leg section 724*b* extending upwardly from the foot section 724*a*. The upper portion 724 is not critical to the present invention, and thus, will not be discussed or illustrated in further detail herein.

The sole portion 722 is basically constructed of three parts (a mid sole 722*a*, an outer sole 722*b* and a modified front catch 726). More specifically, the mid sole 722*a* has the outer sole 722*b* molded thereon, and the front catch 726 located at a front part of the mid sole 722*a*. The outer sole 722*b* is also molded onto the lower peripheral edge of the upper portion 724 such that the outer sole 722*b* fixedly and 20 securely attaches the upper portion 724 to the mid sole 722*a*. Thus, the sole portion 722 is identical to sole portion 622 (illustrated in FIGS. 46–48 and 56–62), except that the modified front catch 726 explained below.

The front catch 726 is preferably either molded into the mid sole 722*a* or attached thereto via fasteners (not shown). Alternatively, the front catch 726 can merely rest within a front catch receiving recess 727*b* and be held in place by an inner sole or liner and the wearer's foot. The front catch 726 is configured to engage a portion of the snowboard binding 712, as discussed below in more detail.

As seen in FIGS. 98–108, the front catch 726 is similar to the front catch 626. More specifically, the front catch basically includes a U-shaped member with a tongue portion 736 and a pair of leg portions 738 extending upwardly from the tongue portion 736. The leg portions 738 are coupled together by the tongue portion 736 and a two piece mounting plate 739. One part of the mounting plate 739 is integrally formed with one of the leg portions 738, while the other part of the mounting plate 739 is integrally formed with the other of the leg portions 738. The mounting plate 739 rests on the upwardly facing surface of the front catch receiving recess 727*b*, while the leg portions 738 extend through an opening formed in the front catch receiving recess 727*b* such that the tongue portion 736 is located below the mid sole 722*a*.

Preferably, the front catch 726 is constructed of a one-piece, unitary member with the leg portions 738 having a rectangular cross section in a manner similar to the leg portions 638 of the sixth embodiment. On the other hand, the tongue portion 736 is a modified version of the tongue portion 636 of the sixth embodiment. In particular, the tongue portion 736 includes several upper and lower staggered surfaces as discussed below in more detail. In the most preferred embodiment, the front catch 726 is preferably constructed of a hard rigid material, such as steel or any other suitable material. It will be apparent to those skilled in the art from this disclosure that the front catch 726 can be implemented in any number of ways, and the present invention is not limited to the particular implementations shown in the drawings, which are provided merely for purposes of illustration.

The tongue portion 736 is preferably a substantially T-shaped member that has a main section 736*a* and a rear section 736*b* as best seen in FIGS. 102–108. The main section 736*a* extends between the leg portions 738, while the rear section 736*b* projects rearwardly from the main section 736*a* beyond the leg portions 738. Thus, the tongue portion 736 has a forward to rearward dimension $D_1$ that is larger than the forward to rearward dimensions $D_2$ of the leg portions 738 as seen in FIG. 6. By having an elongated tongue portion 736, the front catch 726 can be more easily engaged with the snowboard boot binding 712 as discussed below.

In this embodiment, the rear section 736*b* preferably has a smaller cross-sectional shape than the main section 736*a*. The tongue portion 736 also preferably has a non-planar lower surface 736*c* and a non-planar upper surface 736*d*. Thus, the lower surface 736*c* forms a lower periphery of the front catch 726. The lower surface 736*c* and the upper surface 736*d* are designed to engage part of the binding 712, as discussed below.

Figure 108:
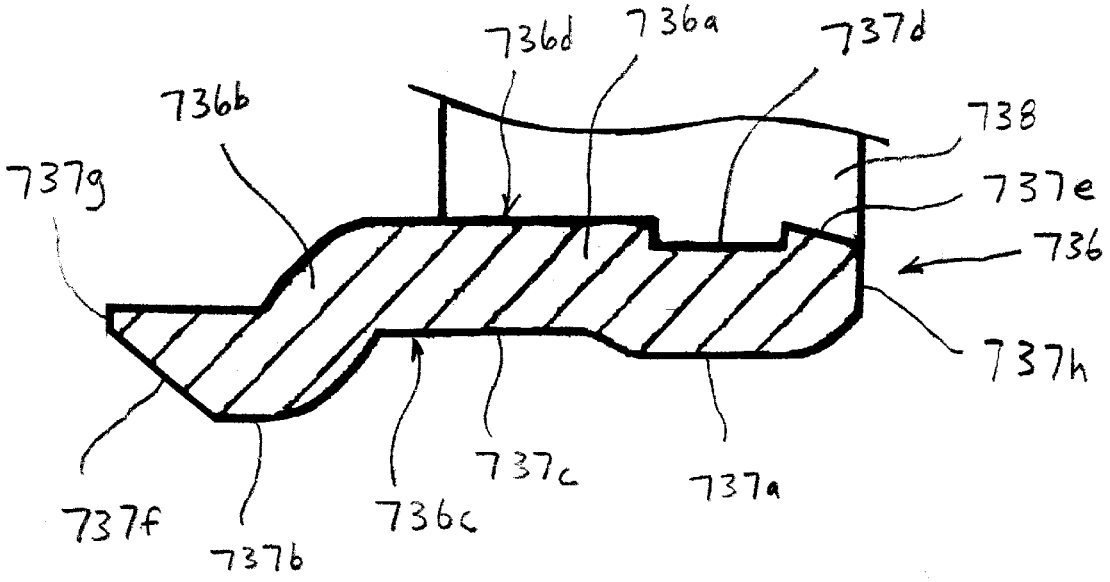
FIG. 108 is a further enlarged, partial cross-sectional view of the front catch illustrated in FIGS. 102–107, as seen along section line 106—106 of FIG. 102.
Figure 109:
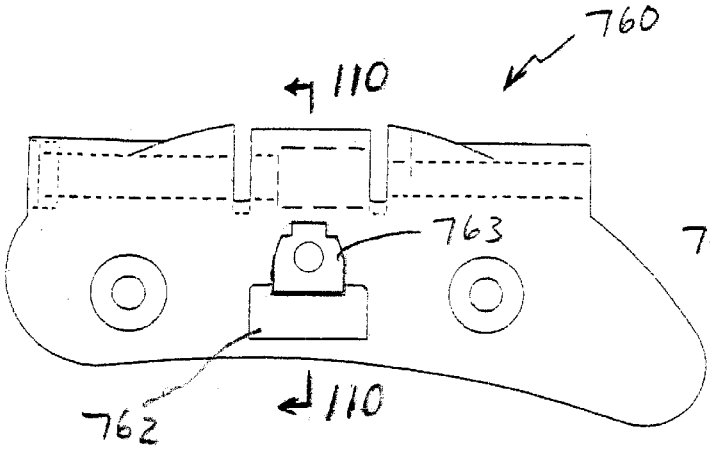
FIG. 109 is a top plan view of the front binding plate (of the front binding arrangement of the snowboard binding) of the snowboard binding system illustrated in FIGS. 97–101.
Figure 110:
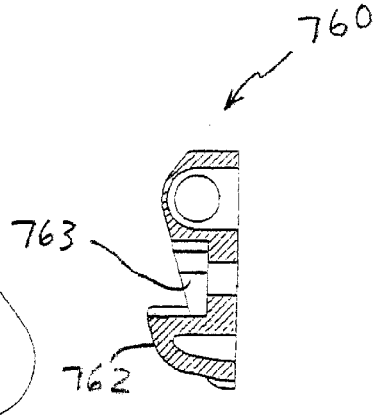
FIG. 110 is a cross-sectional view of the front binding plate illustrated in FIG. 109, as seen along section line 110—110 of FIG. 109.
Figure 111:
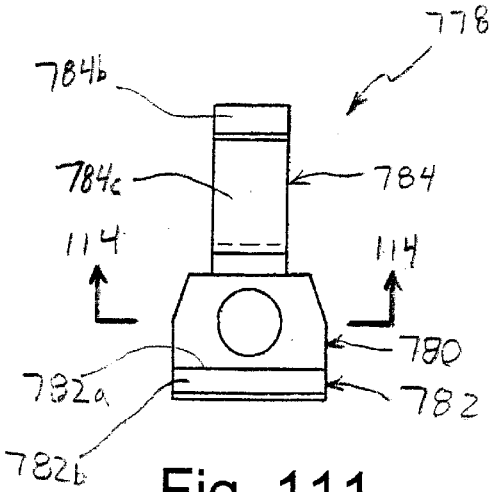
Figure 112:
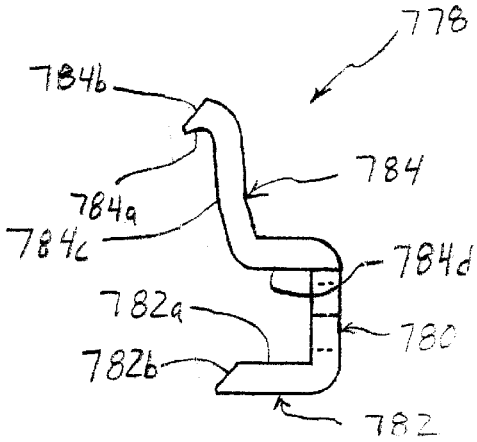
Figure 113:
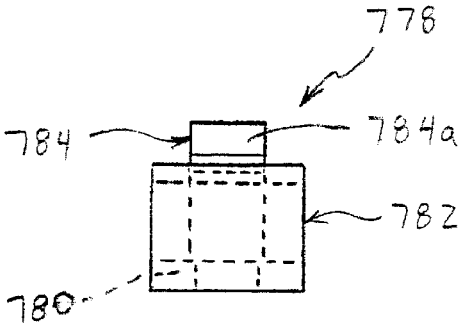
Figure 114:
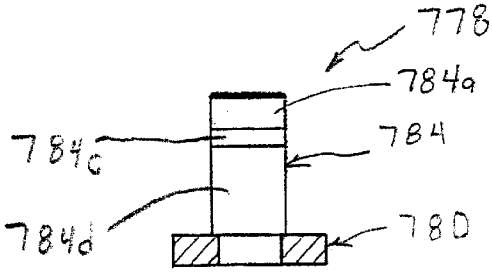
Figure 115:
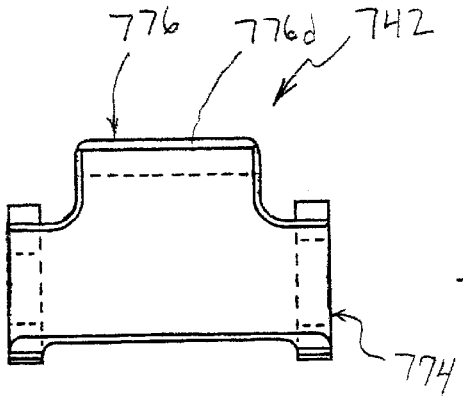
Figure 116:
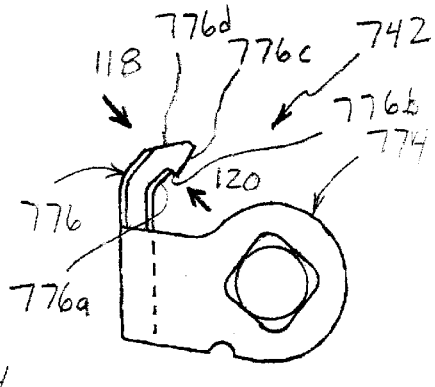
Figure 117:
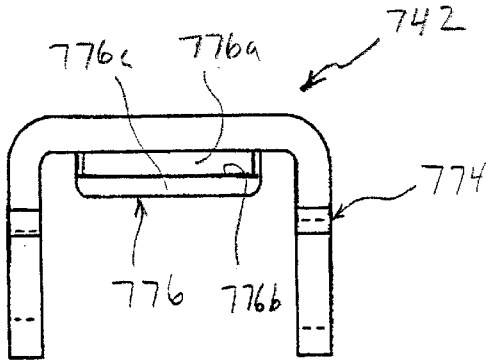
Figure 118:
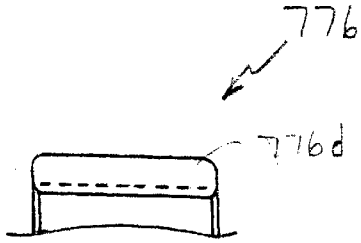
Figure 119:
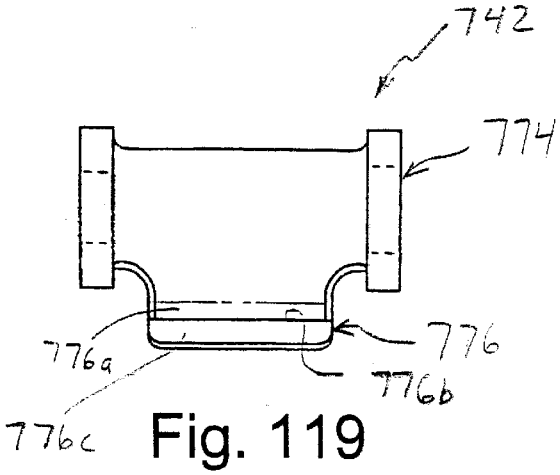
Figure 120:
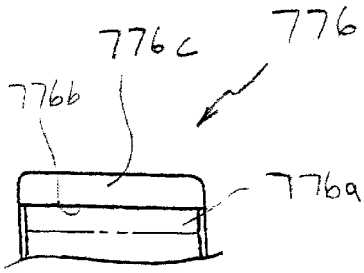

More specifically, the lower surface 736*c* of the tongue portion 736 has a front end 737*a* lying in a plane closer to the sole portion 722 than a rear end 737*b* as best seen in FIG. 108. An intermediate section 737*c* of the lower surface 736*c* is located longitudinally between the front and rear ends 737*a* and 737*b*. The intermediate section 737*c* of the lower surface 736*c* lies in a plane closer to the sole portion 722 than the front end 737*a* and is partially formed on both the main section 736*a* and the rear section 736*b* of the tongue portion 736.

The upper surface 736*d* of the tongue portion 736 is preferably substantially parallel to the lower surface 736*c*, except the upper surface 736*d* includes a recess 737*d* and an inclined surface 737*e* formed at the front end of the upper surface 736*d*. The recess 737*d* is located adjacent a contact surface 737*e* to form the front free end of the upper surface 736*d*. The recess 737*d* and the inclined surface 737*e* of the upper surface 736*d* form a non-planar claw engaging surface at the front end of the upper surface 736*d*. In other words, the lower and upper surfaces 736*c* and 736*d* have generally the same shape such that the tongue portion 736 has a substantially constant thickness.

The claw engaging surface of the upper surface 736*d* is configured to mate with a portion of the snowboard binding 712 to limit upward movement of the snowboard boot relative to the snowboard binding 712. Moreover, the engagement or mating arrangement between the claw engaging surface and the portion of the binding 712 is configured to limit longitudinal movement of the front catch 726 when coupled to the snowboard binding, as discussed below in more detail.

The tongue portion 736 not only secures the front portion of the snowboard boot 714 to the snowboard boot binding 712, but also engages the snowboard boot binding 712 to prevent forward and/or rearward movement as explained below. In particular, the tongue portion 736 is configured to be received in a catch receiving area of the snowboard binding 712. Specifically, the tongue portion has front and rear ends that are configured to selectively contact parts of the binding 712 at opposite ends of the catch receiving area.

More specifically, at the rear end of the tongue portion 736, an inclined end surface 737*f* extends upwardly and rearwardly from the rear end 737*b* of the lower surface 736*c*. Additionally, a rear edge surface 737*g* extends upwardly from the inclined end surface 737*f* to the upper surface 736*d* to form a rear abutment or stop surface of the front catch 726. Similarly, a front edge surface 737*h* extends between the front end 737*a* of the lower surface 736*c* and the front inclined surface 737*e* of the upper surface 736*d* to form a front abutment or stop surface of the front catch 726.

The inclined end surface 737*f* acts as a guide surface during the engagement process with a portion of the snowboard binding 712, as discussed below. The rear edge surface 737*g* is configured to selectively contact a portion of the binding 712 such that the front catch 726 is held securely against rearward longitudinal movement relative to the snowboard binding 712, as also discussed below in more detail. Similarly, the front edge surface 737*h* is configured to selectively contact a portion of the binding 712 such that the front catch 726 is held securely against forward longitudinal movement relative to the snowboard binding 712, as also discussed below in more detail.

Preferably, the pair of leg portions 738 have generally rectangular cross sections as seen along a section line that is parallel to the longitudinal axis B.

Referring to FIGS. 97-101, the modified snowboard binding 712 will now be discussed in more detail. The snowboard binding 712 has a base member 740, a front binding member 742 and a pair (first and second) of rear binding members 744*a* and 744*b*. The front binding member 742 is movably coupled to the base member 740 between a release position and a latched position. The pair (first and second) of rear binding members 744*a* and 744*b* are coupled to opposite lateral sides of the base member 40 as discussed in more detail below.

The base member 740 is attached to the top or upper surface of the snowboard 16 via four fasteners or screws 18 (illustrated in FIG. 1) in a manner identical to the snowboard binding 612 of the sixth embodiment. It will be apparent to those skilled in the art from this disclosure that a pair of snowboard binding systems 710 are utilized in conjunction with the snowboard 16 such that the rider has both feet firmly attached to the snowboard 16. Preferably, two adjustment disks 720 are used to adjustably couple the pair of snowboard binding systems 710 to the snowboard 16 via the screws 18. For the sake of brevity, only a single snowboard binding system 710 will be discussed and/or illustrated herein.

The base member 740 basically includes a base plate 746 adjustably coupled to the snowboard 16 via the adjustment disk 720, a heel cup 748 adjustably coupled to the base plate 746 and a highback 750 adjustably coupled to the heel cup 748. The base member 740 has a longitudinal center axis B extending between the front portion of the base member 740 (i.e., the binding plate 760) and the rear portion of the base member 740 (i.e., the heel cup 748 and the highback 750).

The first and second rear binding members 744*a* and 744*b*, the heel cup 748 and the highback 750 are identical to corresponding parts of the sixth embodiment, and thus, these parts will not be discussed in detail herein.

Similar to the sixth embodiment, the rear binding members 744*a* and 744*b* are movable relative to the base member 740 to selectively hold the snowboard boot 714 thereto. The rear binding members 744*a* and 744*b* form a rear binding arrangement.

The rear binding members 744*a* and 744*b* are arranged to move laterally apart relative to each other from the initial rest positions or latched positions to the guide positions or coupling positions upon application of a force in a direction substantially towards the base member 740.

The rear binding members 744*a* and 744*b* are also arranged to move laterally toward each other or together to one of the locked or latched positions upon removal of the force. The rear binding members 744*a* and 744*b* are movable relative to the base member 740 to selectively hold the snowboard boot 714 thereto in a manner identical to the sixth embodiment. Thus, the rear binding members 744*a* and 744*b* are arranged to selectively hold the snowboard boot 714 in a plurality of engagement or locked or latched positions having different heights above the base member 740.

The front binding member 742 is movably coupled to the base plate 746 of the snowboard binding 712 via a modified front binding plate 760 to move between a release position and a latched position. A modified front stop plate or member 778 is fixedly coupled to the front binding plate 760. The front binding plate 760, the front binding member 742 and the front stop member 778 form parts of a modified front binding arrangement, as discussed below. The remaining parts of the snowboard binding 712 (e.g. parts other than the front binding plate 760, the front binding member 742 and the front stop member 778) are identical to the parts of the snowboard binding 612 of the sixth embodiment.

Accordingly, it will be apparent to those skilled in the art from this disclosure that the descriptions and illustrations of the parts of the snowboard binding 612 also apply to the parts of the snowboard binding 712, except for these modified parts, which are discussed below. Moreover, it will be apparent to those skilled in the art from this disclosure that that the snowboard binding 712 operates in substantially the same manner as in the prior embodiments.

The base member 740 is identical to the base member 640 of the sixth embodiment except that the base member 740 has the modified front binding plate 760 coupled thereto.

As seen in FIGS. 97–101, the modified front binding plate 760 is fixedly coupled to the base plate 740 to form a front portion of the base member 740. The front binding member 742 is movably coupled to the binding plate 760 in a manner identical to the sixth embodiment. Thus, when the binding plate 760 is fixedly coupled to the base plate 746, the front binding member 742 is movably coupled to the base member 740. The front binding member 742 is preferably pivotally coupled to the binding plate 760 via a front release lever 764 which functions as a front pivot pin for the front binding member 742 in a manner identical to the sixth embodiment.

The binding plate 760 is identical to the binding plate 660 of the sixth embodiment, except that is configured to be used with the modified stop member 778, as discussed below. Thus, the front binding plate 760 will not be discussed and/or illustrated in detail herein. Rather, the following description will focus mainly on the differences between the front binding plate 760 and the front binding plate 660 of the sixth embodiment. Moreover, it will be apparent to those skilled in the art from this disclosure that the descriptions and illustrations of the front binding plate 660 apply to the front binding plate 760 except as explained below.

The front binding plate 760 basically includes a front guide member or ramp 762 extending upwardly relative to the upper surface of the front portion of the base member 740. The front guide member 762 is located immediately rearwardly of the front binding member 742. A modified stop member receiving recess 763 is formed between the guide member 762 and the front binding member 742 as seen in FIGS. 98–101, 109 and 110. The front guide member 762 is designed to engage the snowboard boot 714 during disengagement of the snowboard boot 714 from the snowboard binding 712 in a manner identical to the sixth embodiment. Other than the shape of the stop member receiving recess 763, the front binding plate 760 is identical to the front binding plate 660 of the sixth embodiment.

As seen in FIGS. 98–101 and 111–114, the front stop member 778 is fixedly coupled within the stop member receiving recess 763 of the front binding plate 760. The front stop member 778 is preferably constructed of a hard rigid material such as metal. The front stop member 778 basically includes a mounting portion 780, a rear stop portion 782 and a front stop portion 784, as seen in FIGS. 109–112. The mounting portion 780 and the rear stop portion 782 are functionally similar to the stop member 678 of the sixth embodiment. However, the stop member 678 of the sixth embodiment does not include the front stop portion 784 of this seventh embodiment. Thus, the mounting portion 782 basically includes a through hole configured to receive a fastener (shown in hidden lines in FIGS. 98 and 99) to fixedly couple the stop member 778 to the front binding plate 760.

The mounting portion 780 and the rear stop portion 782 together form an L-shaped cross-section as viewed in the transverse direction. The front stop portion 784 also basically forms a substantially L-shaped cross-section as viewed in the transverse direction with a portion of the front binding plate 760 being arranged below the front stop portion 784. The rear stop portion 782 includes a rear stop surface 782*a* and a guide surface 782*b* extending upwardly and rearwardly from the rear stop surface 82*a*. The rear stop surface 782*a* faces substantially in a forward direction and is designed to selectively contact the tongue portion 736 of the front catch 726 in a manner identical to the sixth embodiment.

More specifically, the guide surface 782*b* is configured to guide the inclined edge surface 737*f* of the tongue portion 736 into the catch receiving area. The rear stop surface 782*a* is configured to selectively contact the rear edge surface 737*g* of the tongue portion 736 when the tongue portion is located in the front catch receiving area to limit rearward longitudinal movement of the rear catch 726 relative to the binding 712.

The front stop portion 784 includes a front stop surface 784*a*, an abutment surface 784*b*, an upper contact or control surface 784*c* and a connecting surface 784*d*. The front stop surface 784*a* is located at the forward free end and faces substantially in a rearward direction. The abutment surface 784*b* is formed on the front side surface of the forward free end and faces forward and upward from the snowboard binding 712. The front stop surface 784*a* is configured to selectively contact part of the front catch 726.

More specifically, the front stop surface 784*a* is configured to selectively contact the front edge surface 737*h* of the tongue portion 736 to limit forward longitudinal movement of the front catch 726. The abutment surface 784*b* is configured to selectively contact part of the front binding member 742 to limit rearward rotational movement of the front binding member. The front stop surface 784*a* and the abutment surface 784*b* form a substantially V-shaped free end flange of the front stop portion 784.

The upper contact or control surface 784*c* is configured to contact the lower surface 736*c* of the tongue portion 736 to limit downward movement of the front catch 726. The contact surface 784*c* extends rearwardly from the front stop surface 784*a*. The connecting surface 784*d* extends downwardly from the contact surface 784*c* to the mounting portion 780. The front stop surface 784*a* is configured to limit forward longitudinal movement of the front catch 726 relative to the stop member 778. The contact surface 784*c* is basically formed of a pair of planar surfaces that are angled relative to each to maintain contact with the lower surface 736*c* of the front catch 726.

As best seen in FIGS. 98–101 and 115–120, the front binding member 742 basically includes a mounting portion 774 with a binding flange or front claw 776 integrally formed therewith. The mounting portion 774 is identical to the mounting portion 664 of the sixth embodiment and is non-rotatably coupled to the release lever 764 for rotation between a latched position and a release position about a front pivot axis in a manner identical to the sixth embodiment. The front claw 776 is a modified version of the front claw 676 of the sixth embodiment. The front pivot axis of the front binding member 742 is arranged below the front binding plate 760 such that front claw 776 can be moved out of engagement with the front catch 726 (i.e. to the release position) in manner identical to the sixth embodiment.

The front claw 776 includes a recessed surface 776*a*, an abutment surface 776*b*, a contact surface 776*c* and an inclined surface 776*d*. The contact surface 776*c* is located on a lower side of the front claw 776 and extends to a free end. The recessed surface 776*a* is offset from and slightly angled relative to the contact surface 776*c*. The abutment surface 776*b* extends between the recessed surface 776*a* and the contact surface 776*c* and forms substantially a right angle with both the recessed surface 776*a* and the contact surface 776*c*. The inclined surface 776*d* is located on an upper side of the front claw 776 and is angled relative to the contact surface 776*c* to form a substantially V-shaped free end.

The ramp or inclined surface 776*d* acts as a guide surface when the front catch 726 is moved downward. The recessed surface 776*a*, abutment surface 776*b* and the contact surface 776*c* form parts of a catch engaging surface that is a non-planar surface that faces generally towards the base member 740 when the front binding member 742 is in the engaged or latched position. Therefore, the inclined surface 776*d* faces generally away from the base member 740 when the front binding member 742 is in the engaged or latched position.

The front claw 776 is designed such that the inclined surface 776*d* aids in the engagement of the front catch 726 with the front claw 776. In other words, the tongue portion 736 of the front catch 726 can easily slide along the inclined surface 776*d* to allow for easy entry of the front catch 726 beneath the front claw 776. Moreover, when the front catch 726 applies a downward force on the inclined surface 776*d*, the front binding member 742 rotates to allow entry of the front catch into the catch receiving area in a manner similar to the sixth embodiment. The release lever is then moved to rotate the front claw 776 into the engaged position. In the engaged position, the inclined surface 737*e* of the tongue portion 736 engages the recessed surface 776*a* to couple the boot 714 to the binding 712.

In the latched position, the tongue portion 736 is located between the rear stop surface 782*a* and the front stop surface 784*a* of the stop member 778 to prevent forward/rearward movement of the front catch 726 relative to the base member 740. Moreover, the catch engaging surface and the claw engaging surface fit together in a substantially meshed arrangement when the front catch 726 is arranged in the front catch receiving area and the front claw 776 is in the engaged position to limit longitudinal movement therebetween.

More specifically, the tongue portion 736 of the front catch 726 has a longitudinal dimension slightly smaller than the distance between the front stop surface 784*a* and the rear stop surface 782*a* as measured along a center longitudinal axis of the tongue portion (when located in the engaged position). The upper surface 784*c* of the front stop portion 784 of the stop member 778 acts as a contact surface with the front catch 726 when engaged with the snowboard binding 712 to limit downward movement of the front catch 726 and provide a secure engagement feel to the rider.

Moreover, due to the configuration of the lower surface 736*c* of the front catch 726 and the inclined upper surfaces of the upper surface 784*c* of the front stop portion 784, continuous contact between the front catch 726 and the stop member 778 is maintained. In particular, during riding, forces are continually applied to the front catch 726 and the front binding arrangement, which can cause the tongue portion 736 to move slightly. However, due to the configuration of the front catch 726 and the front stop portion 784, continuous contact between the front catch 726 and the stop member 778 is maintained.

Figure 100:
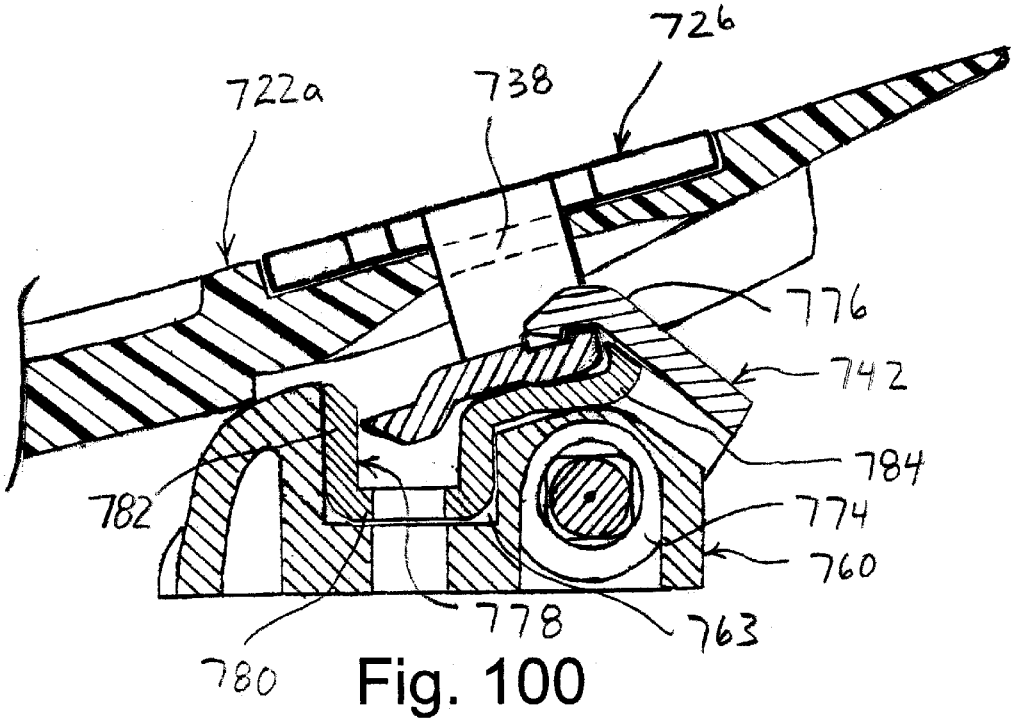
FIG. 100 is an enlarged, partial cross-sectional view of the front binding member (front claw), front stop member and front catch (coupled to the mid sole) of the snowboard binding system illustrated in FIG. 97, with the front claw in a latched position engaging the front catch.
Figure 101:
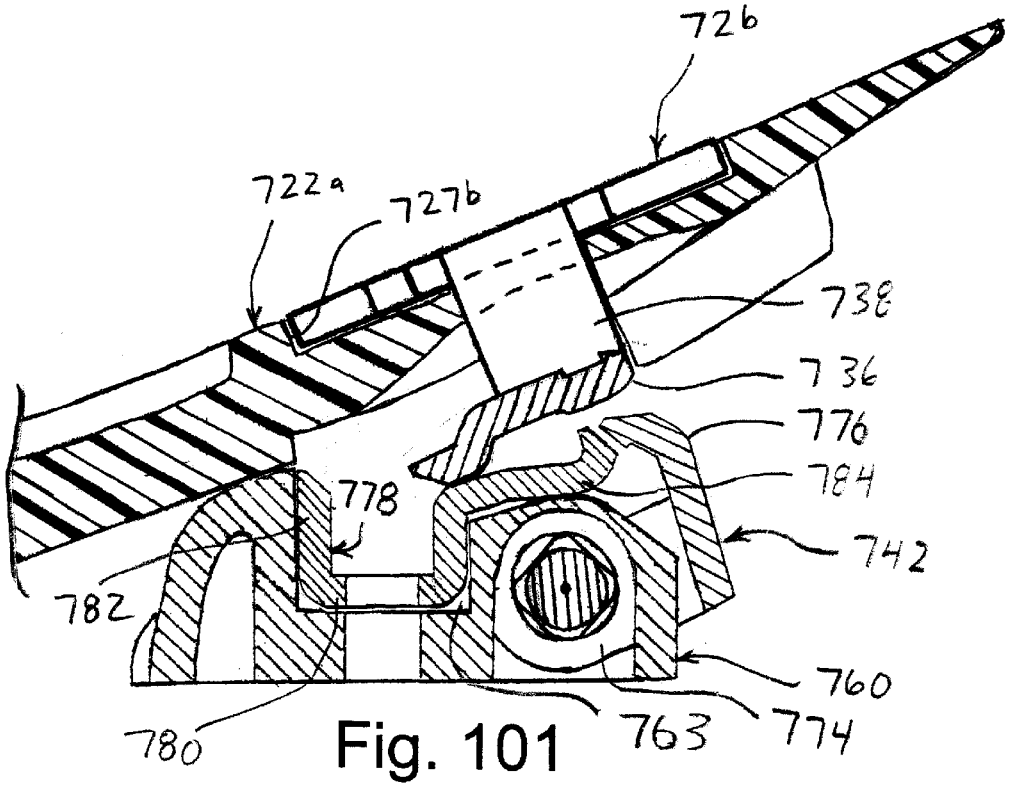
FIG. 101 is an enlarged, partial cross-sectional view of the front binding member (front claw), front stop member and front catch (coupled to the mid sole) of the snowboard binding system illustrated in FIG. 97, with the front claw in a release position and the sole in an intermediate releasing position.
Figure 102:
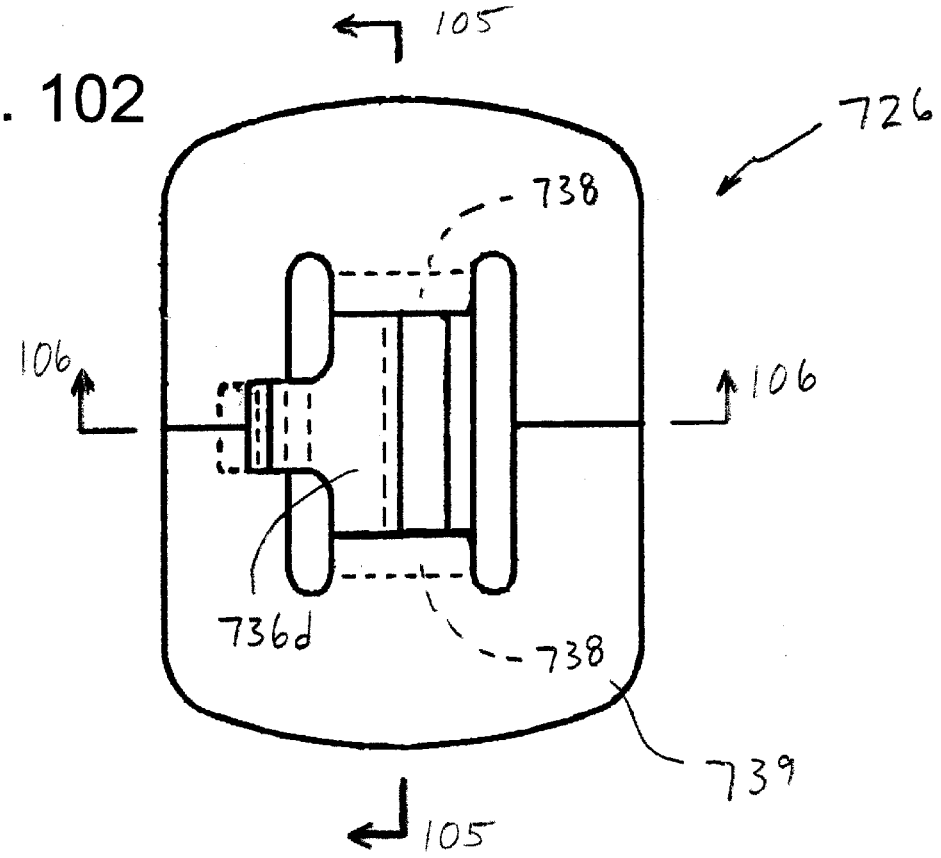
FIG. 102 is an enlarged top plan view of the front catch (of the snowboard boot) of the snowboard binding system illustrated in FIGS. 97–101.
Figure 103:
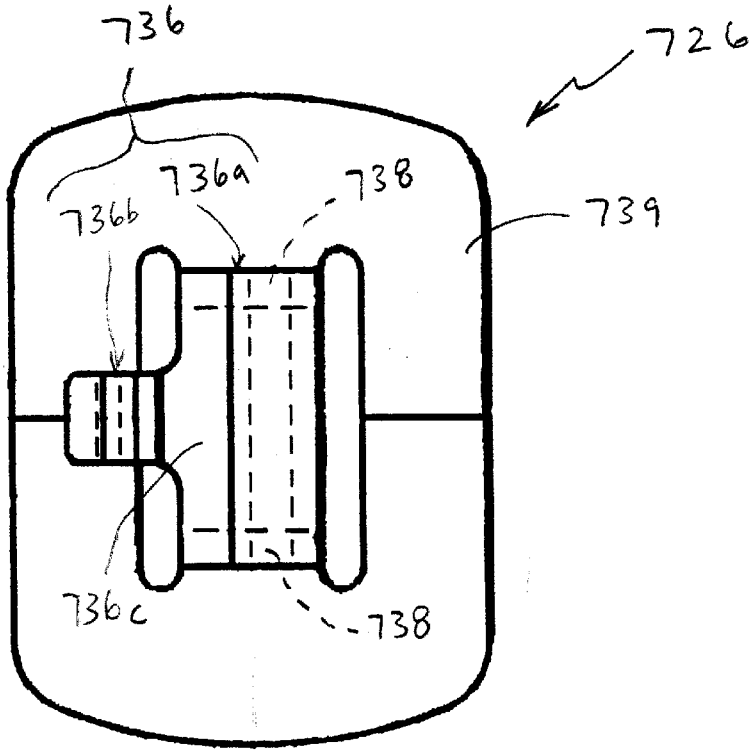
FIG. 103 is a bottom plan view of the front catch illustrated in FIG. 102.
Figure 104:
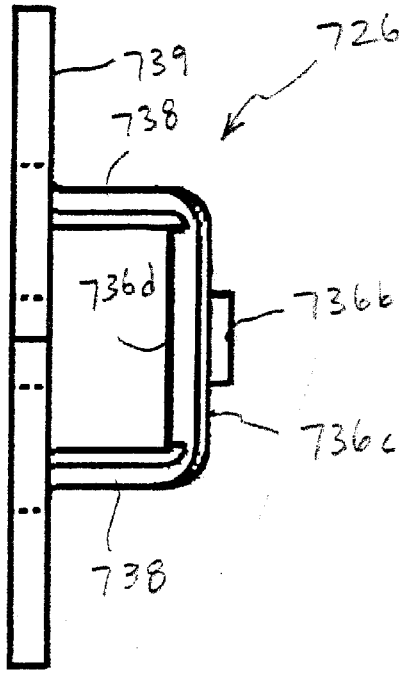
FIG. 104 is a front elevational view of the front catch illustrated in FIGS. 102 and 103.
Figure 105:
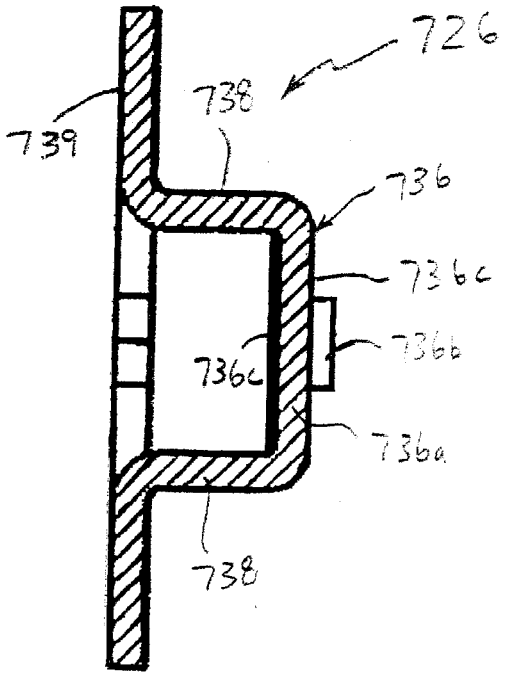
FIG. 105 is a cross-sectional view of the front catch illustrated in FIGS. 102–104, as seen along section line 105—105 of FIG. 102.
Figure 106:
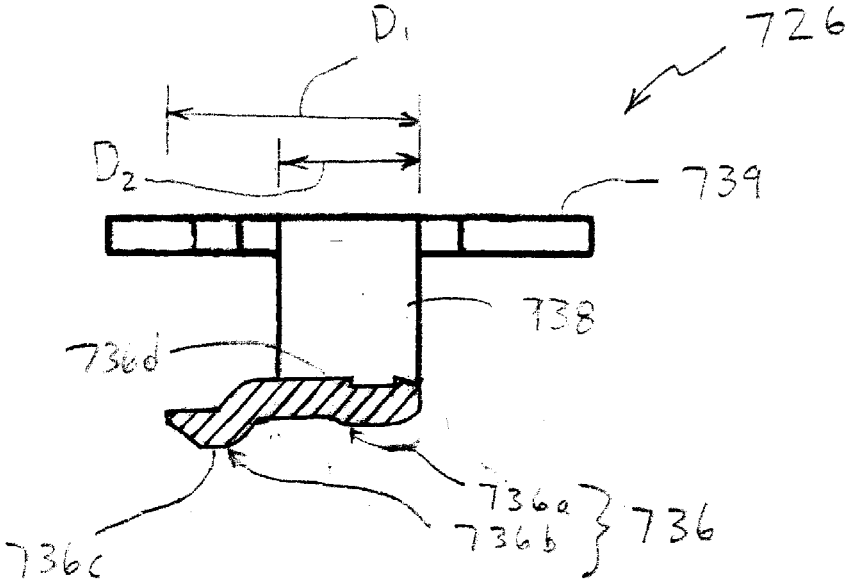
FIG. 106 is a cross-sectional view of the front catch illustrated in FIGS. 102–105, as seen along section line 106—106 of FIG. 102.
Figure 107:
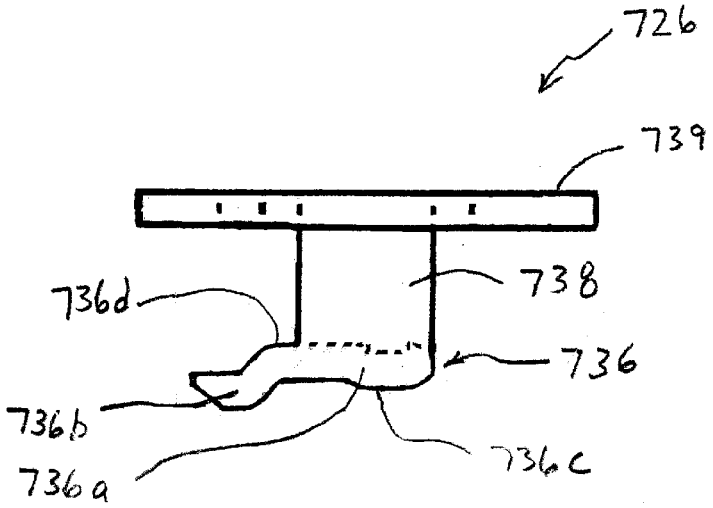
FIG. 107 is a side elevational view of the front catch illustrated in FIGS. 102–106.

When the front catch 726 is located in the area beneath the front claw 776, the release lever 764 can be manually rotated to move the front claw 776 from a latched position as seen in FIG. 100 to a release position as seen in FIG. 101. When the front claw 776 is located in the release position, the front catch 726 can be easily removed the base member 740.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A snowboard binding comprising:

a base member having a front portion, a rear portion and a longitudinal axis extending between said front and rear portions;

a rear binding arrangement coupled to said rear portion of said base member; and a front binding arrangement coupled to said front portion of said base member, said front binding arrangement including a front claw and a stop member that form a front catch receiving area, said front claw being pivotally coupled to said front portion of said base member to move between a release position and a latched position, said stop member being coupled to said front portion of said base member adjacent said front claw, said stop member having a front stop surface facing in a rearward direction that is substantially facing toward said rear portion of said base member to prevent a front catch of a boot from moving said front claw from said latched position to said release position when the front catch is located in said front catch receiving area.

2. A snowboard binding according to claim 1, wherein said stop member includes a rear stop surface facing in a forward direction that is substantially opposite to said rearward direction.

3. A snowboard binding according to claim 1, wherein said stop member includes a guide surface arranged to guide the front catch into said front catch receiving area.

4. A snowboard binding according to claim 1, wherein said front claw has a front catch engaging surface located above said catch receiving area and facing generally towards said base member when said front claw is in said latched position.

5. A snowboard binding according to claim 1, wherein said stop member includes a front flange extending upwardly to form said front stop surface.

6. A snowboard binding according to claim 1, wherein said front binding arrangement further includes a release lever coupled to a mounting portion of said front claw to move said front claw between said latched position and said release position.

7. A snowboard binding according to claim 2, wherein said rear stop surface is located behind said front claw.

8. A snowboard binding according to claim 4, wherein said front catch engaging surface is a non-planar surface adapted to mate with a surface of the front catch.

9. A snowboard binding according to claim 5, wherein said front flange includes an abutment surface arranged to selectively contact said front claw to limit rotational movement of said front claw.

10. A snowboard binding according to claim 7, wherein said stop member includes a rear guide surface that extends upwardly and rearwardly from said rear stop surface to guide the front catch into said front catch receiving area.

11. A snowboard boot comprising:

an upper portion including a foot section and a leg section extending upwardly from said foot section;

a sole portion fixedly coupled to said foot section of said upper portion, said sole portion having a toe section, a mid section and a heel section with a forward to rearward longitudinal axis extending between said toe section and said heel section;

at least one rear catch located at said heel section of said sole portion; and a front catch coupled to said toe section of said sole portion, said front catch having a pair of leg portions extending downwardly from said toe section of said sole portion and a tongue portion extending laterally between said leg portions of said front catch, said tongue portion of said front catch having a non-planar lower surface with a front end and a rear end, said rear end of said lower surface being spaced further from said sole portion than said front end of said lower surface.

12. The snowboard boot according to claim 11, wherein said tongue portion of said front catch has a forward to rearward dimension that is larger than forward to rearward dimensions of said leg portions of said front catch.

13. The snowboard boot according to claim 11, wherein said tongue portion has a main section and a rear section projecting rearwardly from said main section with a smaller cross-sectional shape than said main section.

14. The snowboard boot according to claim 11, wherein said tongue portion includes a claw engaging surface facing substantially toward said sole portion and substantially in an opposite direction from said lower surface.

15. The snowboard boot according to claim 11, wherein said front catch further includes a mounting plate extending between said leg portions of said front catch, with said mounting plate contacting an interior surface of said sole portion.

16. The snowboard boot according to claim 11, wherein said tongue portion includes an angled rear end surface extending from said rear end of said lower surface.

17. The snowboard boot according to claim 11, wherein said at least one rear catch includes first and second rear catches located at first and second lateral sides of said heel section of said sole portion.

18. The snowboard boot according to claim 12, wherein said tongue portion has a main section extending between said leg portions and a rear section projecting rearwardly beyond said leg portions with a smaller cross-sectional shape than said main section.

19. The snowboard boot according to claim 14, wherein said claw engaging surface is a non-planar surface adapted to mate with a surface of a front claw of a binding.

20. The snowboard boot according to claim 17, wherein said first and second rear catches include a plurality of first and second notches that extend in a longitudinal direction of said sole portion.

21. A snowboard binding system comprising:

a snowboard binding including a base member having a front portion, a rear portion and a binding longitudinal axis extending between said front and rear portions, a rear binding arrangement coupled to said rear portion of said base member, and a front binding arrangement coupled to said front portion of said base member, said front binding arrangement including a front claw and a stop member that form a front catch receiving area, said front claw being pivotally coupled to said front portion of said base member to move between a release position and a latched position, said stop member being coupled to said front portion of said base member adjacent said front claw; and a snowboard boot configured to be releasably coupled to said snowboard binding, said snowboard boot including an upper portion including a foot section and a leg section extending upwardly from said foot section, a sole portion fixedly coupled to said foot section of said upper portion, said sole portion having a toe section, a mid section and a heel section with a forward to rearward longitudinal axis extending between said toe section and said heel section, at least one rear catch located at said heel section of said sole portion, said at least one rear catch being configured to be releasably coupled to said rear binding arrangement, and a front catch coupled to said toe section of said sole portion, said front catch being configured to be releasably coupled to said front binding arrangement via said front claw, said front claw, said stop member and said front catch being arranged and configured to prevent said front catch of said boot from moving said front claw from said latched position to said release position when said front catch is located in said front catch receiving area.

22. The snowboard binding system according to claim 21, wherein said stop member has a front stop surface facing in a rearward direction that is arranged to selectively contact said front catch when said front catch is located in said front catch receiving area.

23. The snowboard binding system according to claim 21, wherein said front claw has a non-planar front catch engaging surface that mates with a non-planar claw engaging surface of said front catch when said front catch is located in said front catch receiving area and said front claw is in said latched position.

24. The snowboard binding system according to claim 21, wherein said front binding arrangement further includes a release lever coupled to a mounting portion of said front claw to move said front claw between said latched position and said release position.

25. The snowboard binding system according to claim 21, wherein said at least one rear catch includes first and second rear catches located at first and second lateral sides of said heel section of said sole portion.

26. The snowboard binding system according to claim 22, wherein said stop member includes a rear stop surface facing in a forward direction that is substantially opposite to said rearward direction, said rear stop surface being arranged to selectively contact said front catch when said front catch is located in said front catch receiving area.

27. The snowboard binding system according to claim 22, wherein said front catch has a non-planar lower surface that at least partially contacts said stop member to prevent downward movement of said front catch relative to said binding when said front catch is located in said front catch receiving area.

28. The snowboard binding system according to claim 22, wherein said stop member includes a front flange portion extending upwardly to form said front stop surface.

29. The snowboard binding system according to claim 26, wherein said front catch has a pair of leg portions extending downwardly from said toe section of said sole portion and a tongue portion extending laterally between said leg portions, said tongue portion being arranged between said front and rear stop surfaces of said stop member when said tongue portion is located in said front catch receiving area.

30. The snowboard binding system according to claim 26, wherein said stop member includes a rear guide surface that extends upwardly and rearwardly from said rear stop surface to guide said front catch into said front catch receiving area.

31. The snowboard binding system according to claim 26, wherein said front catch includes a rear guide surface that extends upwardly and rearwardly to guide said front catch into said front catch receiving area.

32. The snowboard binding system according to claim 28, wherein said front flange portion includes an abutment arranged to selectively contact said front claw to limit rotational movement of said front claw.

33. The snowboard binding system according to claim 29, wherein said front claw has a non-planar front catch engaging surface that mates with a non-planar claw engaging surface of said tongue portion when said tongue portion is arranged in said front catch receiving area and said front claw is in said latched position.

34. The snowboard binding system according to claim 32, wherein said tongue portion of said front catch has a forward to rearward dimension that is larger than forward to rearward dimensions of said leg portions of said front catch.

35. The snowboard binding system according to claim 33, wherein said front catch engaging surface faces substantially downward toward said front catch receiving area and said front claw engaging surface faces substantially in a direction opposite said front catch engaging surface when said tongue portion is. arranged in said front catch receiving area and said front claw is in said engaged position.

36. The snowboard binding system according to claim 34, wherein said tongue portion has a main section extending between said leg portions and a rear section projecting rearwardly beyond said leg portions with a smaller cross-sectional shape than said main section.

* * * * *